US012098560B2

(12) United States Patent
Matsuno et al.

(10) Patent No.: US 12,098,560 B2
(45) Date of Patent: Sep. 24, 2024

(54) REBAR TYING TOOL

(71) Applicant: MAKITA CORPORATION, Anjo (JP)

(72) Inventors: Tadasuke Matsuno, Anjo (JP); Yuta Asakura, Anjo (JP)

(73) Assignee: MAKITA CORPORATION, Anjo (JP)

( * ) Notice: Subject to any disclaimer, the term of this patent is extended or adjusted under 35 U.S.C. 154(b) by 276 days.

(21) Appl. No.: 17/764,731

(22) PCT Filed: Aug. 18, 2020

(86) PCT No.: PCT/JP2020/031175
§ 371 (c)(1),
(2) Date: Mar. 29, 2022

(87) PCT Pub. No.: WO2021/070481
PCT Pub. Date: Apr. 15, 2021

(65) Prior Publication Data

US 2022/0325543 A1 Oct. 13, 2022

(30) Foreign Application Priority Data

Oct. 11, 2019 (JP) ..... 2019-188024

(51) Int. Cl.
*E04G 21/12* (2006.01)
*B21F 15/06* (2006.01)
(Continued)

(52) U.S. Cl.
CPC ..... *E04G 21/123* (2013.01)

(58) Field of Classification Search
CPC ..... B65B 13/185; B65B 13/285; B65B 13/28; B65B 27/10; B21F 15/06; E04G 21/123;
(Continued)

(56) References Cited

U.S. PATENT DOCUMENTS

2006/0011254 A1* 1/2006 Yokochi ..... E04G 21/123 140/119
2009/0283168 A1 11/2009 Kusakari
(Continued)

FOREIGN PATENT DOCUMENTS

CN 101585422 A 11/2009
CN 105314142 A 2/2016
(Continued)

OTHER PUBLICATIONS

Mar. 6, 2023 Office Action issued in Chinese Patent Application No. 202080071192.9.
(Continued)

*Primary Examiner* — Mohammed S. Alawadi
(74) *Attorney, Agent, or Firm* — Oliff PLC

(57) ABSTRACT

A rebar tying tool may include a holder, a stopper, a driving roller, and a driven roller. The stopper may be configured to switch between a prohibiting state in which the stopper prohibits a reel from detaching from the holder and an allowing state in which the stopper allows the reel to detach from the holder. The driving roller may be configured to rotate. The driven roller may be configured to switch between a clamped state and a non-clamped state, the wire may be clamped between the driving roller and the driven roller when the driven roller is in the clamped state, and the wire may not be clamped between the driving roller and the driven roller when the driven roller is in the non-clamped state. The driven roller may be in the non-clamped state at all times while the stopper is in the allowing state.

23 Claims, 34 Drawing Sheets

(51) Int. Cl.

| | |
|---|---|
| ***B65B 13/18*** | (2006.01) |
| ***B65B 13/28*** | (2006.01) |
| ***B65B 27/10*** | (2006.01) |
| ***B65H 75/14*** | (2006.01) |
| ***E04C 5/16*** | (2006.01) |

(58) Field of Classification Search
CPC ..... B65H 2701/362; B65H 2701/526; B65H 75/14; E04C 5/162
See application file for complete search history.

(56) References Cited

U.S. PATENT DOCUMENTS

| | | | | |
|---|---|---|---|---|
| 2016/0031575 | A1 | 2/2016 | Shindou | |
| 2016/0031576 | A1 | 2/2016 | Shindou | |
| 2017/0218631 | A1* | 8/2017 | Matsuno | B21F 15/04 |
| 2017/0335582 | A1 | 11/2017 | Machida et al. | |
| 2018/0148943 | A1 | 5/2018 | Itagaki et al. | |
| 2018/0207710 | A1* | 7/2018 | Itagaki | E04G 21/123 |
| 2019/0194958 | A1 | 6/2019 | Machida et al. | |
| 2020/0149279 | A1 | 5/2020 | Matsuno | |
| 2020/0207494 | A1 | 7/2020 | Shindou | |
| 2020/0270881 | A1 | 8/2020 | Machida et al. | |
| 2020/0290759 | A1* | 9/2020 | Yoshida | B65B 13/285 |
| 2020/0378140 | A1 | 12/2020 | Itagaki et al. | |
| 2022/0220755 | A1 | 7/2022 | Itagaki | |

FOREIGN PATENT DOCUMENTS

| | | | |
|---|---|---|---|
| CN | 105314150 | A | 2/2016 |
| CN | 107031891 | A | 8/2017 |
| CN | 107399447 | A | 11/2017 |
| CN | 107709166 | A | 2/2018 |
| CN | 109956072 | A | 7/2019 |
| EP | 3 336 280 | A1 | 6/2018 |
| JP | 2016-30625 | A | 3/2016 |
| JP | 2017-132003 | A | 8/2017 |
| JP | 2019-112868 | A | 7/2019 |
| WO | 2017/014266 | A1 | 1/2017 |

OTHER PUBLICATIONS

Jan. 31, 2023 Office Action Issued in Japanese Patent Application No. 2021-550413.
Nov. 2, 2020 International Search Report issued in International Application No. PCT/JP2020/031175.
Nov. 2, 2020 Written Opinion issed in International Application No. PCT/JP2020/031175.

* cited by examiner

REBAR TYING TOOL

TECHNICAL FIELD

This disclosure herewith relates to a rebar tying tool.

BACKGROUND ART

Japanese Patent Application Publication No. 2019-112868 describes a rebar tying tool. The rebar tying tool includes a holder, a stopper, a driving roller, a driven roller, and a twisting unit. The holder is configured to hold a reel around which a wire is wound. The stopper is configured to switch between a prohibiting state in which the stopper prohibits the reel from detaching from the holder and an allowing state in which the stopper allows the reel to detach from the holder. The driving roller is configured to rotate. The driven roller is configured to switch between a clamped state and a non-clamped state, wherein the wire is clamped between the driving roller and the driven roller when the driven roller is in the clamped state, and the wire is not clamped between the driving roller and the driven roller when the driven roller is in the non-clamped state. The twisting unit is configured to twist the wire clamped between the driving roller and the driven roller and fed around rebars.

SUMMARY OF INVENTION

Technical Problem

When the reel is to be replaced in the above rebar tying tool, firstly the stopper is switched from the prohibiting state to the allowing state. Then, the driven roller is switched from the clamped state to the non-clamped state. Then, the old reel is removed by an operator and a new reel is attached to the holder. Finally, a tip end of a wire wound on the reel is inserted between the driving roller and the driven roller in a state where the driven roller is kept in the non-clamped state by the operator. Due to this, reel replacement work is complicated. Further, in the above rebar tying tool, when a reel is to be attached to the holder in a state where no reel is held by the holder, firstly the stopper is switched from the prohibiting state to the allowing state. Then, the driven roller is switched from the clamped state to the non-clamped state. Then, the new reel is attached to the holder by the operator. Finally, the operator inserts the tip end of the wire wound on the reel is inserted between the driving roller and the driven roller in the state where the driven roller is kept in the non-clamped state by the operator. Due to this, reel attachment work is complicated. The description herein provides an art configured to facilitate reel replacement work and reel attachment work.

Solution to Technical Problem

The present teachings disclose a rebar tying tool. The rebar tying tool is configured to tie rebars with a wire. The rebar tying tool may comprise: a holder; a stopper; a driving roller; a driven roller; a driven roller; and a twisting unit. The holder may be configured to hold a reel around which the wire is wound about a rotation axis. The stopper may be configured to switch between a prohibiting state in which the stopper prohibits the reel from detaching from the holder and an allowing state in which the stopper allows the reel to detach from the holder. The driving roller may be configured to rotate. The driven roller may be configured to switch between a clamped state and a non-clamped state, the wire is clamped between the driving roller and the driven roller when the driven roller is in the clamped state, and the wire is not clamped between the driving roller and the driven roller when the driven roller is in the non-clamped state. The twisting unit may be configured to twist the wire clamped between the driving roller and the driven roller and fed around the rebars. The driven roller may be in the non-clamped state at all times while the stopper is in the allowing state.

In the above configuration, since the driven roller is in the non-clamped state at all times when the stopper is in the allowing state, the tip end of the wire wound on the reel can easily be inserted between the driving roller and the driven roller upon replacing the reel. Due to this, reel replacement work can easily be performed. Further, in the above configuration, when the reel is to be attached to the holder, the tip end of the wire wound on the reel can easily be inserted between the driving roller and the driven roller. Due to this, reel attachment work can easily be performed.

Further, the present teachings disclose a rebar tying tool. The rebar tying tool is configured to tie rebars with a wire. The rebar tying tool may comprise: a holder; a stopper; an operating part; a driving roller; a driven roller; and a twisting unit. The holder may be configured to hold a reel around which the wire is wound about a rotation axis. The stopper may be configured to switch between a prohibiting state in which the stopper prohibits the reel from detaching from the holder and an allowing state in which the stopper allows the reel to detach from the holder. The driving roller may be configured to rotate. The driven roller may be configured to switch between a clamped state and a non-clamped state, in which the wire is clamped between the driving roller and the driven roller when the driven roller is in the clamped state, and the wire is not clamped between the driving roller and the driven roller when the driven roller is in the non-clamped state. The twisting unit may be configured to twist the wire clamped between the driving roller and the driven roller and fed around the rebars. The driven roller may switch from the clamped state to the non-clamped state and the stopper may switch from the prohibiting state to the allowing state when the operating part is operated.

In the above configuration, the driven roller can be switched from the clamped state to the non-clamped state and further the stopper can be switched from the prohibiting state to the allowing state by simply operating only the operating part. Due to this, the reel replacement work and attachment work can easily be performed.

DESCRIPTION OF EMBODIMENTS

Figure 1:
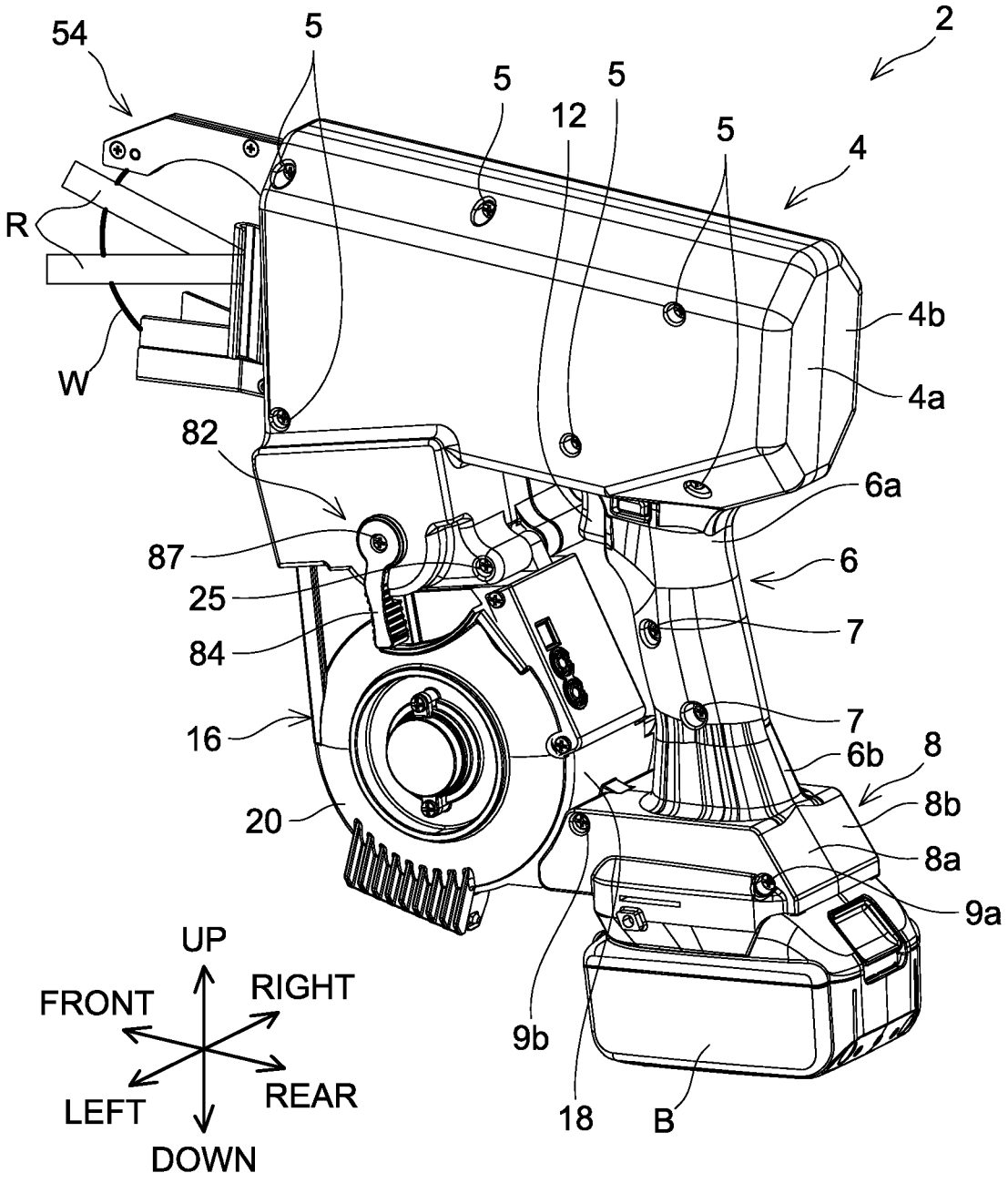
FIG. 1 is a perspective view of a rebar tying tool 2 of a first embodiment with a cover 20 in a prohibiting state.

In one or more aspects, the rebar tying tool may further comprise an operating part configured to move between an open position and a closed position. The driven roller may switch from the clamped state to the non-clamped state and the stopper may switch from the prohibiting state to the allowing state when the operating part is operated from the closed position toward the open position.

In the above configuration, the driven roller can be switched from the clamped state to the non-clamped state and further the stopper can be switched from the prohibiting state to the allowing state by simply operating only the operating part. Due to this, reel replacement work and attachment work can easily be performed.

In one or more aspects, the rebar tying tool may further comprise an operating part configured to move between an open position and a closed position. The driven roller may switch from the non-clamped state to the clamped state and the stopper may switch from the allowing state to the prohibiting state when the operating part is operated from the open position toward the closed position.

In the above configuration, the driven roller can be switched from the non-clamped state to the clamped state and further the stopper can be switched from the allowing state to the prohibiting state by simply operating only the operating part. Due to this, the reel replacement work and attachment work can easily be performed.

In one or more aspects, the rebar tying tool may further comprise a link part disposed between the operating part and the driven roller. The link part may be located in a first position when the operating part is located in the closed position, the driven roller being in the clamped state while the link part is located in the first position. The link part may be located in a second position when the operating part is located in the open position, the driven roller being in the non-clamped state while the link part is located in the second position.

In the above configuration, the driven roller can be switched between the clamped state and the non-clamped state and further the stopper can be switched between the prohibiting state and the allowing state with a simple configuration.

In one or more aspects, the operating part may comprise a cam part. The cam part may be configured to move the link part from the first position to the second position when the operating part is operated from the closed position toward the open position.

In the above configuration, by using the cam part, a direction of operating the operating part and a direction in which the link part moves can be made to differ. Due to this, a size of the rebar tying tool can be suppressed from becoming large as compared to a case in which the direction of operating the operating part and the direction in which the link part moves are same.

In one or more aspects, the operating part may be configured to pivot about a pivot axis. The cam part may gradually extend toward a link part side in a direction along which the pivot axis extends, the cam part gradually extending toward the link part side at a greater degree along one direction about the pivot axis. The cam part may be configured to move the link part from the first position to the second position while being in contact with the link part when the operating part pivots to another direction about the pivot axis.

In the above configuration, as the cam part pivots to the other side about the pivot axis, a position at which the cam part and the link part contact each other gradually changes along the direction in which the pivot axis extends. As a result of this, the link part moves from the first position to the second position. Due to this, the link part can be moved from the first position to the second position by such a simple configuration of the cam part.

In one or more aspects, the rebar tying tool may further comprise a first biasing part configured to bias the link part from the second position toward the first position.

In the above configuration, the driven roller can be biased from the non-clamped state toward the clamped state by the link part being biased from the second position toward the first position.

In one or more aspects, the operating part may comprise a lever part configured to be operated by an operator. The stopper may comprise an engaging part configured to engage with the lever part when the stopper is in the prohibiting state. The lever part may keep the stopper in the prohibiting state when the lever part engages with the engaging part.

In the above configuration, the stopper can be suppressed from switching from the prohibiting state to the allowing state while the lever part is not being operated by the operator.

In one or more aspects, at least a part of the operating part may be disposed between the reel and the driven roller when the rebar tying tool is viewed along a direction in which the rotation axis extends.

Generally, the reel is disposed away from the driven roller in order to pull out the wire from the reel. In the above configuration, a space defined between the reel and the driven roller can be utilized efficiently. Due to this, the size of the rebar tying tool can be suppressed from becoming large.

In one or more aspects, when a direction in which the rebars are disposed as viewed from the twisting unit is a front direction and a direction in which the rotation axis extends is a left-right direction, the operating part may be disposed higher than the reel and lower than the driven roller.

In the above configuration, the operating part is disposed between the reel and the driven roller in an up-down direction. Due to this, the size of the rebar tying tool can be suppressed from becoming large in the up-down direction.

In one or more aspects, the driven roller may be disposed more on one side than the driving roller is in the direction in which the rotation axis extends. The stopper may be disposed more on the one side than the holder is in the direction in which the rotation axis extends.

If the driven roller is disposed more on the one side than the driving roller is in the direction in which the rotation axis extends and the stopper is disposed more on another side than the holder is in the direction in which the rotation axis extends, the driven roller switches from the clamped state to the non-clamped state toward one side, and the stopper switches from the prohibiting state to the allowing state toward the one side. Due to this, the size of the rebar tying tool becomes large in the direction in which the rotation axis extends. In the above configuration, the driven roller switches from the clamped state to the non-clamped state toward one side, and the stopper switches from the prohibiting state to the allowing state toward the one side. Due to this, the size of the rebar tying tool can be suppressed from becoming large in the direction in which the rotation axis extends.

In one or more aspects, the rebar tying tool may further comprise a motor configured to rotate the driving roller. The operating part may be disposed more on the one side than the motor is in the direction in which the rotation axis extends.

If the operating part is disposed more on another side than the motor is in the direction in which the rotation axis extends, a mechanism that switches the driven roller between the clamped state and the non-clamped state by the operating part is disposed traversing across the motor. Due to this, the size of the rebar tying tool becomes large in the direction in which the rotation axis extends. In the above configuration, the mechanism that switches the driven roller between the clamped state and the non-clamped state by the operating part is not disposed traversing across the motor. Due to this, the size of the rebar tying tool can be suppressed from becoming large in the direction in which the rotation axis extends.

In one or more aspects, the rebar tying tool may further comprise: a motor configured to rotate the driving roller; and a reduction gear unit configured to decelerate rotation of the motor. The operating part may be disposed more on the one side than the motor is in the direction in which the rotation axis extends. The link part may be disposed more on the one side than the reduction gear unit is in the direction in which the rotation axis extends.

In the above configuration, the link part is not disposed traversing across the reduction gear unit. Due to this, the size of the rebar tying tool can be suppressed from becoming large in the direction in which the rotation axis extends as compared to a case where the link part is disposed traversing across the reduction gear unit.

In one or more aspects, the holder may include an opening. The stopper may be configured to close the opening when the stopper is in the prohibiting state. An accommodating space may be defined by the holder and the stopper. The reel may be placed in the accommodating space.

In the above configuration, the opening of the holder can be closed by the stopper when the stopper is in the prohibiting state, and the reel can easily be placed in the accommodating space.

In one or more aspects, the rebar tying tool may further comprise a pivoting part connecting the holder with the stopper. The stopper may be configured to pivot with respect to the holder by the pivoting part. The reel may be disposed between the pivoting part and the driven roller when the rebar tying tool is viewed along the direction in which the rotation axis extends.

If the stopper is disposed on the same side as the driven roller with respect to the reel in a state where the opening of the holder is open, a hand of the operator may interfere with the stopper, and the operator cannot easily insert the wire between the driving roller and the driven roller. In the above configuration, in the state where the stopper is opening the opening of the holder, the stopper is disposed on an opposite side from the driven roller with the reel interposed therebetween. Due to this, the hand of the operator is suppressed from interfering with the stopper, and the operator can easily insert the wire between the driving roller and the driven roller.

In one or more aspects, the rebar tying tool may further comprise a second biasing part configured to bias the stopper from the prohibiting state to the allowing state.

In the above configuration, when the reel is to be removed from the holder, the stopper can be kept in the allowing state by the second biasing part.

In one or more aspects, the driving roller may have an outer circumferential surface comprising first teeth. The driven roller may have an outer circumferential surface comprising second teeth configured to mesh with the first teeth.

In the above configuration, performance of the driven roller to follow the driving roller can be improved by the first teeth meshing with the second teeth.

In one or more aspects, the rebar tying tool may further comprise a main body. The cam part may be disposed inside the main body. The operating part may further comprise: a lever part disposed outside the main body and configured to be operated by an operator; and a coupler penetrating the main body and coupling the cam part with the lever part. One of the lever part and the cam part may be configured to slide along the main body. The rebar tying tool may further comprise a third biasing member configured to bias the operating part with respect to the main body in a direction along which the one of the lever part and the cam part is pressed against the main body.

In the above configuration, one of the lever part and the cam part is pressed against the main body due to a biasing force of the third biasing member being applied to one of the lever part and the cam part. Thus, wobbling of the operating part can be suppressed.

In one or more aspects, the lever part may be configured to slide along an outer surface of the main body and keep the stopper in the prohibiting state. The third biasing member may be configured to bias the cam part toward inside the main body.

In the above configuration, since the cam part is biased toward inside the main body by the biasing force of the third biasing member being applied to the cam part, the lever part is thereby pressed against the outer surface of the main body. In this case, foreign matters can be suppressed from being caught between the lever part and the outer surface of the main body. Due to this, sliding performance of the operating part can be suppressed from decreasing while at the same time the wobbling of the operating part can be suppressed.

In one or more aspects, the third biasing member may comprise a compression spring. The coupler may pass inside the compression spring.

In the above configuration, a space required inside the main body to dispose the cam part, the coupler, and the compression spring can be reduced.

In one or more aspects, the rebar tying tool may further comprise a protrusion part and a recess both disposed inside the main body and configured to engage with each other. A position of one of the protrusion part and the recess may be fixed with respect to the cam part. A position of another of the protrusion part and the recess may be fixed with respect to the main body.

In the above configuration, the protrusion part and the recess are disposed inside the main body. As compared to a case where the protrusion part and the recess are disposed outside the main body, collision of objects such as rebars with the protrusion part and the recess can be suppressed from occurring, and the protrusion part and the recess can be suppressed from being damaged. Due to this, an occurrence of engagement defect between the protrusion part and the recess can be suppressed.

First Embodiment

A rebar tying tool 2 of a first embodiment will be described with reference to FIGS. 1 to 7. The rebar tying tool 2 is configured to tie a plurality of rebars R with a wire W. For example, the rebar tying tool 2 can tie small-diameter rebars R having a diameter of 16 mm or less and large-diameter rebars R having a diameter greater than 16 mm (e.g., a diameter of 25 mm or 32 mm) with the wire W. The diameter of the wire W is, for example, in a range from 0.5 mm to 2.0 mm.

As shown in FIG. 1, the rebar tying tool 2 comprises a main body 4, a grip 6, a battery receptacle 8, a controller 10 (see FIG. 2), and an accommodating part 16. The main body 4 comprises a left main body 4*a* and a right main body 4*b*. The left main body 4*a* composes an outer shape of a left half of the main body 4. The right main body 4*b* composes an outer shape of a right half of the main body 4. The left main body 4*a* and the right main body 4*b* are fixed by screws 5. In the present embodiment, a longitudinal direction of a twisting unit 76 to be described later (see FIG. 2) will be termed a front-rear direction, a direction perpendicularly intersecting the front-rear direction will be termed an up-down direction, and a direction perpendicularly intersecting the front-rear direction and the up-down direction will be termed a left-right direction.

The grip 6 is a member for an operator to grip. The grip 6 is arranged at a rear lower portion of the main body 4. The grip 6 is integrated with the main body 4. The grip 6 comprises a left grip 6*a* and a right grip 6*b*. The left grip 6*a* composes an outer shape of a left half of the grip 6. The right grip 6*b* composes an outer shape of a right half of the grip 6. The left grip 6*a* and the right grip 6*b* are fixed by screws 7.

A trigger 12 is disposed at a front upper portion of the grip 6. When the trigger 12 is pressed in, a tying operation of tying the rebars R with the wire W is started.

The battery receptacle 8 is disposed below the grip 6. The battery receptacle 8 is integrated with the grip 6. The battery receptacle 8 comprises a left battery receptacle 8*a* and a right battery receptacle 8*b*. The left battery receptacle 8*a* composes an outer shape of a left half of the battery receptacle 8. The right battery receptacle 8*b* composes an outer shape of a right half of the battery receptacle 8. The left battery receptacle 8*a* and the right battery receptacle 8*b* are fixed by screws 9*a*, 9*b*.

Figure 2:
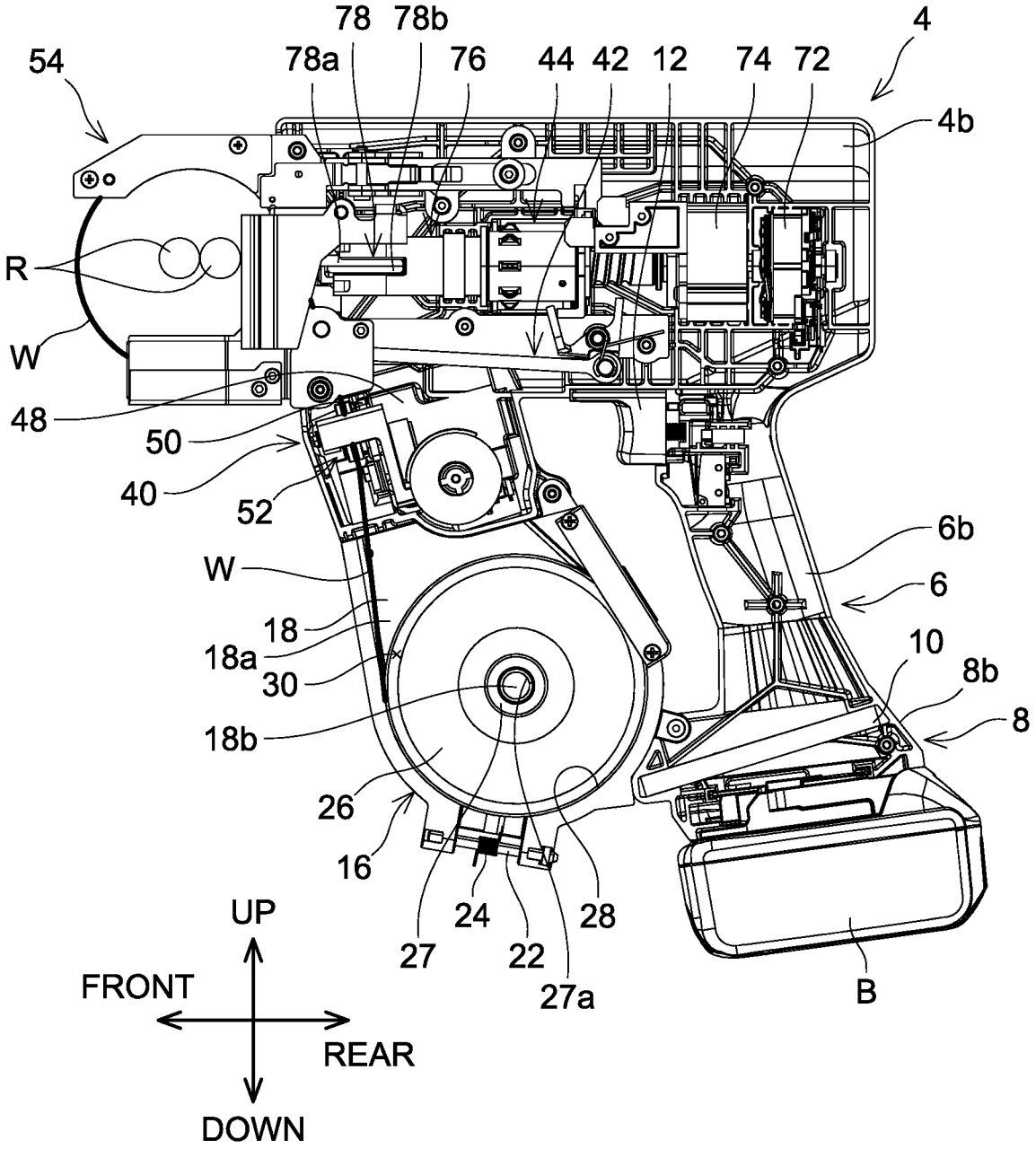
FIG. 2 is a left side view of the rebar tying tool 2 of the first embodiment in a state having a left main body 4*a*, a left grip 6*a*, a left battery receptacle 8*a*, and the cover 20 detached.

A battery B is detachably attached to the battery receptacle 8. The battery B may for example be a lithium ion battery. As shown in FIG. 2, the battery receptacle 8 accommodates the controller 10. When the trigger 12 is pressed in, the controller 10 executes control for starting the tying operation of tying the wire W around the rebars R.

Figure 3:
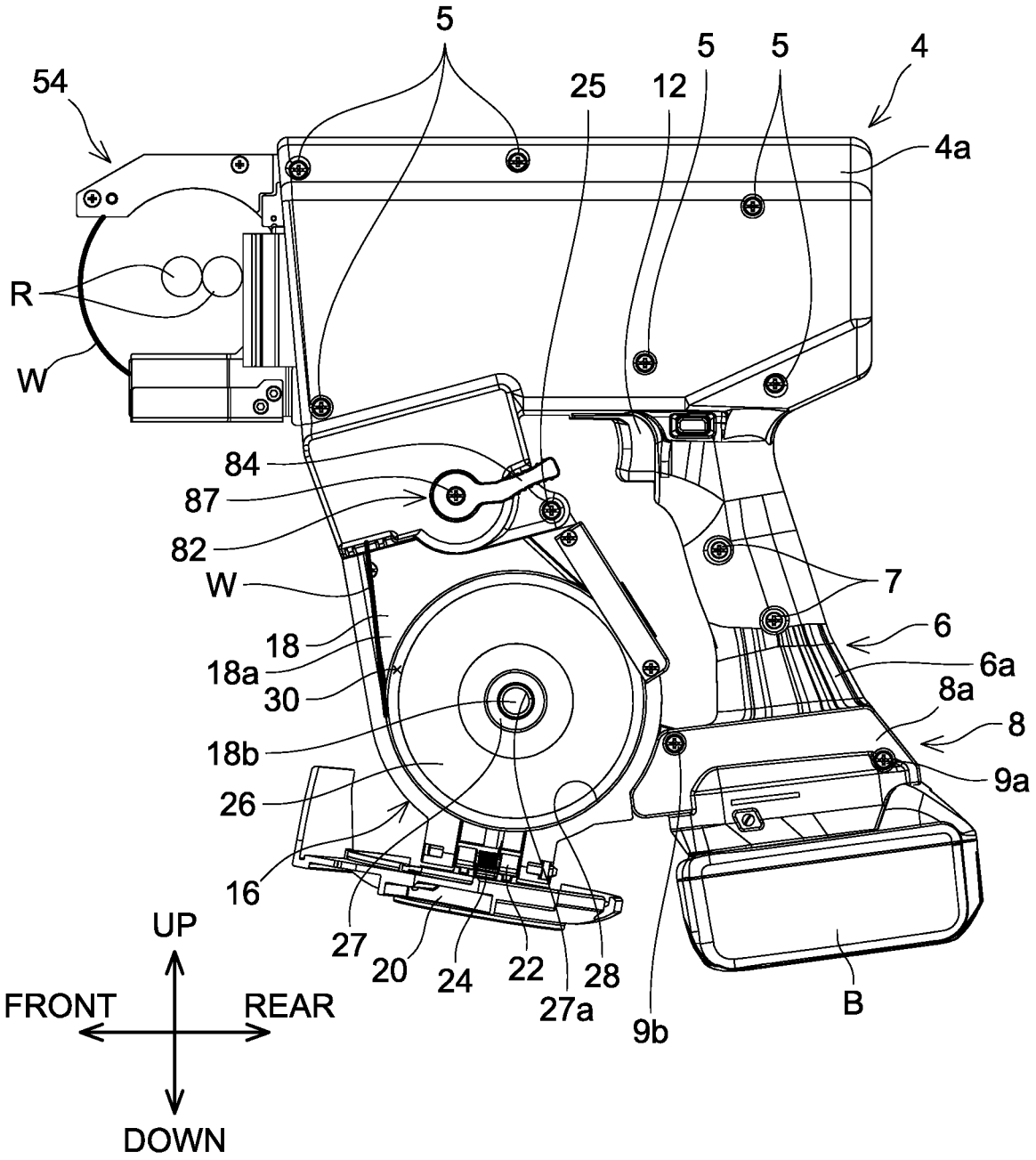
FIG. 3 is a left side view of the rebar tying tool 2 with the cover 20 of the first embodiment in an allowing state.

As shown in FIG. 3, the accommodating part 16 is disposed below the main body 4 and more on a front side than the grip 6 is. The accommodating part 16 comprises a holder (retaining part) 18, a cover 20, a pivoting part 22, and a biasing part 24. The holder 18 comprises a base part 18*a* and a shaft 18*b*. The base part 18*a* is attached to a front lower portion of the main body 4 by a screw 25 and is attached to a front portion of the battery receptacle 8 by the screw 9*b*. The base part 18*a* includes an opening 28 in its left side surface. The shaft 18*b* extends leftward from an inner surface of the base part 18*a*. The shaft 18*b* is configured to be inserted into a bearing hole 27*a* of a core 27 of a reel 26. A diameter of the shaft 18*b* is slightly smaller than a diameter of the bearing hole 27*a*. Due to this, the holder 18 can hold (retain) the reel 26. Further, the reel 26 is arranged capable of rotating on an outer circumferential surface of the shaft 18*b* in a circumferential direction. The wire W is wound around the core 27 of the reel 26.

The pivoting part 22 is attached to a lower portion of the base part 18*a* of the holder 18. The pivoting part 22 connects the base part 18*a* and the cover 20. The cover 20 is disposed more on the left side than the base part 18*a* is. The cover 20 is capable of pivoting with respect to the base part 18*a* by the pivoting part 22. An accommodating space 30 is defined between the holder 18 and the cover 20. The reel 26 is placed in the accommodating space 30. In this state, the shaft 18*b* is inserted in the bearing hole 27*a* of the reel 26. The cover 20 is configured to move between a prohibiting state and an allowing state. As shown in FIG. 1, when the cover 20 is in the prohibiting state, the cover 20 closes the opening 28 of the base part 18*a*. Due to this, the cover 20 prohibits the reel 26 from detaching from the shaft 18*b* of the holder 18. As shown in FIG. 3, when the cover 20 is in the allowing state, the opening 28 of the base part 18*a* is not closed. Due to this, the cover 20 allows the reel 26 to be detached from the shaft 18*b* of the holder 18. The pivoting part 22 is inserted through the biasing part 24. The biasing part 24 biases the cover 20 from the prohibiting state toward the allowing state. The biasing part 24 may for example be a torsion spring.

As shown in FIG. 2, the rebar tying tool 2 comprises a feeding mechanism 40, a cutting mechanism 42, and a twisting mechanism 44. The feeding mechanism 40 comprises a feeding motor 48, a reduction gear unit 50, a feeding part 52, and a guiding part 54. The feeding motor 48 is connected to the controller 10 via a cable that is not shown. The feeding motor 48 is configured to be driven by electric power supplied from the battery B. The feeding motor 48 is configured to switch between a forward driven state and a reverse driven state by the controller 10.

The reduction gear unit 50 is connected to the feeding motor 48. The reduction gear unit 50 is configured to decelerate rotation of the feeding motor 48 by a plurality of reduction gears.

Figure 4:
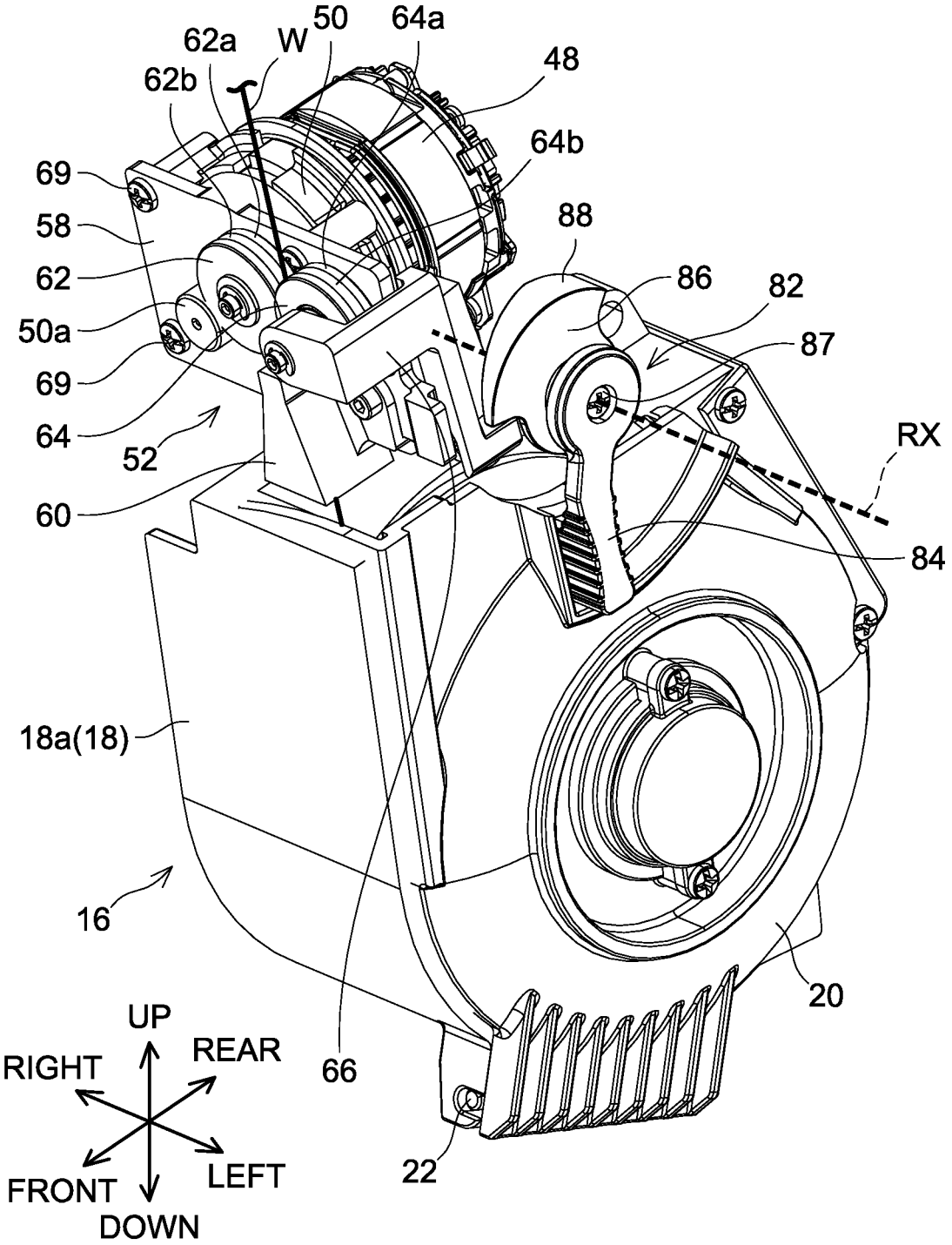
FIG. 4 is a perspective view of an accommodating part 16, a feeding motor 48, a reduction gear unit 50, and a feeding part 52 of the first embodiment.

The feeding part 52 is disposed at the front lower portion of the main body 4. As shown in FIG. 4, the feeding part 52 comprises a base part 58, a guide part 60, a driving roller 62, a driven roller 64, a link part 66, and a biasing part 68 (see FIG. 5). The base part 58 is fixed to the reduction gear unit 50 by screws 69. An output gear 50*a* of the reduction gear unit 50 is inserted onto the base part 58. The base part 58 rotatably supports the driving roller 62.

The guide part 60 is disposed above the accommodating part 16. The guide part 60 is supported by the base part 58. The guide part 60 is configured to guide the wire W drawn out from the reel 26 upward. The wire W extends through inside the guide part 60.

The driving roller 62 and the driven roller 64 are disposed higher than the guide part 60. Teeth 62*a* and a groove 62*b* are arranged on an outer circumferential surface of the driving roller 62. The teeth 62*a* mesh with the output gear 50*a* of the reduction gear unit 50. Due to this, rotation of the feeding motor 48 is transmitted to the driving roller 62 via the reduction gear unit 50. The groove 62*b* extends in the outer circumferential surface of the driving roller 62 in a direction tracing a rotation direction of the driving roller 62.

The driven roller 64 is disposed more on the left side than the feeding motor 48, the reduction gear unit 50, and the driving roller 62 are. Teeth 64*a* and a groove 64*b* are arranged on an outer circumferential surface of the driven roller 64. The teeth 64*a* of the driven roller 64 mesh with the teeth 62*a* of the driving roller 62. The groove 64*b* extends in the outer circumferential surface of the driven roller 64 in a direction tracing a rotation direction of the driven roller 64.

Figure 5:
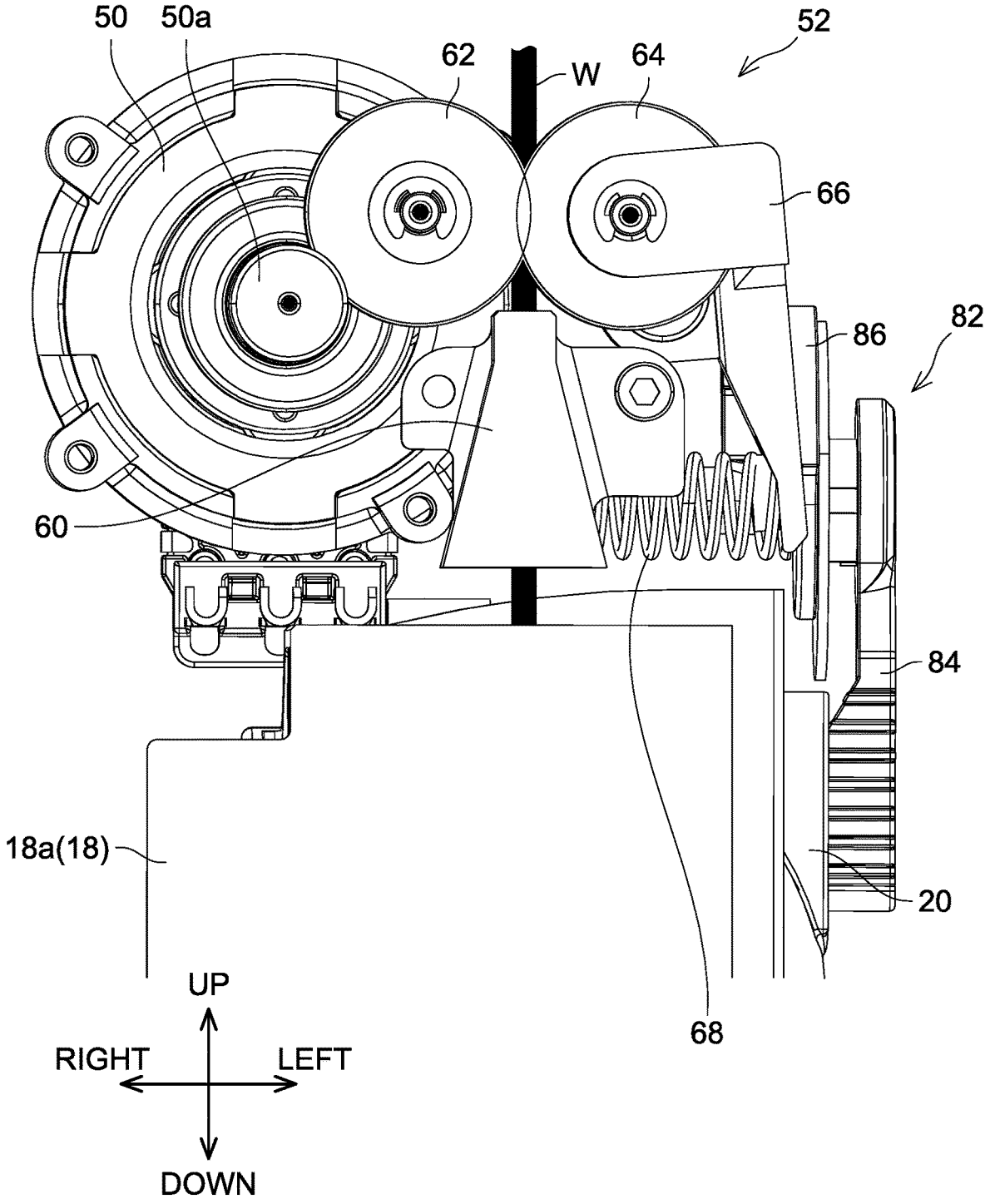
FIG. 5 is a side view of the accommodating part 16, the reduction gear unit 50, and the feeding part 52 in a case where a driven roller 64 of the first embodiment is in a clamped state.
Figure 6:
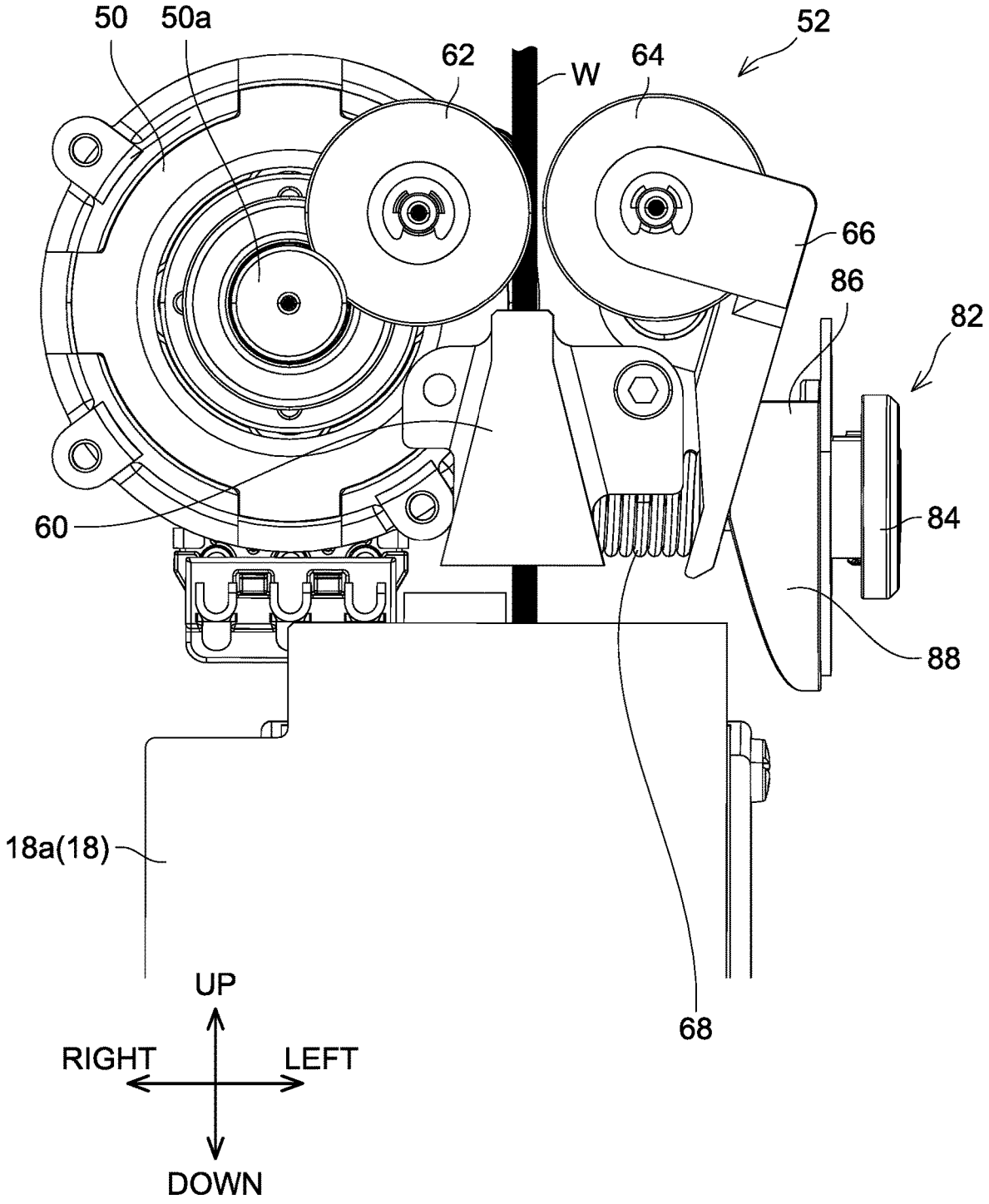
FIG. 6 is a side view of the accommodating part 16, the reduction gear unit 50, and the feeding part 52 in a case where the driven roller 64 of the first embodiment is in a non-clamped state.

The link part 66 is disposed more on the left side than the driven roller 64 is and on the right side than an operating part 82 to be described later is. That is, the link part 66 is disposed between the driven roller 64 and the operating part 82 in the left-right direction. The link part 66 extends in the up-down direction (see FIG. 5). The link part 66 rotatably supports the driven roller 64. The link part 66 is pivotably supported by the base part 58. The link part 66 is configured to pivot with respect to the base part 58 with a pivot axis extending in the front-rear direction as a center. The link part 66 pivots between a first position and a second position. As shown in FIG. 5, when the link part 66 is located in the first position, the driven roller 64 is in a clamped state. When the driven roller 64 is in the clamped state, the driven roller 64 comes into contact with the driving roller 62. Due to this, the teeth 64*a* of the driven roller 64 mesh with the teeth 62*a* of the driving roller 62. Due to this, when the driving roller 62 rotates by rotation of the feeding motor 48, the driven roller 64 is thereby rotated. Further, the wire W is clamped between the groove 64*b* of the driven roller 64 and the groove 62*b* of the driving roller 62. As shown in FIG. 6, when the link part 66 pivots from the first position and moves to the second position, the driven roller 64 is in a non-clamped state. When the driven roller 64 is in the non-clamped state, the driven roller 64 is separated from the driving roller 62. Due to this, the teeth 64*a* of the driven roller 64 do not mesh with the teeth 62*a* of the driving roller 62. As a result, the driven roller 64 does not rotate even when the driving roller 62 rotates by the rotation of the feeding motor 48. Further, the wire W is not clamped between the groove 64*b* of the driven roller 64 and the groove 62*b* of the driving roller 62.

As shown in FIGS. 5 and 6, the biasing part 68 extends in the left-right direction. In FIGS. 5 and 6, the base part 58 is omitted from depiction to facilitate understanding of a position of the biasing part 68. One end of the biasing part 68 is in contact with a lower portion of the link part 66. Although not shown, another end of the biasing part 68 is in contact with the base part 58. The biasing part 68 may for example be a compression spring. As shown in FIG. 5, when the link part 66 is located in the first position, the biasing part 68 is extended. On the other hand as shown in FIG. 6, when the link part 66 pivots from the first position and moves to the second position, the biasing part 68 is contracted. The biasing part 68 biases the lower portion of the link part 66 in a direction separating away from the base part 58 (leftward in the present embodiment). Due to this, the link part 66 is biased by the biasing part 68 from the second position toward the first position.

Figure 7:
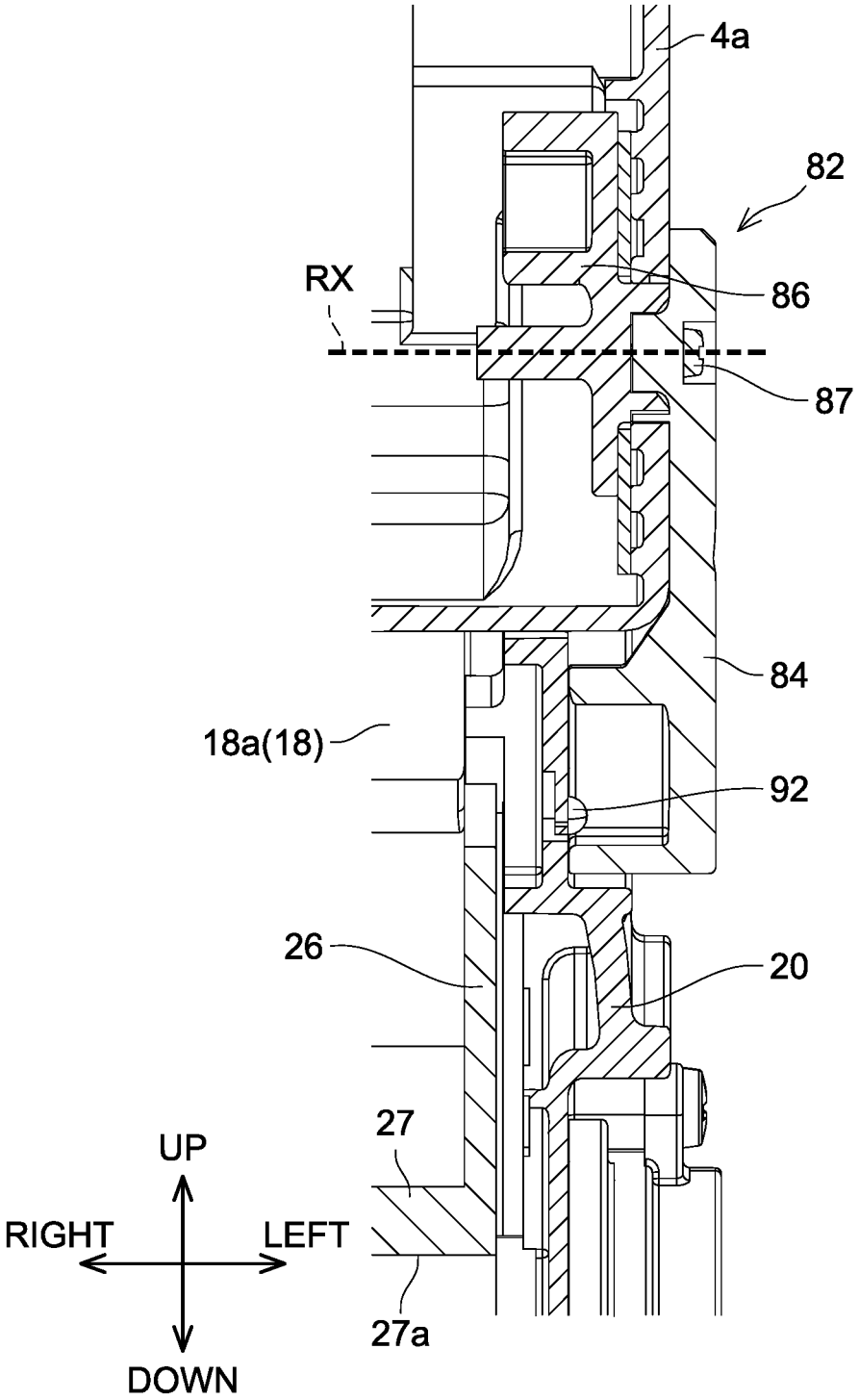
FIG. 7 is a cross-sectional view of a vicinity of an operating part 82 when a lever part 84 of the first embodiment is in a closed position.

As shown in FIG. 4, the rebar tying tool 2 further comprises the operating part 82. A part of the operating part 82 is disposed higher than the reel 26 and lower than the driven roller 64. That is, when the rebar tying tool 2 is seen along the left-right direction, the part of the operating part 82 is disposed between the reel 26 and the driven roller 64 in the up-down direction. The operating part 82 is disposed more on the left side than the feeding motor 48, the reduction gear unit 50, the driving roller 62, and the driven roller 64 are. The operating part 82 is configured to pivot about a pivot axis RX extending in the left-right direction. The operating part 82 includes a lever part 84 and a cam part 86. The lever part 84 is a portion to be held by the operator and be operated. As shown in FIG. 1, the lever part 84 is disposed on the left side of the left main body 4*a*. The lever part 84 is configured to move between a closed position and an open position. As shown in FIG. 7, when the lever part 84 is located in the closed position, a right surface of the lever part 84 (that is, its surface on the left main body 4*a* side) is in contact with the outer surface of the cover 20. Due to this, the cover 20 is suppressed from switching from the prohibiting state to the allowing state. Further, when the lever part 84 is located in the closed position, the lever part 84 engages with an engaging part 92 protruding outward from the outer surface of the cover 20. Due to this, the lever part 84 is kept in the prohibiting state when the lever part 84 is not operated by the operator. On the other hand, as shown in FIG. 3, when the lever part 84 is located in the open position, the right surface of the lever part 84 does not contact the outer circumferential surface of the cover 20. Due to this, the cover 20 is kept in the allowing state by being biased by the biasing part 24.

As shown in FIG. 7, the cam part 86 is disposed with the left main body 4*a* interposed between itself and the lever part 84. The cam part 86 is fixed to the lever part 84 by a screw 87. The cam part 86 is configured to pivot integrally with the lever part 84. As shown in FIG. 4, the cam part 86 has an edge 88. A left surface of the edge 88 is parallel to a plane that perpendicularly intersects the pivot axis RX of the operating part 82. On the other hand, a right surface of the edge 88 extends in the left-right direction so as to gradually separate away rightward from the plane perpendicularly intersecting the left-right direction along a clockwise direction about the pivot axis RX. In the left-right direction, a width of the edge 88 between its left and right surfaces widens along the clockwise direction about the pivot axis RX. In other words, the edge 88 extends in the left-right direction toward the link part 66 side at a greater degree along the clockwise direction about the pivot axis RX. The right surface of the edge 88 of the cam part 86 slidably contacts a lower left surface of the link part 66. As shown in FIG. 5, when the lever part 84 is in the closed position, a portion of the edge 88 with the narrowest width between the left surface and the right surface is in contact with the link part 66, as a result of which the link part 66 is kept in the first position. Further, as shown in FIG. 6, when the lever part 84 is in the open position, a portion of the edge 88 with the widest width between the left surface and the right surface is in contact with the link part 66, as a result of which the link part 66 is kept in the second position.

As aforementioned, the feeding mechanism 40 includes the guiding part 54. As shown in FIG. 2, the guiding part 54 is disposed more on the front upper side than the feeding part 52 is. The guiding part 54 is configured to guide the wire W fed out from the feeding part 52 around the rebars R in a loop shape.

The cutting mechanism 42 is accommodated in the main body 4. The cutting mechanism 42 comprises a cutter that is not shown. The cutter is configured to cut the wire W by rotating in cooperation with operation of the twisting mechanism 44.

The twisting mechanism 44 is accommodated in the main body 4. The twisting mechanism 44 extends inside the main body 4 in the front-rear direction. The twisting mechanism 44 comprises a twisting motor 72, a reduction gear unit 74, and a twisting unit 76. The twisting motor 72 is configured to rotate by electric power supplied from the battery B. The twisting motor 72 is controlled by the controller 10.

The reduction gear unit 74 is connected to a front portion of the twisting motor 72. The reduction gear unit 74 is configured to decelerate rotation of the twisting motor 72 by a plurality of reduction gears and transmit the decelerated rotation to the twisting unit 76.

The twisting unit 76 is configured to advance, retract, and rotate in accordance with the rotation of the twisting motor 72. When the rebar tying tool 2 is set on the rebars R, the rebars R are placed in front of the twisting unit 76. The twisting unit 76 comprises a retaining member 78. The retaining member 78 is located in the front portion of the twisting unit 76. The retaining member 78 comprises two members 78*a*, 78*b* that overlap each other in the up-down direction. The two members 78*a*, 78*b* are configured to move in the left-right direction so as to approach each other in accordance with the rotation of the twisting motor 72. Due to this, the retaining member 78 is configured to switch between a fully opened state, a half-opened state, and a closed state. Although a detailed configuration of the retaining member 78 will be omitted from the description, when the retaining member 78 switches from the fully opened state to the half-opened state, one point on the wire W wrapped around the rebars R is thereby retained. When the retaining member 78 switches from the half-opened state to the closed state, another point on the wire W wrapped around the rebars R is further retained.

Next, the tying operation of the wire W on the rebars R will be described. Before the tying operation is performed, that is, before the trigger 12 is pressed in, the driven roller 64 is kept in the clamped state and the wire W is clamped between the groove 62*b* of the driving roller 62 and the groove 64*b* of the driven roller 64 as shown in FIG. 5. Further, the retaining member 78 is kept in the fully opened state. When the trigger 12 is pressed in in the state where the rebar tying tool 2 is set on the rebars R by the operator (in the state where the rebars R are placed on the front side than the twisting unit 76), the controller 10 starts processes for the tying operation. Firstly, the feeding motor 48 rotates forward, and the wire W wound on the reel 26 is fed out to the guiding part 54 by the driving roller 62 and the driven roller 64. The wire W is drawn out from the reel 26, and the reel 26 rotates about a rotation axis extending in the left-right direction through the center of the bearing hole 27*a*. As shown in FIG. 2, the wire W is guided in the loop shape around the rebars R by the guiding part 54.

From this state, when the rotation of the feeding motor 48 stops and the twisting motor 72 rotates, the retaining member 78 switches from the fully opened state to the half-opened state. Due to this, the tip end of the wire W is retained by the retaining member 78.

From this state, when the rotation of the twisting motor 72 stops and the feeding motor 48 rotates in reverse, the wire W is pulled back onto the reel 26 by the driving roller 62 and the driven roller 64. Since the tip end of the wire W is retained by the retaining member 78, the loop of the wire W around the rebars R is tightened by this pullback of the wire W, and the wire W comes into tight contact with the rebars R.

From this state, when the feeding motor 48 stops and the twisting motor 72 rotates, the retaining member 78 switches from the half-opened state to the closed state. Due to this, a trailing end of the wire W is retained by the retaining member 78. Further, when the twisting motor 72 rotates, the wire W is cut at a position more on a reel 26 side than its trailing end by pivoting of the cutter of the cutting mechanism 42.

From this state, when the twisting motor 72 rotates, the twisting unit 76 moves rearward, and thereafter rotates. Due to this, the wire W is pulled back and thereafter twisted. As a result, the rebars R are tied by the wire W. After this, series of operations for returning the respective constituent components of the rebar tying tool 2 to their pre-tying operation state are executed by the controller 10.

After the tying operation by the wire W on the rebars R as aforementioned is repeated, and when a remaining amount of the wire W wound on the reel 26 becomes equal to or less than a predetermined amount by which the rebars R can no longer be tied, replacement work of the reel 26 is performed by the operator. As shown in FIG. 5, prior to the replacement work of the reel 26, the lever part 84 is located in the closed position. Due to this, the cover 20 is in the prohibiting state. Further, since the link part 66 is located in the first position, the driven roller 64 is in a clamping position. Firstly, when the lever part 84 is operated to pivot from the closed position to the open position by the operator, the edge 88 of the cam part 86 pivots about the pivot axis RX. When the rebar tying tool 2 is seen in the right direction, since the edge 88 extends to the link part 66 side at a greater degree along the clockwise direction of the pivot axis RX, the edge 88 pushes the left surface of the lower portion of the link part 66 rightward as the cam part 86 pivots. Due to this, the link part 66 pivots from the first position toward the second position about its pivot axis extending in the front-rear direction. Due to this, as shown in FIG. 6, the driven roller 64 switches from the clamped state to the non-clamped state. As a result, the wire W is released from between the driving roller 62 and the driven roller 64. Further, when the lever part 84 moves to the open position, the lever part 84 is no longer in contact with the cover 20. Due to this, the cover 20 switches from the prohibiting state to the allowing state by the biasing force of the biasing part 24. While the cover 20 is in the allowing state, the driven roller 64 is in the non-clamped state at all times.

From this state, the operator pulls out the wire W from between the driving roller 62 and the driven roller 64 and from the guide part 60, and removes the reel 26 from the holder 18. Then, the operator attaches a replacement reel 26 on the holder 18 and inserts a tip end of a wire W wound on this reel 26 into the guide part 60 and between the driving roller 62 and the driven roller 64.

From this state, after the cover 20 is switched from the allowing state to the prohibiting state by the operator and when the lever part 84 is operated to pivot from the open position to the closed position, the edge 88 of the cam part 86 pivots about the pivot axis RX. In viewing the rebar tying tool 2 in the right direction, since the edge 88 separates away from the link part 66 by moving in a counterclockwise direction about the pivot axis RX, the lower portion of the link part 66 moves leftward by the biasing force of the biasing part 68 as the cam part 86 pivots. Due to this, the link part 66 pivots from the second position toward the first position about its pivot axis extending in the front-rear direction. Due to this, as shown in FIG. 5, the driven roller 64 switches from the non-clamped state to the clamped state. As a result, the tip end of the wire W is clamped between the driving roller 62 and the driven roller 64. When the lever part 84 moves to the closed position, the lever part 84 engages with the engaging part 92 of the cover 20. Due to this, the lever part 84 is kept in the prohibiting state.

Further, for example, when the rebar tying tool 2 is purchased, for example, the reel 26 is not held in the holder 18. In this case, attachment work of the reel 26 is performed by the operator. As shown in FIG. 5, prior to the attachment work of the reel 26, the lever part 84 is located in the closed position. Due to this, the cover 20 is in the prohibiting state. Further, since the link part 66 is located in the first position, the driven roller 64 is in the clamping position. Firstly, when the lever part 84 is operated to pivot from the closed position to the open position by the operator, the edge 88 of the cam part 86 pivots about the pivot axis RX. The edge 88 pushes the left surface of the lower portion of the link part 66 rightward as the cam part 86 pivots. Due to this, the link part 66 pivots from the first position toward the second position about its pivot axis extending in the front-rear direction. Due to this, as shown in FIG. 6, the driven roller 64 switches from the clamped state to the non-clamped state.

From this state, the operator attaches a replacement reel 26 on the holder 18 and inserts a tip end of a wire W wound on this reel 26 into the guide part 60 and between the driving roller 62 and the driven roller 64.

From this state, after the cover 20 is switched from the allowing state to the prohibiting state by the operator and when the lever part 84 is operated to pivot from the open position to the closed position, the edge 88 of the cam part 86 pivots about the pivot axis RX. The lower portion of the link part 66 moves leftward by the biasing force of the biasing part 68 as the cam part 86 pivots. Due to this, the link part 66 pivots from the second position toward the first position about its pivot axis extending in the front-rear direction. Due to this, as shown in FIG. 5, the driven roller 64 switches from the non-clamped state to the clamped state. As a result, the tip end of the wire W is clamped between the driving roller 62 and the driven roller 64. When the lever part 84 moves to the closed position, the lever part 84 engages with the engaging part 92 of the cover 20. Due to this, the lever part 84 is kept in the prohibiting state.

The rebar tying tool 2 of the present embodiment is configured to tie the rebars R using the wire W. The rebar tying tool 2 comprises the holder 18, the cover 20, the driving roller 62, the driven roller 64, and the twisting unit 76. The holder 18 is configured to hold the reel 26 on which the wire W is wound about the rotation axis extending in the left-right direction. The cover 20 is configured to switch between the prohibiting state in which the cover 20 prohibits the reel 26 from detaching from the holder 18 and the allowing state in which the cover 20 allows the reel 26 to detach from the holder 18. The driving roller 62 is configured to rotate. The driven roller 64 is configured to switch between the clamped state and the non-clamped state, in which the wire W is clamped between the driving roller 62 and the driven roller 64 when the driven roller 64 is in the clamped state, and the wire W is not clamped between the driving roller 62 and the driven roller 64 when the driven roller 64 is in the non-clamped state. The twisting unit 76 is configured to twist the wire W clamped between the driving roller 62 and the driven roller 64 and fed out around the rebars R. While the cover 20 is in the allowing state, the driven roller 64 is in the non-clamped state at all times. In this configuration, since the driven roller 64 is in the non-clamped state at all times while the cover 20 is in the allowing state, the tip end of the wire W wound on the reel 26 can easily be inserted between the driving roller 62 and the driven roller 64 upon replacing the reel 26. Due to this, the replacement work of the reel 26 can easily be performed.

Further, when the reel 26 is to be attached to the holder 18, the tip end of the wire W wound on the reel 26 can easily be inserted between the driving roller 62 and the driven roller 64. Due to this, the attachment work of the reel 26 can easily be performed.

Further, the rebar tying tool 2 further comprises the operating part 82 configured to move between the closed position and the open position. When the operating part 82 is operated from the closed position toward the open position, the driven roller 64 switches from the clamped state to the non-clamped state and the cover 20 switches from the prohibiting state to the allowing state. In this configuration, the driven roller 64 can be switched from the clamped state to the non-clamped state and further the cover 20 can be switched from the prohibiting state to the allowing state by simply operating only the operating part 82. Due to this, steps in the reel replacement work can be reduced prior to inserting the tip end of the wire W wound on the reel 26 between the driving roller 62 and the driven roller 64. Thus, the replacement work and the attachment work of the reel 26 can easily be performed.

Further, the rebar tying tool 2 further comprises the operating part 82 configured to move between the closed position and the open position. When the operating part 82 is operated from the open position toward the closed position, the driven roller 64 switches from the non-clamped state to the clamped state and the cover 20 switches from the allowing state to the prohibiting state. In this configuration, the driven roller 64 can be switched from the non-clamped state to the clamped state and further the cover 20 can be switched from the allowing state to the prohibiting state by simply operating only the operating part 82. Due to this, steps in the reel replacement work can be reduced after inserting the tip end of the wire W wound on the reel 26 between the driving roller 62 and the driven roller 64. Thus, the replacement work and the attachment work of the reel 26 can easily be performed.

Further, the rebar tying tool 2 further comprises the link part 66 disposed between the operating part 82 and the driven roller 64. When the operating part 82 is located in the closed position, the link part 66 is located in the first position at which the driven roller 64 is in the clamped state, and when the operating part 82 is located in the open position, the link part 66 is located in the second position at which the driven roller 64 is in the non-clamped state. In this configuration, the driven roller 64 can be switched between the clamped state and the non-clamped state and further the cover 20 can be switched between the prohibiting state and the allowing state with a simple configuration.

Further, the operating part 82 comprises the cam part 86. When the operating part 82 is operated from the closed position toward the open position, the cam part 86 moves the link part 66 from the first position to the second position. In this configuration, a direction of operating the operating part 82 and a direction in which the link part 66 moves can be made to differ by the cam part 86. Due to this, a size of the rebar tying tool 2 can be suppressed from becoming large as compared to a case in which the direction of operating the operating part 82 and the direction in which the link part 66 moves are same.

Further, the operating part 82 is configured to pivot about the pivot axis. The cam part 86 extends gradually toward the link part 66 side in the left-right direction, which is the direction along which the pivot axis extends, by gradually extending toward the link part 66 at a greater degree along one direction about the pivot axis. When the operating part 82 pivots to another direction about the pivot axis, the cam part 86 comes into contact with the link part 66 and thereby moves the link part 66 from the first position to the second position. In this configuration, as the cam part 86 pivots to the other direction about the pivot axis, the position at which the cam part 86 and the link part 66 contact each other gradually changes rightward along the left-right direction in which the pivot axis extends. As a result of this, the link part 66 moves from the first position to the second position. The link part 66 can be moved from the first position to the second position by a simple configuration of the cam part 86.

Further, the rebar tying tool 2 further comprises the biasing part 68 configured to bias the link part 66 from the second position toward the first position. In this configuration, with the link part 66 being biased from the second position toward the first position, the driven roller 64 can be biased from the non-clamped state to the clamped state.

Further, the operating part 82 comprises the lever part 84 configured to be operated by operator. The cover 20 comprises the engaging part 92 configured to engage with the lever part 84 when the cover 20 is in the prohibiting state. The lever part 84 engages with the engaging part 92, by which the lever part 84 keeps the cover 20 in the prohibiting state. In this configuration, the cover 20 can be suppressed from switching from the prohibiting state to the allowing state while the lever part 84 is not operated by the operator.

Further, when the rebar tying tool 2 is viewed along the left-right direction in which the rotation axis of the reel 26 extends, the operating part 82 is disposed between the reel 26 and the driven roller 64. Generally, the reel 26 is disposed away from the driven roller 64 in order to pull out the wire W from the reel 26. In the above configuration, the space defined between the reel 26 and the driven roller 64 can be utilized efficiently. Due to this, the size of the rebar tying tool 2 can be suppressed from becoming large.

Further, when the direction in which the rebars R are placed as viewed from the twisting unit 76 is the front direction and the direction in which the rotation axis of the reel 26 extends is the left-right direction, the operating part 82 is disposed higher than the reel 26 and lower than the driven roller 64. In this configuration, the operating part 82 is disposed between the reel 26 and the driven roller 64 in the up-down direction. Due to this, the size of the rebar tying tool 2 can be suppressed from becoming large in the up-down direction.

The driven roller 64 is disposed more on the left side than the driving roller 62 is in the left-right direction in which the rotation axis of the reel 26 extends. The cover 20 is disposed more on the left side than the holder 18 is in the left-right direction in which the rotation axis of the reel 26 extends. If the driven roller 64 is disposed more on the left side than the driving roller 62 is and the cover 20 is disposed more on the right side than the holder 18 is, the driven roller 64 switches from the clamped state to the non-clamped state as it moves leftward, and the cover 20 switches from the prohibiting state to the allowing state toward as it moves rightward. Due to this, the size of the rebar tying tool 2 would become large in the left-right direction. In the above configuration, the driven roller 64 switches from the clamped state to the non-clamped state as it moves leftward, and the cover 20 switches from the prohibiting state to the allowing state toward as it moves leftward. Due to this, the size of the rebar tying tool 2 can be suppressed from becoming large in the left-right direction.

Further, the rebar tying tool 2 further comprises the feeding motor 48 configured to rotate the driving roller 62. The operating part 82 is disposed more on the left side than the feeding motor 48 is in the left-right direction in which the rotation axis of the reel 26 extends. If the operating part 82 is disposed more on the right side than the feeding motor 48 is in the left-right direction, the mechanism that switches the driven roller 64 between the clamped state and the non-clamped state by the operating part 82 is disposed traversing across the feeding motor 48. Due to this, the size of the rebar tying tool 2 becomes large in the left-right direction. In the above configuration, the mechanism that switches the driven roller 64 between the clamped state and the non-clamped state by the operating part 82 is not disposed traversing across the feeding motor 48. Due to this, the size of the rebar tying tool 2 can be suppressed from becoming large in the left-right direction.

Further, the rebar tying tool 2 further comprises the feeding motor 48 configured to rotate the driving roller 62 and the reduction gear unit 50 configured to decelerate the rotation of the feeding motor 48. The operating part 82 is disposed more on the left side than the feeding motor 48 is in the left-right direction in which the rotation axis of the reel 26 extends. The link part 66 is disposed more on the left side than the reduction gear unit 50 is in the left-right direction. In this configuration, the link part 66 is not disposed traversing across the reduction gear unit 50. Due to this, the size of the rebar tying tool 2 can be suppressed from becoming large in the left-right direction as compared to the case in which the link part 66 is disposed traversing across the reduction gear unit 50.

Further, the holder 18 comprises the opening 28. The cover 20 is configured to close the opening 28 when it is in the prohibiting state. The accommodating space 30 is defined by the holder 18 and the cover 20. The reel 26 is placed in the accommodating space 30. In this configuration, the reel 26 can easily be placed in the accommodating space 30 by closing the opening 28 of the holder 18 when the cover 20 is in the prohibiting state.

Further, the rebar tying tool 2 further comprises the pivoting part 22 connecting the holder 18 and the cover 20. The cover 20 is configured to pivot with respect to the holder 18 by the pivoting part 22. When the rebar tying tool 2 is viewed in the direction in which the rotation axis of the reel 26 extends, the reel 26 is disposed between the pivoting part 22 and the driven roller 64. If the cover 20 is disposed on the same side as the driven roller 64 with respect to the reel 26 in the state where the cover 20 is keeping the opening 28 of the holder 18 open, a hand of the operator may interfere with the cover 20, and the operator cannot easily insert the wire W between the driving roller 62 and the driven roller 64. In the above configuration, in the state where the cover 20 is keeping the opening 28 of the holder 18 open, the cover 20 is disposed on the opposite side from the driven roller 64 with the reel 26 interposed therebetween. Due to this, the hand of the operator is suppressed from interfering with the cover 20, and the operator can easily insert the wire W between the driving roller 62 and the driven roller 64.

Further, the rebar tying tool 2 further comprises the biasing part 24 configured to bias the cover 20 from the prohibiting state to the allowing state. In this configuration, when the reel 26 is to be removed from the holder 18, the cover 20 can be kept in the allowing state by the biasing part 24.

Further, the teeth 62*a* are disposed on the outer circumferential surface of the driving roller 62. The teeth 64*a* configured to mesh with the teeth 62*a* are disposed on the outer circumferential surface of the driven roller 64. In this configuration, performance of the driven roller 64 to follow the driving roller 62 can be improved by the teeth 62*a* of the driving roller 62 meshing with the teeth 64*a* of the driven roller 64.

Further, the rebar tying tool 2 of the present embodiment ties the rebars R using the wire W. The rebar tying tool 2 comprises the holder 18, the cover 20, the operating part 82, the driving roller 62, the driven roller 64, and the twisting unit 76. The holder 18 is configured to hold the reel 26 on which the wire W is wound about the rotation axis. The cover 20 is configured to switch between the prohibiting state in which the cover 20 prohibits the reel 26 from detaching from the holder 18 and the allowing state in which the cover 20 allows the reel 26 to detach from the holder 18. The driving roller 62 is configured to rotate. The driven roller 64 is configured to switch between the clamped state and the non-clamped state, in which the wire W is clamped between the driving roller 62 and the driven roller 64 when the driven roller 64 is in the clamped state, and the wire W is not clamped between the driving roller 62 and the driven roller 64 when the driven roller 64 is in the non-clamped state. The twisting unit 76 is configured to twist the wire W clamped between the driving roller 62 and the driven roller 64 and fed out around the rebars R. When the operating part 82 is operated, the driven roller 64 switches from the clamped state to the non-clamped state and the cover 20 switches from the prohibiting state to the allowing state. In this configuration, the driven roller 64 can be switched from the clamped state to the non-clamped state and further the cover 20 can be switched from the prohibiting state to the allowing state by simply operating only the operating part 82. Due to this, the replacement work and the attachment work of the reel 26 can easily be performed.

(Corresponding Relationship)

The cover 20 is an example of "stopper", the feeding motor 48 is an example of "motor", the biasing part 68 is an example of "first biasing part", the biasing part 24 is an example of "second biasing part", the teeth 62*a* of the driving roller 62 are an example of "first teeth", and the teeth 64*a* of the driven roller 64 are an example of "second teeth".

Second Embodiment

Figure 8:
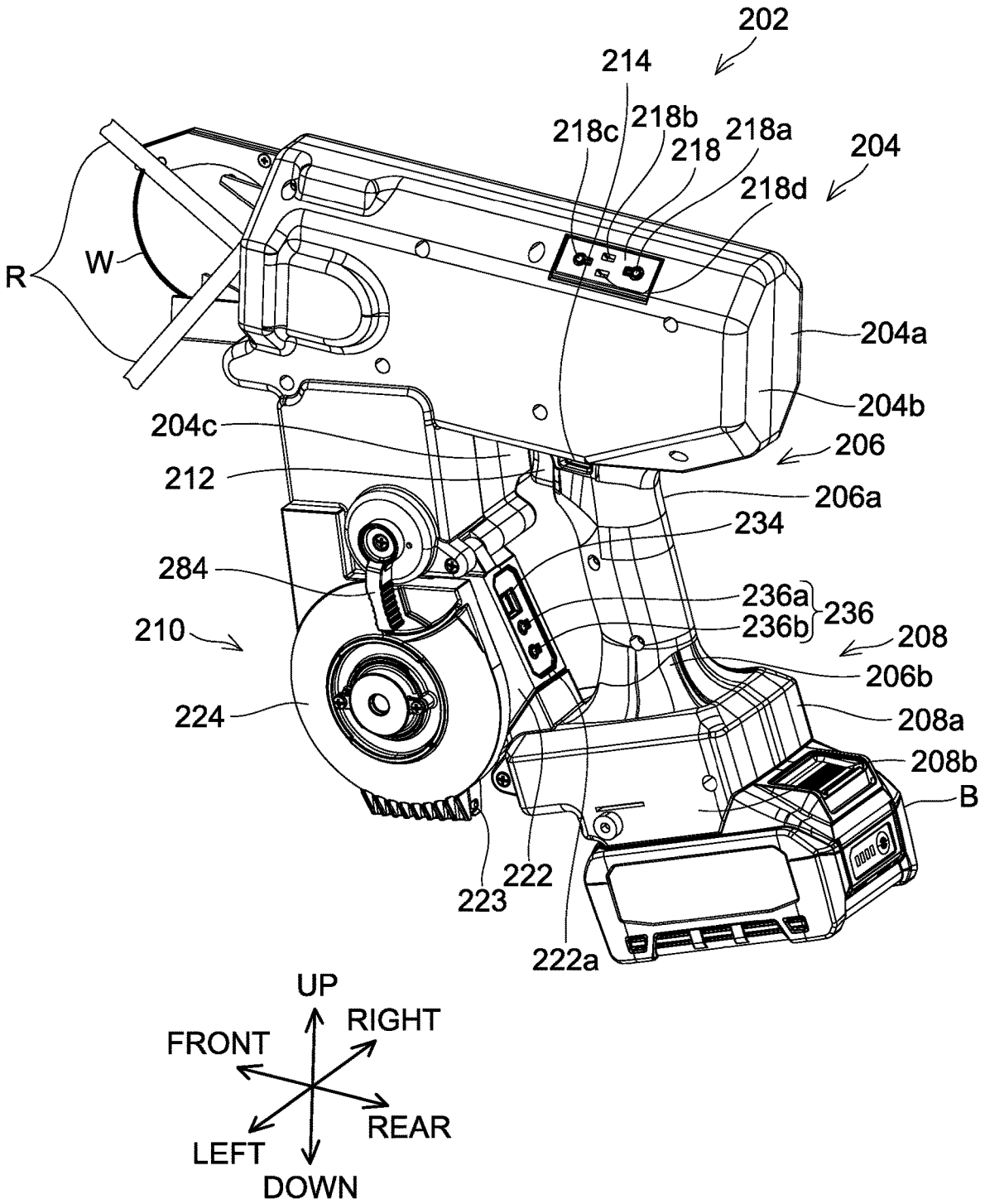
FIG. 8 is a perspective view of a rebar tying tool 202 of a second embodiment as seen from a rear left upper side.

A rebar tying tool 202 of a second embodiment will be described with reference to FIGS. 8 to 34. In the second embodiment, explanations on points that are same as the first embodiment are omitted. As shown in FIG. 8, the rebar tying tool 202 comprises a main body 204, a grip 206, a battery receptacle 208, a battery B, and an accommodating part 210. The main body 204 comprises a right main body 204*a* that composes an outer shape of a right half, a left main body 204*b* that composes an outer shape of a left half, and a motor cover 204*c* (see FIG. 9). The motor cover 204*c* is attached to the right main body 204*a*.

The grip 206 is configured to be gripped by the operator. The grip 206 is connected to a rear lower portion of the main body 204. The grip 206 is integrated with the main body 204. The grip 206 comprises a right grip 206*a* that composes an outer shape of its right half and a left grip 206*b* that composes an outer shape of its left half.

Figure 10:
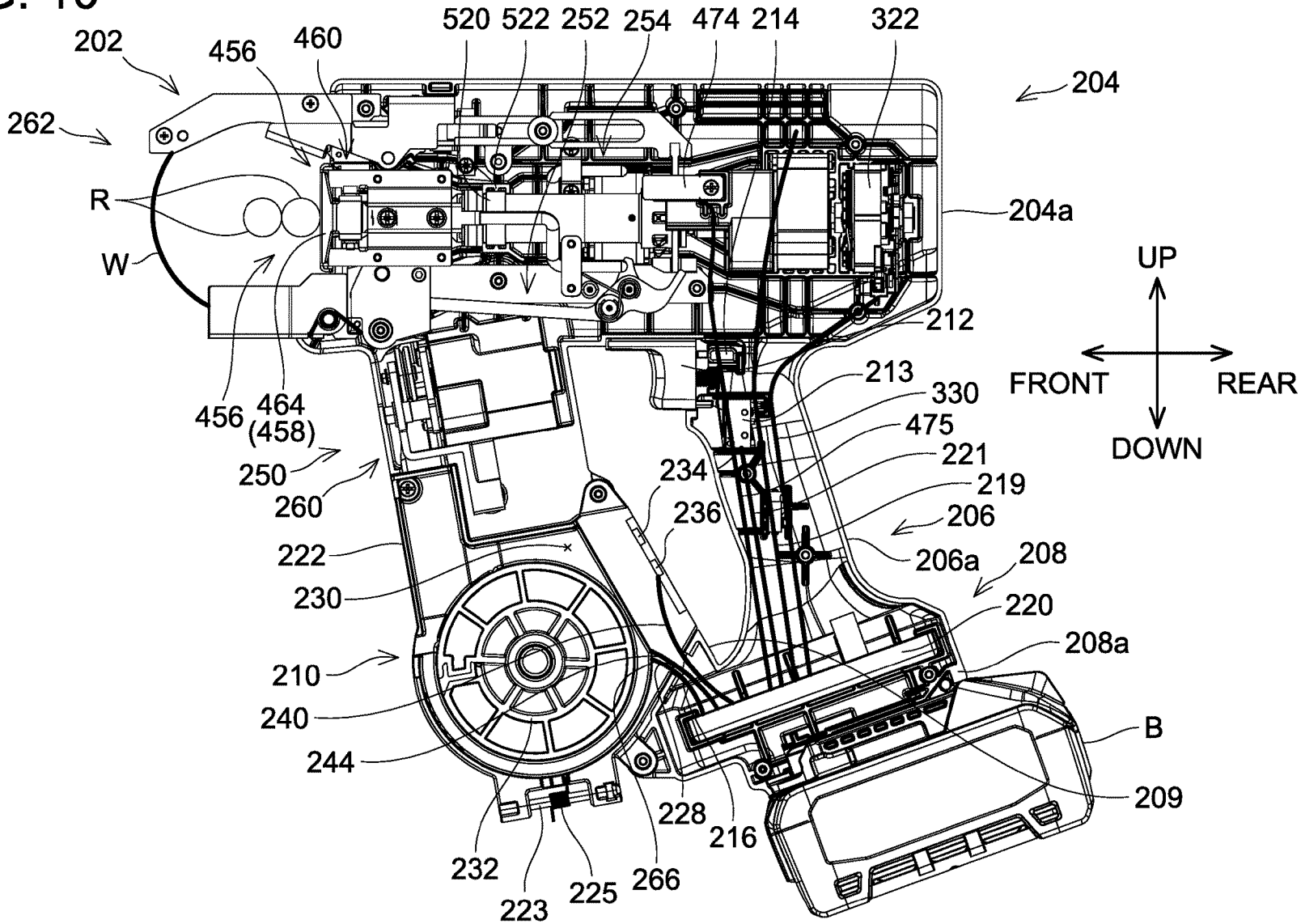
FIG. 10 is a side view showing an internal configuration of the rebar tying tool 202 of the second embodiment.

A trigger 212 is attached at an upper portion of a front surface of the grip 206. The trigger 212 is configured to be operated by the operator. As shown in FIG. 10, a trigger switch 213 configured to detect whether or not the trigger 212 has been pressed in is accommodated inside the grip 206.

As shown in FIG. 8, a trigger lock 214 is attached to an upper portion of the left surface of the grip 206. The trigger lock 214 is disposed near a connecting position between the main body 204 and the grip 206. The trigger lock 214 is configured to move between an allowing position and a prohibiting position. When the trigger lock 214 is in the allowing position, a press-in operation on the trigger 212 is allowed. When the trigger lock 214 is in the prohibiting position, the press-in operation on the trigger 212 is prohibited.

The battery receptacle 208 is connected to a lower portion of the grip 206. The battery receptacle 208 is integrated with the grip 206. The battery B is detachably attached to the battery receptacle 208. The battery receptacle 208 comprises a right battery receptacle 208*a* that composes an outer shape of its right half and a left battery receptacle 208*b* that composes an outer shape of its left half. A coupler 209 is arranged on a front upper portion of the battery receptacle 208. The coupler 209 is integrated with the battery receptacle 208. As shown in FIG. 10, an opening 216 is defined on a front upper surface of the coupler 209.

The rebar tying tool 202 further comprises a controller 220. The controller 220 is accommodated in the battery receptacle 208. The controller 220 and the trigger switch 213 are electrically connected by a fifth connecting cable 221. The fifth connecting cable 221 extends from the trigger switch 213 through inside the grip 206, and further extends inside the battery receptacle 208 to the controller 220. When the trigger 212 is pressed in, the controller 220 detects a signal from the trigger switch 213 and executes control for starting a tying operation for tying a wire W around rebars R.

As shown in FIG. 8, an indicator 218 is disposed at a rear upper portion of the main body 204. The indicator 218 comprises a main power switch 218*a*, a main power LED 218*b*, a mode-shifting switch 218*c*, and a mode-displaying LED 218*d*. The main power switch 218*a* is configured to accept an operation by the operator for switching main power of the rebar tying tool 202 between an on state and an off state. The main power LED 218*b* is configured to display the on state and the off state of the main power of the rebar tying tool 202. The mode-shifting switch 218*c* is configured to accept an operation by the operator for switching an operation mode of the rebar tying tool 202. The mode-displaying LED 218*d* is configured to display the operation mode of the rebar tying tool 202. For example, the operation mode of the rebar tying tool 202 may comprise a single action mode capable of performing one tying operation each time the trigger 212 is operated and a multiple action mode capable of performing multiple tying operations while the trigger 212 is operated.

The indicator 218 and the controller 220 are electrically connected by a sixth connecting cable 219 (see FIG. 10). As shown in FIG. 10, the sixth connecting cable 219 extends from the indicator 218 and on the left side of a twisting unit 254 to be described later, further extends inside the grip 206 via the connecting position between the main body 204 and the grip 206, and through inside the battery receptacle 208 to the controller 220.

Figure 9:
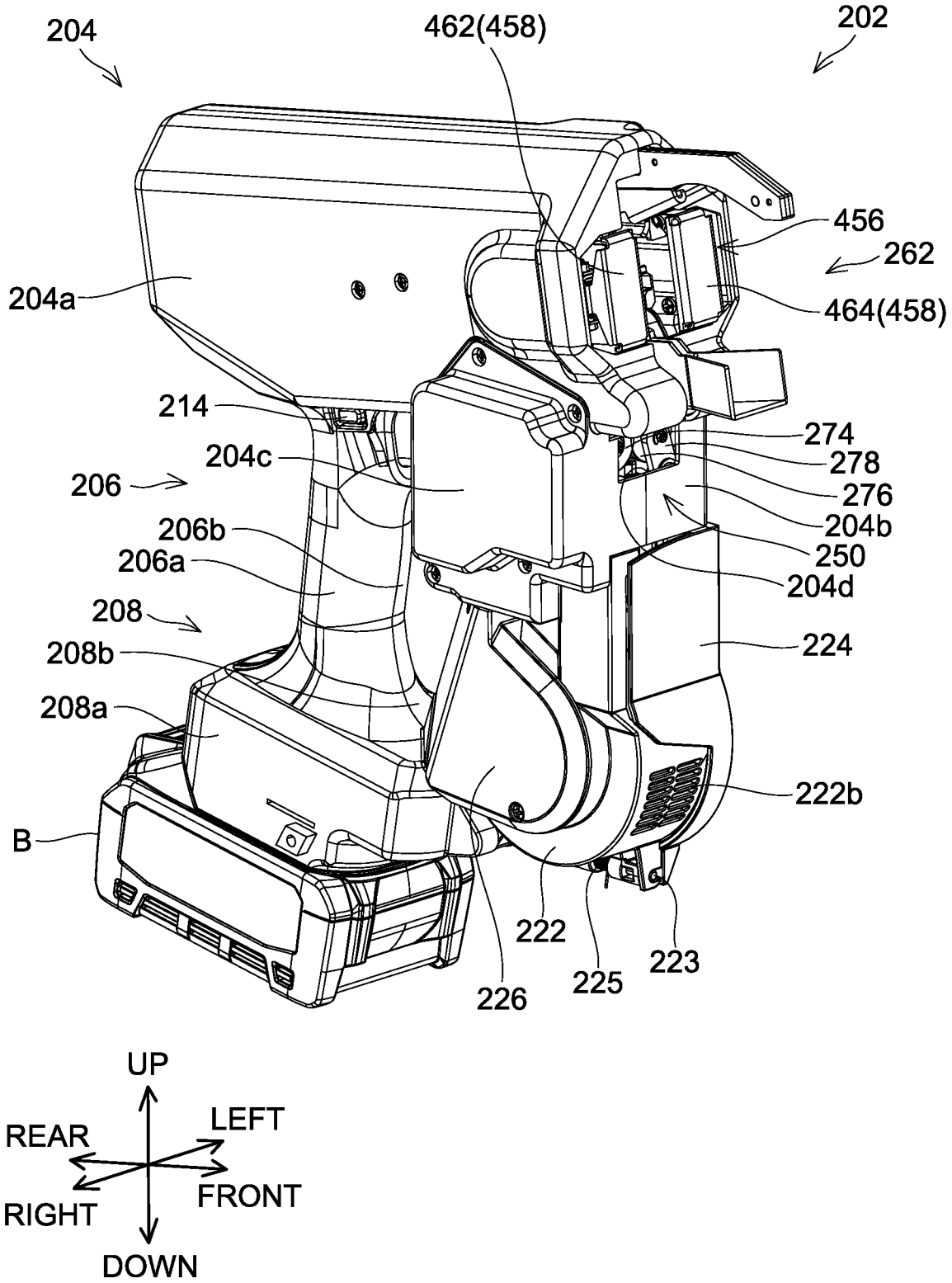
FIG. 9 is a perspective view of the rebar tying tool 202 of the second embodiment as seen from a front right upper side.

As shown in FIGS. 8 and 9, the accommodating part 210 comprises an accommodating part main body 222, a cover member 224, and an auxiliary cover member 226. The accommodating part main body 222 is coupled to a front lower portion of the main body 204 and a front portion of the coupler 209. As shown in FIG. 10, an opening 228 is defined at a rear lower portion of the accommodating part main body 222. The opening 228 faces the opening 216. As shown in FIG. 8, a rear surface 222*a* is arranged at a rear portion of the accommodating part main body 222. The rear surface 222*a* faces the front surface of the grip 206.

An indicator 234 and an adjusting unit 236 are disposed on the rear surface 222*a* of the accommodating part main body 222. The indicator 234 is configured to display a status of the rebar tying tool 202, such as a tying condition for tying the wire W around the rebars R and remaining charge in the battery B. The adjusting unit 236 is configured to accept an operation by the operator for adjusting a tying force of the wire W. In the present embodiment, the adjusting unit 236 comprises two microswitches 236*a*, 236*b*. When the microswitch 236*a* is operated, a set value of the tying force of the wire W increases by one level, and when the microswitch 236*b* is operated, the set value of the tying force of the wire W decreases by one level. The adjusting unit 236 is not limited to the microswitches 236*a*, 236*b*, and may comprise a dial switch.

As shown in FIG. 10, the indicator 234 and the adjusting unit 236 are electrically connected to the controller 220 by first connecting cables 240. The first connecting cables 240 extend from the indicator 234 and the adjusting unit 236 through inside the accommodating part main body 222, further extends through inside the coupler 209 via the openings 228, 216, and through inside the battery receptacle 208 to the controller 220. Since the first connecting cables 240 do not extend inside the main body 204, they do not extend near the twisting unit 254 to be described later.

As shown in FIG. 8, the cover member 224 is attached to the accommodating part main body 222 so as to be pivotable about a pivoting part 223 at a lower portion of the accommodating part main body 222. The cover member 224 is configured to open and close an accommodation opening defined on a left side surface of the accommodating part main body 222. The cover member 224 is biased in an opening direction by a biasing part 225 (see FIG. 9). The biasing part 225 may for example be a torsion spring. An accommodating space 230 (see FIG. 10) is defined by the accommodating part main body 222 and the cover member 224. A reel 232 (see FIG. 10) on which the wire W is wound is accommodated in the accommodating space 230. In a state where the cover member 224 is open, the reel 232 can be set in or removed from the accommodating part main body 222. On the other hand, in a state where the cover member 224 is closed, the reel 232 is prohibited from being set in or removed from the accommodating part main body 222. Hereinbelow, the state where the cover member 224 is open may also be termed an allowed state, and the state where the cover member 224 is closed may also be termed a prohibited state. Further, as shown in FIG. 9, a hole 222*b* is defined in a front surface of the accommodating part main body 222. The operator can check a remaining amount of the wire W wound on the reel 232 by seeing the reel 232 through the hole 222*b*. The auxiliary cover member 226 is configured to cover a right side surface of the accommodating part main body 222. Due to this, a passage space 268 (see FIG. 12) is defined between the right side surface of the accommodating part main body 222 and the auxiliary cover member 226.

Figure 11:
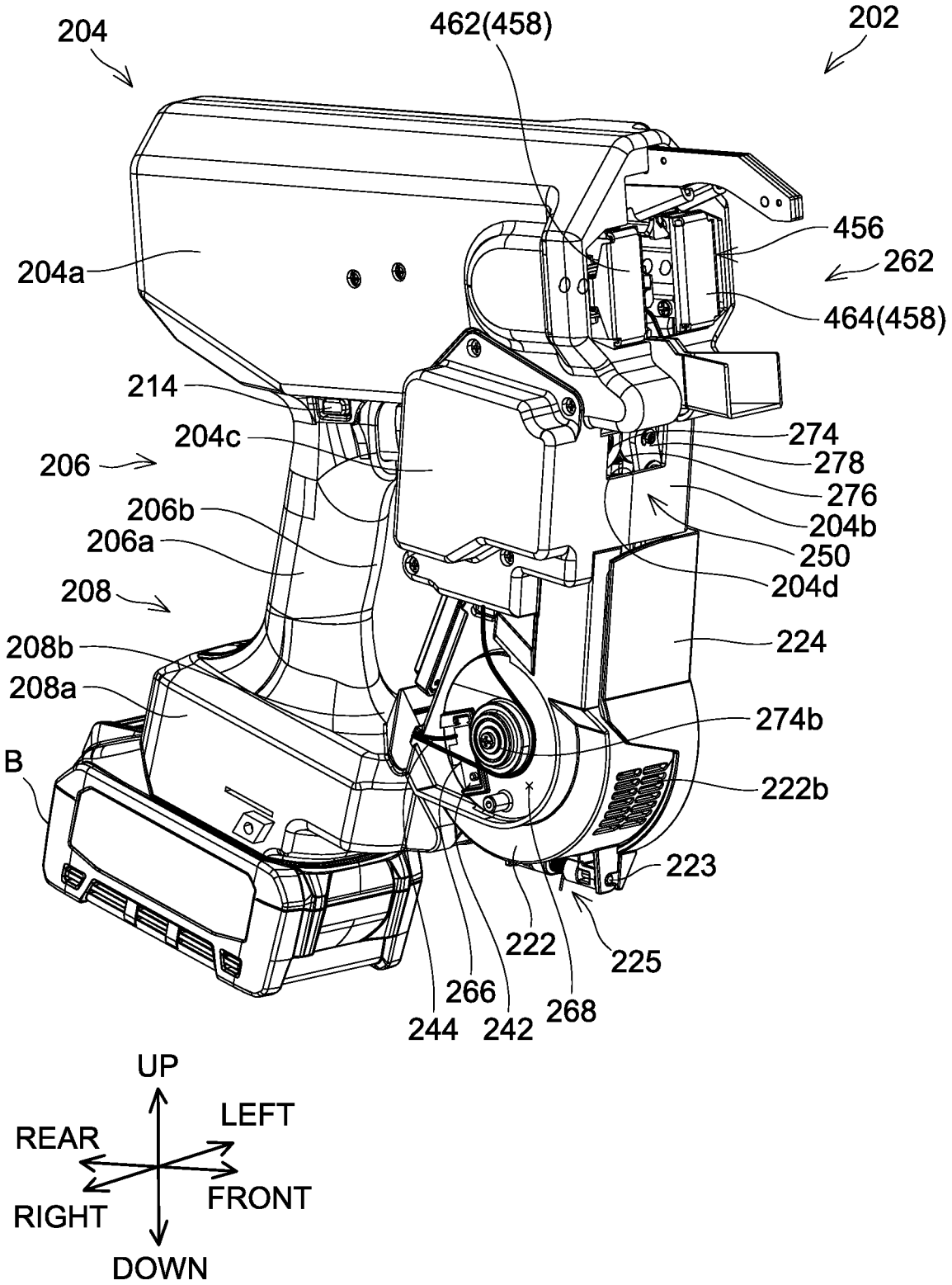
FIG. 11 is a perspective view of the rebar tying tool 202 of the second embodiment as seen from the front right upper side in a state having an auxiliary cover member 226 detached.
Figure 12:
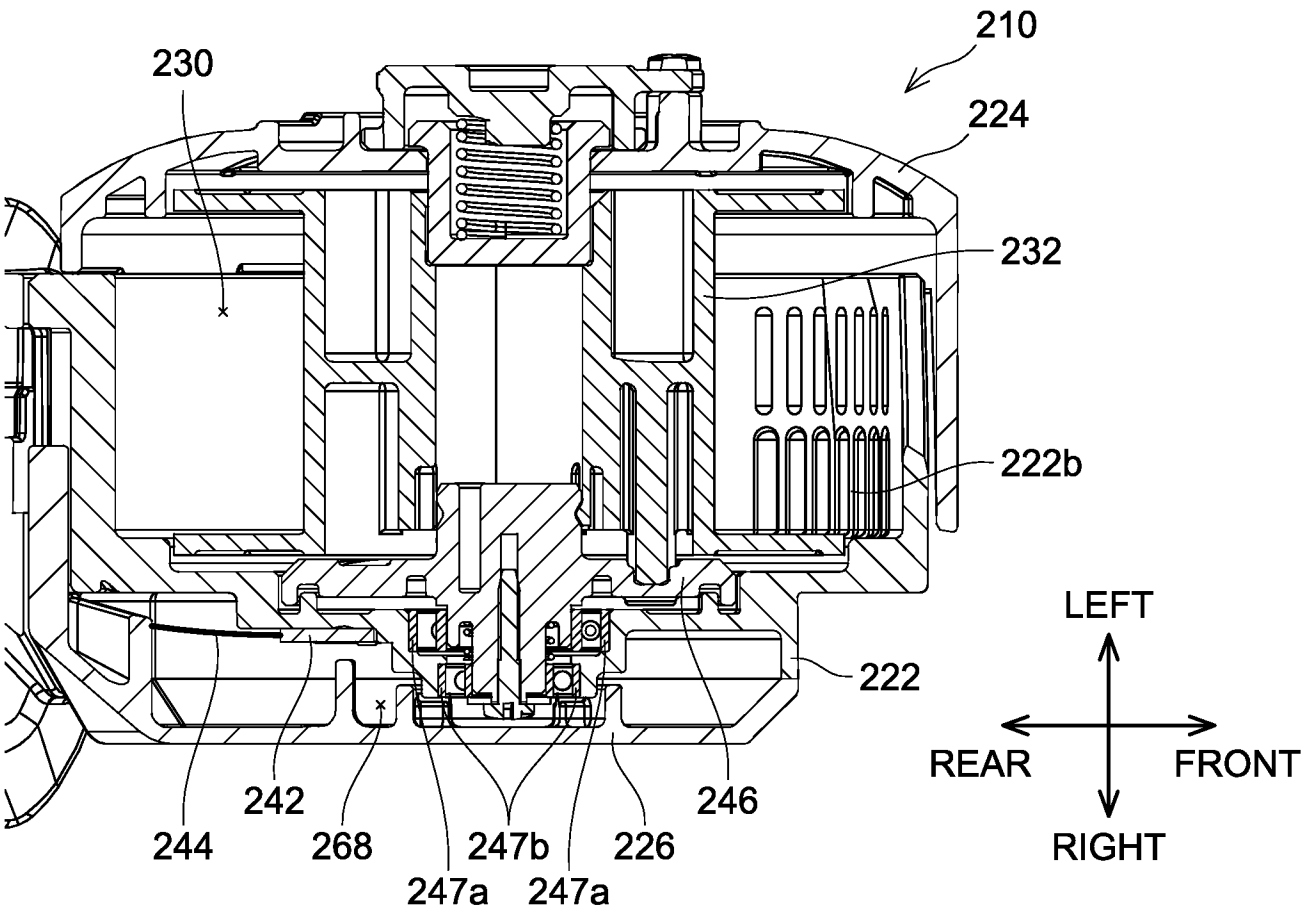
FIG. 12 is a cross-sectional view of an accommodating part 210 of the second embodiment.
Figure 13:
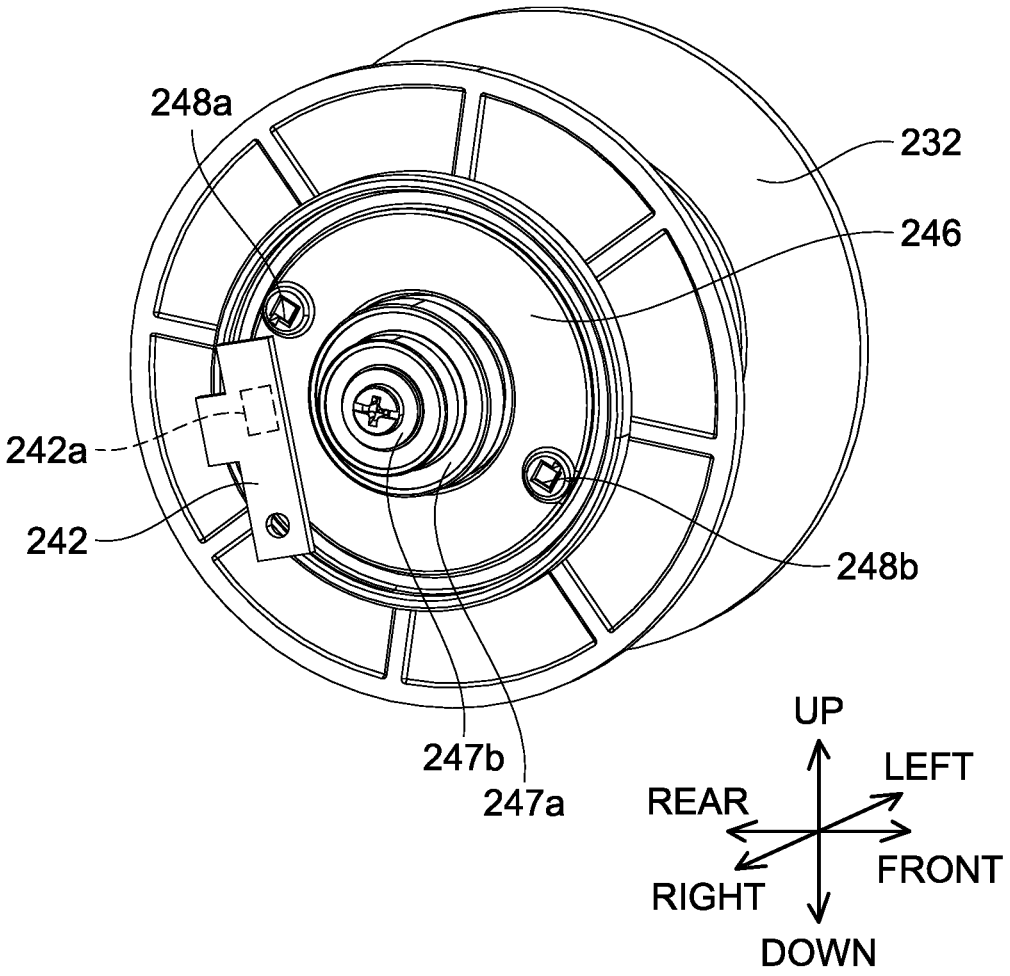
FIG. 13 is a perspective view of a reel 232, a rotating base 246, and a sensor substrate 242 of the second embodiment.

As shown in FIG. 12, the accommodating part 210 further comprises a rotating base 246. The rotating base 246 is rotatably supported by the accommodating part main body 222 via a first bearing 247*a* and a second bearing 247*b*. The rotating base 246 is disposed in the accommodating space 230. When the reel 232 is set in the accommodating space 230, the rotating base 246 and the reel 232 engage with each other. When the reel 232 rotates, the rotating base 246 rotates together with the reel 232. As shown in FIG. 13, permanent magnets 248*a*, 248*b* are attached to a right surface of the rotating base 246. The permanent magnets 248*a*, 248*b* are arranged with 180 degrees intervals in a circumferential direction of the rotating base 246. As shown in FIG. 11, a sensor substrate 242 is attached to the right side surface of the accommodating part main body 222. In a state where the auxiliary cover member 226 covers the right side surface of the accommodating part main body 222, the sensor substrate 242 is disposed in the passage space 268. As shown in FIG. 13, a magnetic sensor 242*a* is attached to the sensor substrate 242. When the reel 232 rotates in the state where the reel 232 is set in the accommodating space 230, the permanent magnets 248*a*, 248*b* rotate accompanying rotation of the rotating base 246, and magnetics detected by the magnetic sensor 242*a* thereby change. The rotation of the reel 232 is detected by this change in the magnetics detected by the magnetic sensor 242*a*.

As shown in FIGS. 10 and 12, the magnetic sensor 242*a* and the controller 220 are electrically connected by a third connecting cable 244. The third connecting cable 244 extends from the magnetic sensor 242*a* through the passage space 268 along the right side surface of the accommodating part main body 222, further extends through inside the accommodating part main body 222, through inside the coupler 209 via the openings 228, 216, and further through inside the battery receptacle 208 to the controller 220. Since the third connecting cable 244 does not extend through inside the main body 204, it does not extend near the twisting unit 254 to be described later.

Figure 14:
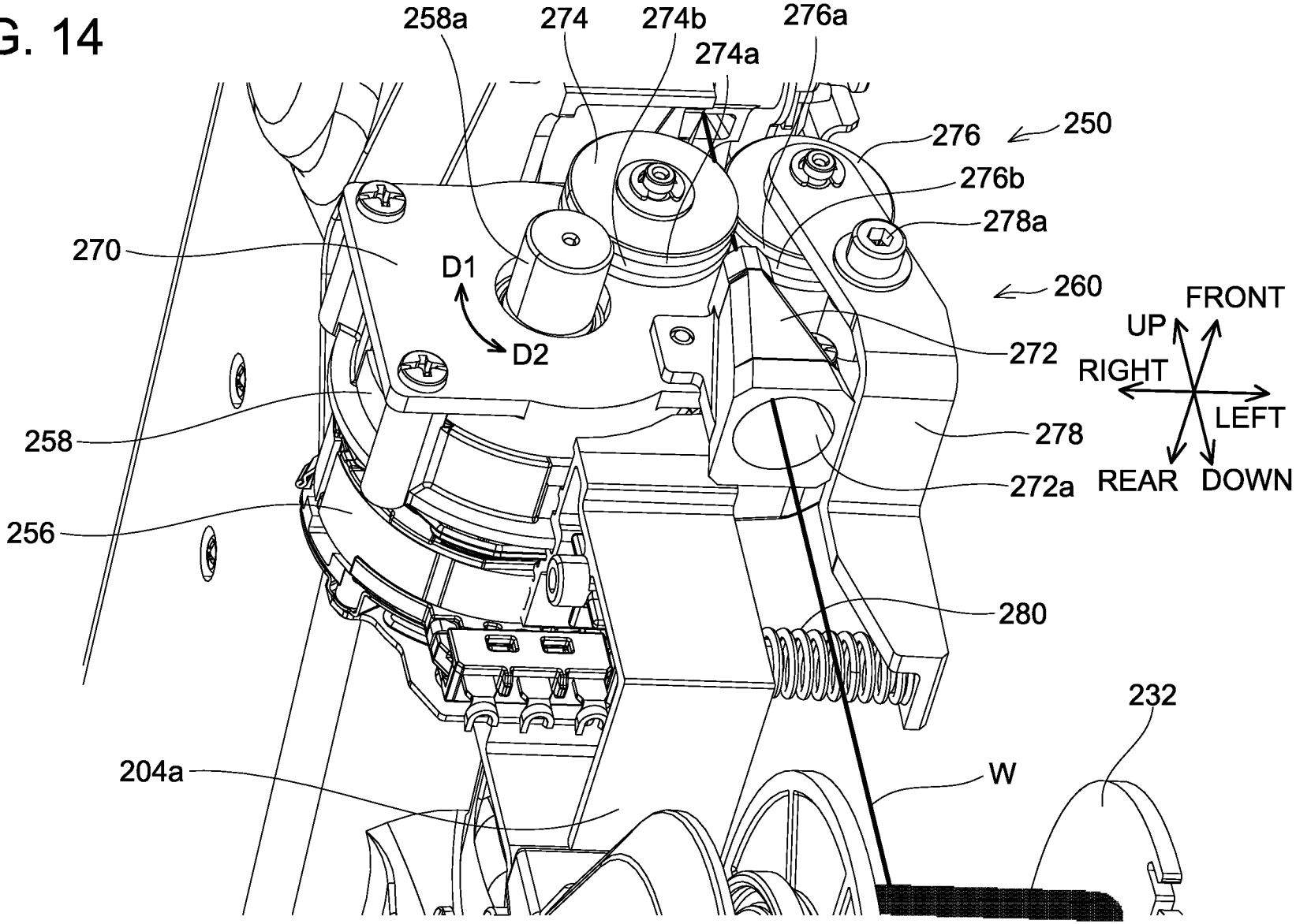
FIG. 14 is a perspective view of a feeding part 250 of the second embodiment.

The rebar tying tool 202 comprises a feeding part 250, a cutter unit 252, and a twisting unit 254. The feeding part 250 is disposed at the front lower portion of the main body 204. As shown in FIG. 14, the feeding part 250 comprises a feeding motor 256, a reduction gear unit 258, a feeding part 260, and a guiding part 262 (see FIG. 17).

The feeding motor 256, the reduction gear unit 258, and the feeding part 260 are accommodated in the main body 204. The feeding motor 256 may for example be a brushless motor. The feeding motor 256 is disposed on the right side of the right main body 204*a*, and is covered by the motor cover 204*c* (see FIG. 11). The feeding motor 256 and the controller 220 are electrically connected by a second connecting cable 266 shown in FIGS. 10 and 11. The second connecting cable 266 extends from the feeding motor 256 through inside the motor cover 204*c*, and further extends in the passage space 268 along the right side surface of the accommodating part main body 222. Further, the second connecting cable 266 extends through inside the accommodating part main body 222 and through inside the coupler 209 via the openings 228, 216, and through inside the battery receptacle 208 to the controller 220. Since the second connecting cable 266 does not extend through inside the main body 204, it does not extend near the twisting unit 254.

As shown in FIG. 14, the reduction gear unit 258 is coupled to the feeding motor 256. The reduction gear unit 258 is configured to decelerate rotation of the feeding motor 256 and transmit the same to the feeding part 260.

The feeding part 260 comprises a base part 270, a guide part 272, a driving roller 274, a driven roller 276, a link part 278, and a biasing part 280. The base part 270 is fixed to the right main body 204*a*. The guide part 272 is fixed to the base part 270. The guide part 272 includes a guide hole 272*a* through which the wire W is inserted.

The driving roller 274 is rotatably supported by the base part 270. Teeth 274*a* and a groove 274*b* are arranged on an outer circumferential surface of the driving roller 274. The teeth 274*a* mesh with an output gear 258*a* of the reduction gear unit 258. The output gear 258*a* is configured to rotate by the rotation of the feeding motor 256. The groove 274*b* is defined on the outer circumferential surface of the driving roller 274 along a direction of rotation of the driving roller 274. The driven roller 276 is rotatably supported by the link part 278. Teeth 276*a* and a groove 276*b* are arranged on an outer circumferential surface of the driven roller 276. The teeth 276*a* of the driven roller 276 mesh with the teeth 274*a* of the driving roller 274. The groove 276*b* extends along a direction of rotation of the driven roller 276 on the outer circumferential surface of the driven roller 276.

The link part 278 is pivotably supported by the base part 270 via a pivot shaft 278*a*. One end of the biasing part 280 is in contact with a lower portion of the link part 278 and another end of the biasing part 280 is in contact with the right main body 204*a*. The biasing part 280 is configured to bias the link part 278 with respect to the right main body 204*a* in a direction along which the driven roller 276 approaches toward the driving roller 274. Due to this, the driven roller 276 is pressed against the driving roller 274. As a result, the wire W is held between the groove 274*b* of the driving roller 274 and the groove 276*b* of the driven roller 276. As shown in FIGS. 9 and 11, a window 204*d* through which the operator can visually identify the driving roller 274 and the driven roller 276 is defined in front surfaces of the left main body 204*b* and the motor cover 204*c*.

Figure 17:
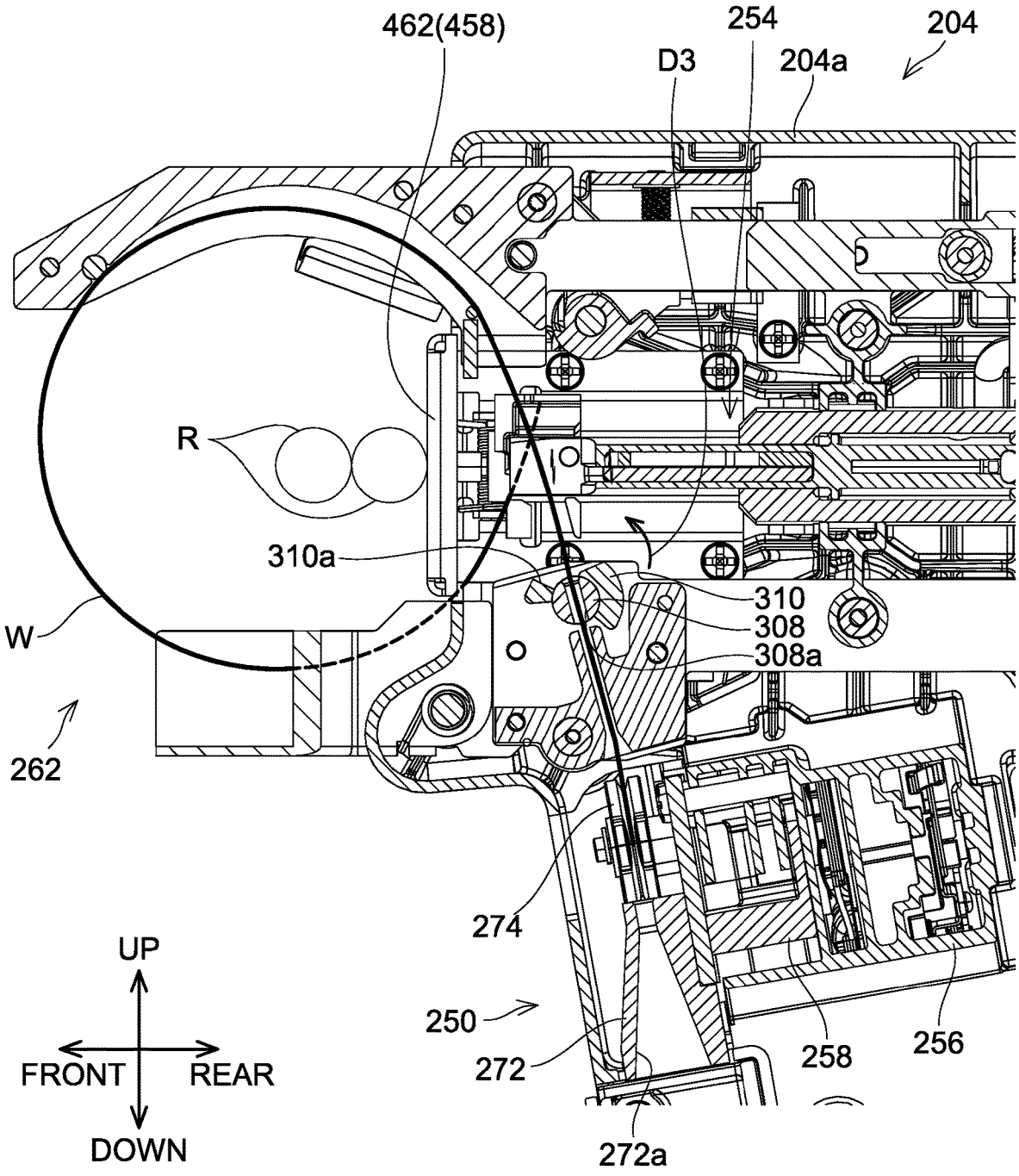
FIG. 17 is a cross-sectional view of a vicinity of a guiding part 262 of the rebar tying tool 202 of the second embodiment.

As shown in FIG. 14, the wire W moves by the rotation of the feeding motor 256 in a state where the wire W is held between the groove 274*b* of the driving roller 274 and the groove 276*b* of the driven roller 276. In the present embodiment, when the feeding motor 256 rotates forward, the output gear 258*a* rotates in a direction D1 and the driving roller 274 and the driven roller 276 thereby rotate in a direction of feeding the wire W out upward from below, and thus the wire W is fed out from the reel 232 into the guiding part 262 (see FIG. 17). As shown in FIG. 17, the guiding part 262 guides the fed-out wire W around the rebars R in a loop shape. On the other hand, when the feeding motor 256 rotates in reverse, the output gear 258*a* rotates in a direction D2 shown in FIG. 12 and the driving roller 274 and the driven roller 276 thereby rotate in a direction of pulling the wire W back downward from above, and thus the wire W is pulled back from the guiding part 262 toward the reel 232.

Figure 15:
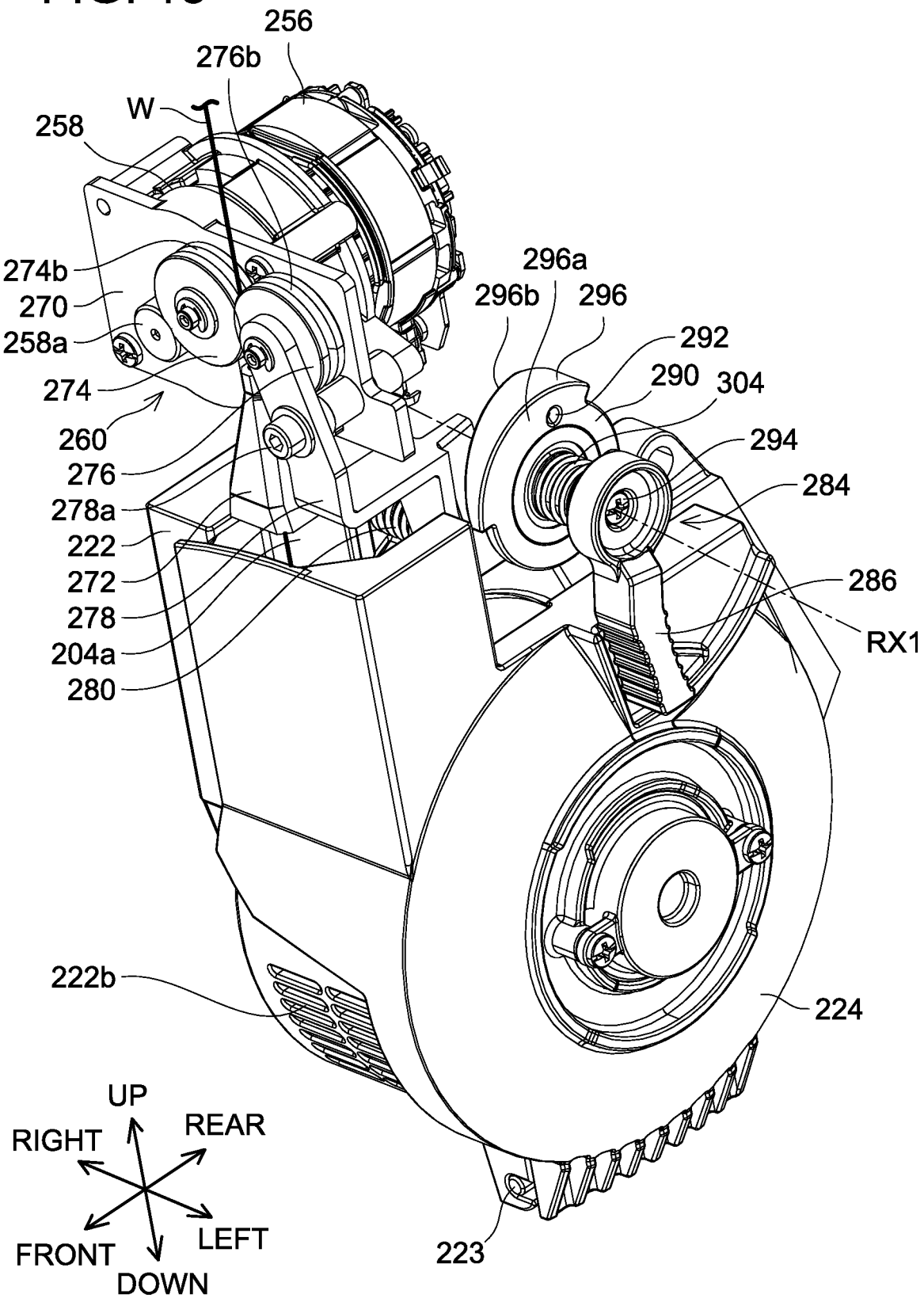
FIG. 15 is a perspective view of an accommodating part 210, a feeding motor 256, a reduction gear unit 258, a feeding part 260, and an operating part 284 of the second embodiment.
Figure 16:
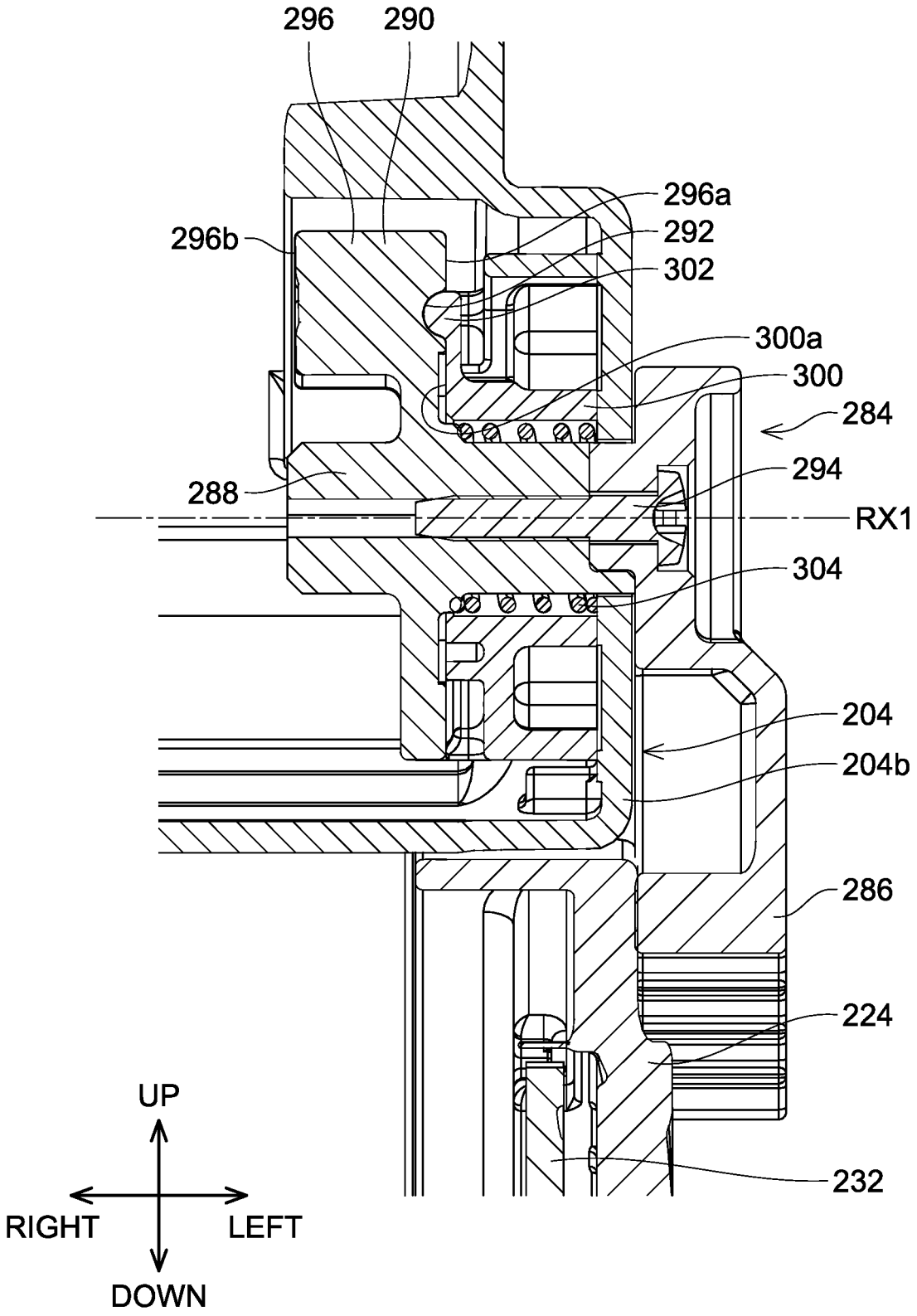
FIG. 16 is a cross-sectional view of a vicinity of the operating part 284 of the second embodiment when a lever 286 is in a closed position.

As shown in FIG. 15, the rebar tying tool 202 further comprises an operating part 284. As shown in FIG. 16, the operating part 284 comprises a lever 286, a coupler 288, a cam part 290, and a recess 292. The lever 286 is configured to be operated by the operator. The lever 286 is disposed outside the main body 204. The lever 286 is disposed on the left side of the left main body 204*b*. The lever 286 is configured to pivot to and from an open position and a closed position about a pivot axis RX1 extending in the left-right direction. The lever 286 slides along outer surfaces of the left main body 204*b* and the cover member 224. When the lever 286 is in the closed position, the lever 286 is in contact with the outer surface of the cover member 224. Due to this, the cover member 224 is maintained in the prohibited state. When the lever 286 moves from the closed position toward the open position and the lever 286 no longer is in contact with the outer surface of the cover member 224, the cover member 224 shifts from the prohibited state to the allowed state by the biasing force of the biasing part 225 (see FIG. 9).

The coupler 288 couples the lever 286 and the cam part 290. The coupler 288 is integrated with the cam part 290. The coupler 288 is fixed to the lever 286 by a screw 294. The coupler 288 penetrates the left surface of the left main body 204*b*.

The cam part 290 is disposed inside the main body 204. The cam part 290 is configured to pivot integrally with the lever 286. The cam part 290 comprises an edge 296. A left surface 296*a* of the edge 296 is parallel to a plane that perpendicularly intersects the pivot axis RX1. Further, the left surface 296*a* of the edge 296 faces an inner surface of the left main body 204*b*. A recess 292 is defined on the left surface 296*a* of the edge 296. The recess 292 is recessed rightward from the left surface 296*a* of the edge 296. A position of the recess 292 is fixed with respect to the cam part 290. As shown in FIG. 15, a right surface 296*b* of the edge 296 has a shape by which a width between the right surface 296*b* and the left surface 296*a* of the edge 296 increases in a clockwise direction as seeing the pivot axis RX1 from the left. The right surface 296*b* of the edge 296 is slidably in contact with a left surface at a lower portion of the link part 278. When the lever 286 is in the closed position, a portion where the width between the left surface 296*a* and the right surface 296*b* of the edge 296 is the smallest comes into contact with the link part 278. At this occasion, the driven roller 276 is pressed against the driving roller 274. When the lever 286 is in the open position, a portion where the width between the left surface 296*a* and the right surface 296*b* of the edge 296 is the largest comes into contact with the link part 278. Since the cam part 290 presses in the link part 278 against the biasing force of the biasing part 280, the link part 278 pivots about the pivot shaft 278*a*. As a result, the driven roller 276 separates away from the driving roller 274.

As shown in FIG. 16, a fixing member 300 is fixed to the inner surface of the left main body 204*b*. The coupler 288 is inserted in the fixing member 300. The fixing member 300 is disposed between the inner surface of the left main body 204*b* and the left surface 296*a* of the cam part 290. A right surface 300*a* of the fixing member 300 faces the left surface 296*a* of the cam part 290. A protrusion 302 protruding rightward is arranged on the right surface 300*a* of the fixing member 300. A position of the protrusion 302 is fixed with respect to the left main body 204*b*. The protrusion 302 is given a shape corresponding to a shape of the recess 292 defined in the cam part 290. The protrusion 302 is configured to engage with the recess 292 when the lever 286 is in the closed position. When the protrusion 302 engages with the recess 292, the lever 286 is maintained in the closed position. When the lever 286 is operated by the operator to be moved from the closed position to the open position, the right surface 300*a* of the fixing member 300 warps toward the inner surface of the left main body 204*b*. Due to this, engagement of the protrusion 302 and the recess 292 is thereby released.

The coupler 288 extends through inside a third biasing member 304. The third biasing member 304 may for example be a compression spring. The third biasing member 304 is inserted in the fixing member 300 so as to surround the coupler 288. One end of the third biasing member 304 is in contact with the left surface 296*a* of the cam part 290 and another end of the third biasing member 304 is in contact with the inner surface of the left main body 204*b*. The third biasing member 304 is configured to bias the cam part 290 rightward with respect to the left main body 204*b*. Due to this, the lever 286 is pressed against the outer surfaces of the left main body 204*b* and the cover member 224. As a result, wobbling of the operating part 284 is suppressed.

Figure 18:
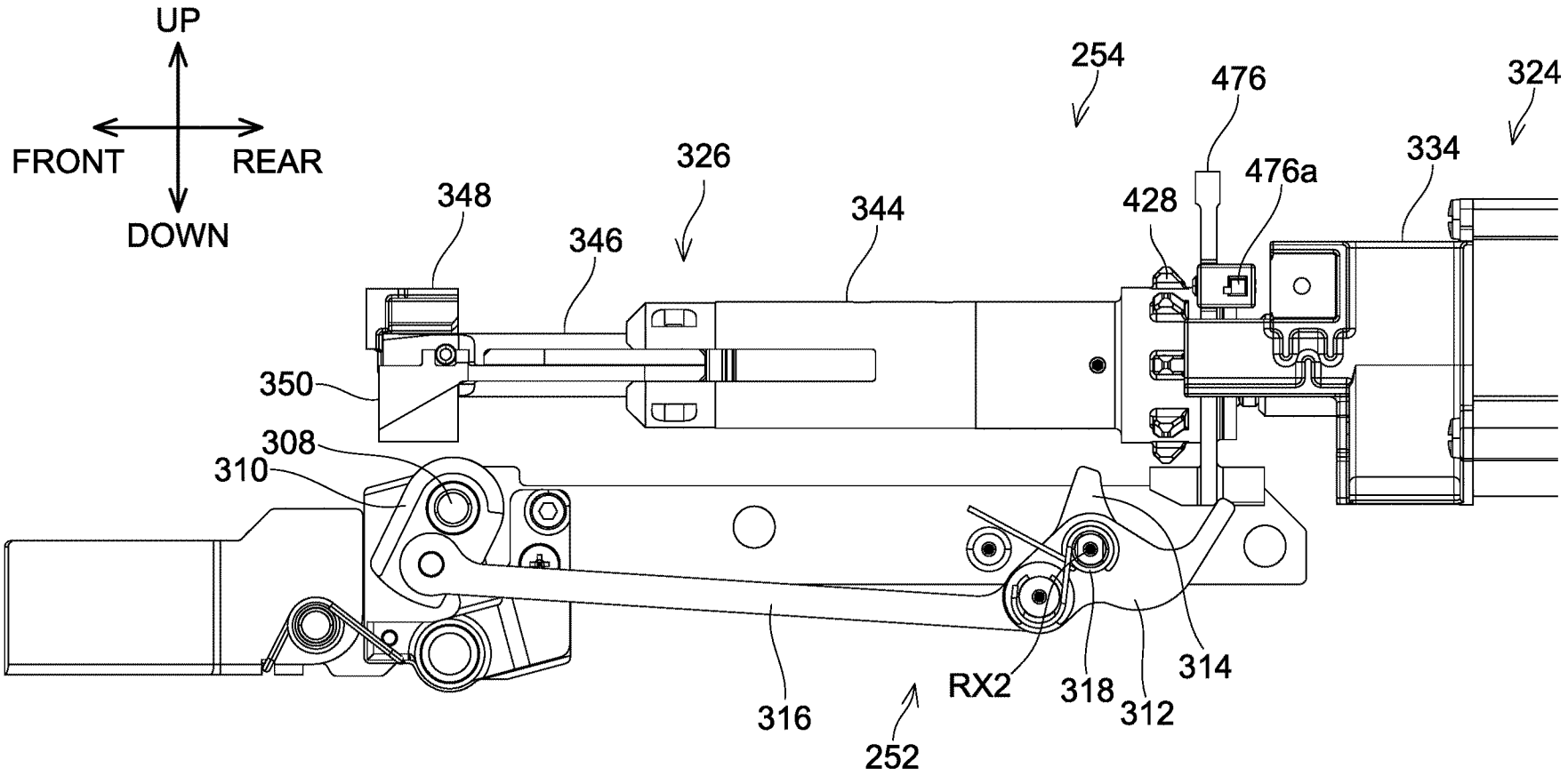
FIG. 18 is a side view of a cutter unit 252 of the rebar tying tool 202 of the second embodiment showing a state before a first lever member 312 and a second lever member 314 pivot.

As shown in FIG. 18, the cutter unit 252 comprises a fixed cutter member 308, a movable cutter member 310, a first lever member 312, a second lever member 314, a link member 316, and a torsion spring 318. The fixed cutter member 308 and the movable cutter member 310 are disposed on a passage along which the wire W is fed from the feeding part 260 to the guiding part 262. The fixed cutter member 308 comprises a hole 308*a* (see FIG. 17) through which the wire W extends. The movable cutter member 310 is supported by the fixed cutter member 308 so as to be able to slide and pivot about the fixed cutter member 308. The movable cutter member 310 comprises a hole 310*a* (see FIG. 17) through which the wire W extends. When the movable cutter member 310 pivots in a direction D3 shown in FIG. 17 in a state of having the wire W inserted in both the hole 308*a* of the fixed cutter member 308 and the hole 310*a* of the movable cutter member 310, the wire W is thereby cut.

Figure 19:
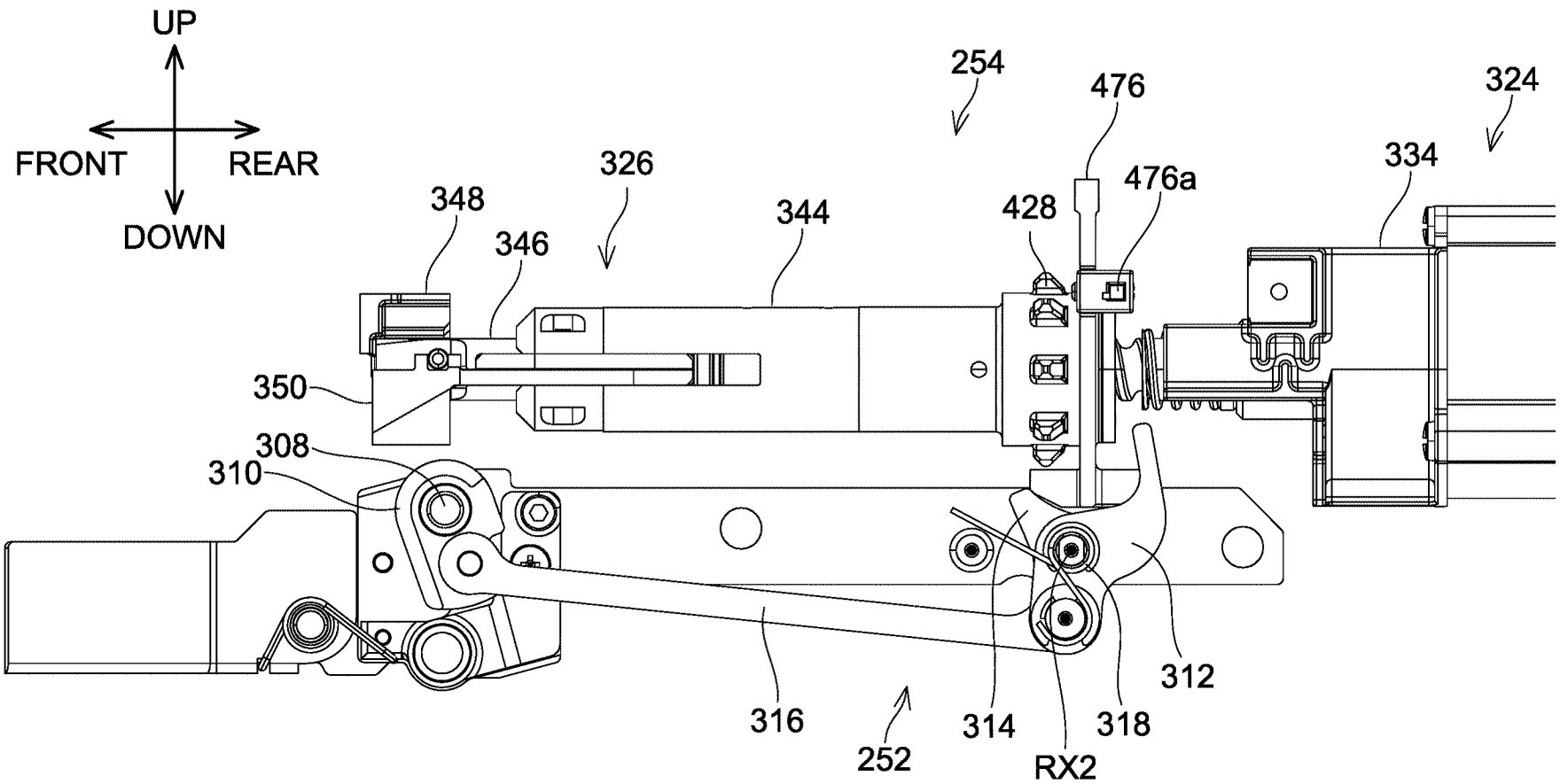
FIG. 19 is a side view of the cutter unit 252 of the rebar tying tool 202 of the second embodiment showing a state after the first lever member 312 and the second lever member 314 have pivoted.

As shown in FIG. 18, the first lever member 312 and the second lever member 314 are fixed to each other. The first lever member 312 and the second lever member 314 are capable of pivoting about a pivot axis RX2. Lower ends of the first lever member 312 and the second lever member 314 are pivotably coupled to a rear end of the link member 316. A front end of the link member 316 is pivotably coupled to a lower end of the movable cutter member 310. The rear end of the link member 316 is biased frontward by a torsion spring 318. When the first lever member 312 and the second lever member 314 pivot in a direction along which the lower ends thereof move frontward, the link member 316 moves frontward. On the other hand, as shown in FIG. 19, when the first lever member 312 and the second lever member 314 pivot in a direction along which the lower ends thereof move rearward, the link member 316 moves rearward. Due to this, the wire W is cut.

Figure 20:
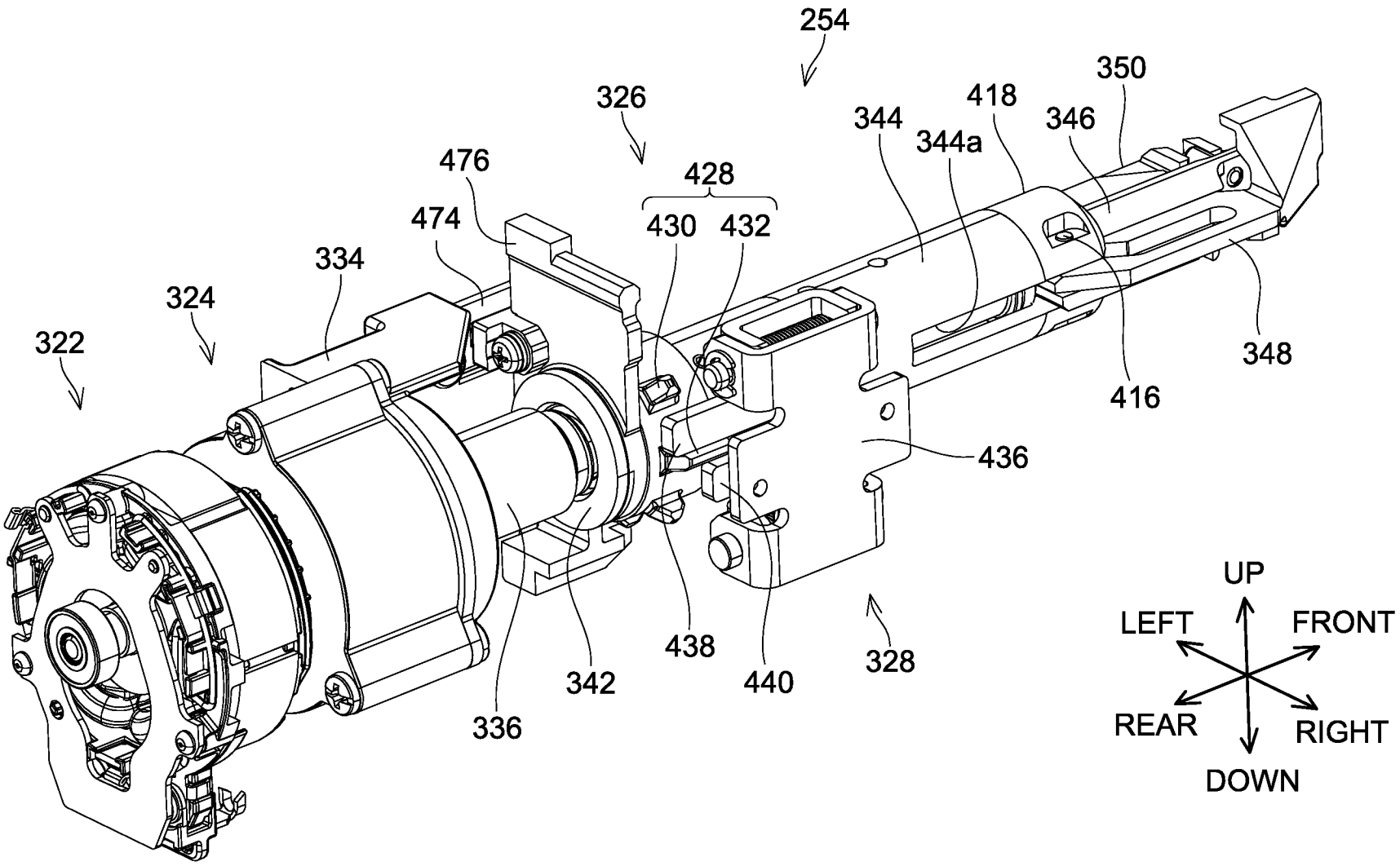
FIG. 20 is a perspective view of a twisting unit 254 of the rebar tying tool 202 of the second embodiment.

As shown in FIG. 20, the twisting unit 254 comprises a twisting motor 322, a reduction gear unit 324, a retaining part 326, and a rotation restrictor 328. The twisting motor 322 may for example be a brushless motor. The twisting motor 322 has same configuration as the feeding motor 256. As shown in FIG. 10, the twisting motor 322 and the controller 220 are electrically connected by a fourth connecting cable 330. The fourth connecting cable 330 extends from the twisting motor 322 through an inner rear portion of the main body 204, further extends through inside the grip 206 via a connecting position between the main body 204 and the grip 206, and through inside the battery receptacle 208 to the controller 220.

The reduction gear unit 324 shown in FIG. 20 is configured to decelerate rotation of the twisting motor 322 and transmit the same to the retaining part 326. The twisting motor 322 and the reduction gear unit 324 are fixed to the right main body 204*a* and the left main body 204*b*.

Figure 21:
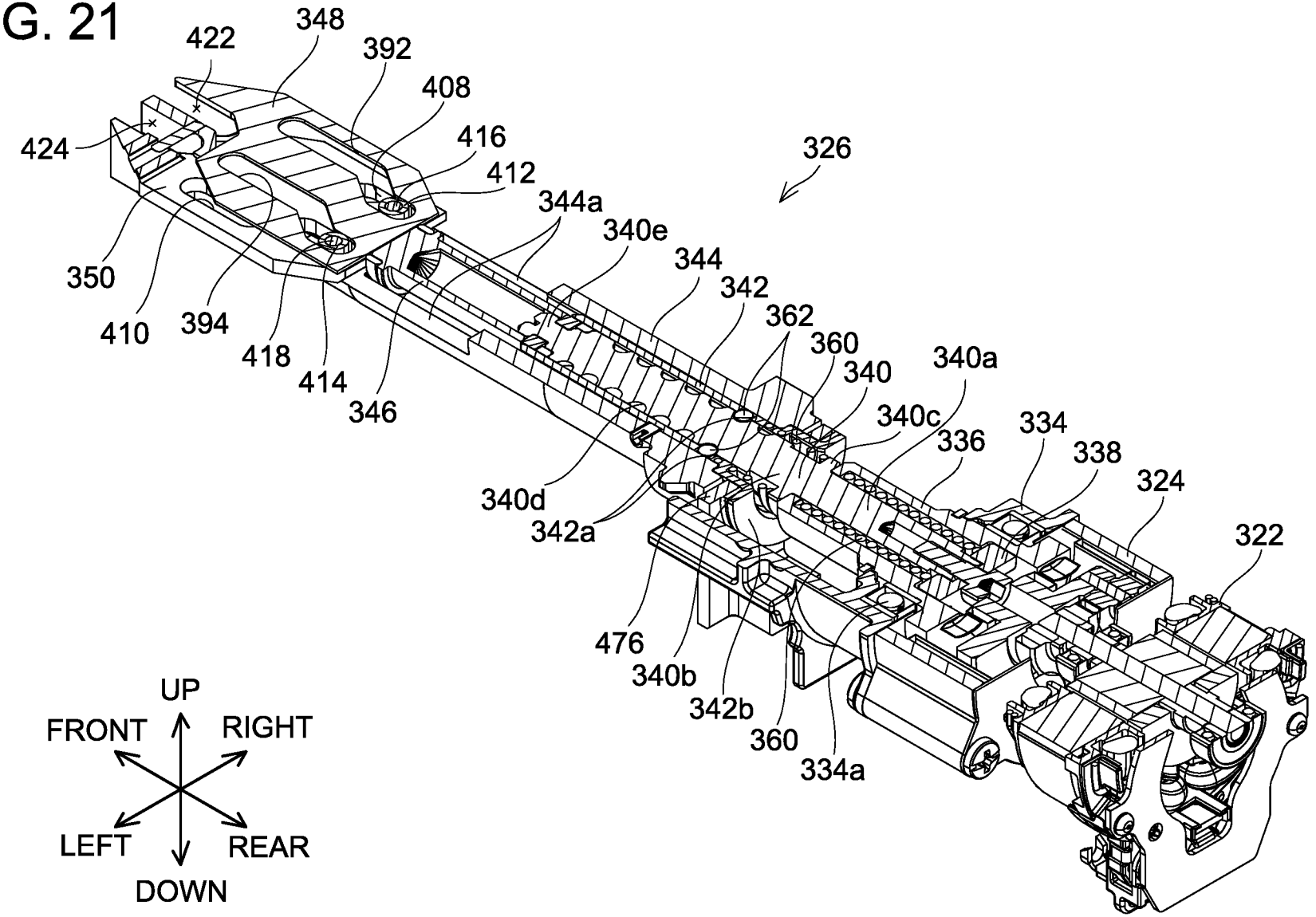
FIG. 21 is a cross-sectional view of a twisting motor 322, a reduction gear unit 324, and a retaining part 326 of the twisting unit 254 of the rebar tying tool 202 of the second embodiment.

As shown in FIG. 21, the retaining part 326 comprises a bearing box 334, a carrier sleeve 336, a clutch plate 338, a screw shaft 340, an inner sleeve 342, an outer sleeve 344, a clamp shaft 346, a right clamp 348, and a left clamp 350.

The bearing box 334 is fixed to the reduction gear unit 324. The bearing box 334 rotatably supports the carrier sleeve 336 via a bearing 334*a*. Rotation is transmitted from the reduction gear unit 324 to the carrier sleeve 336. When the twisting motor 322 rotates forward, the carrier sleeve 336 rotates in a left-hand screw direction as seen from behind. When the twisting motor 322 rotates in reverse, the carrier sleeve 336 rotates in a right-hand screw direction as seen from behind.

Figure 22:
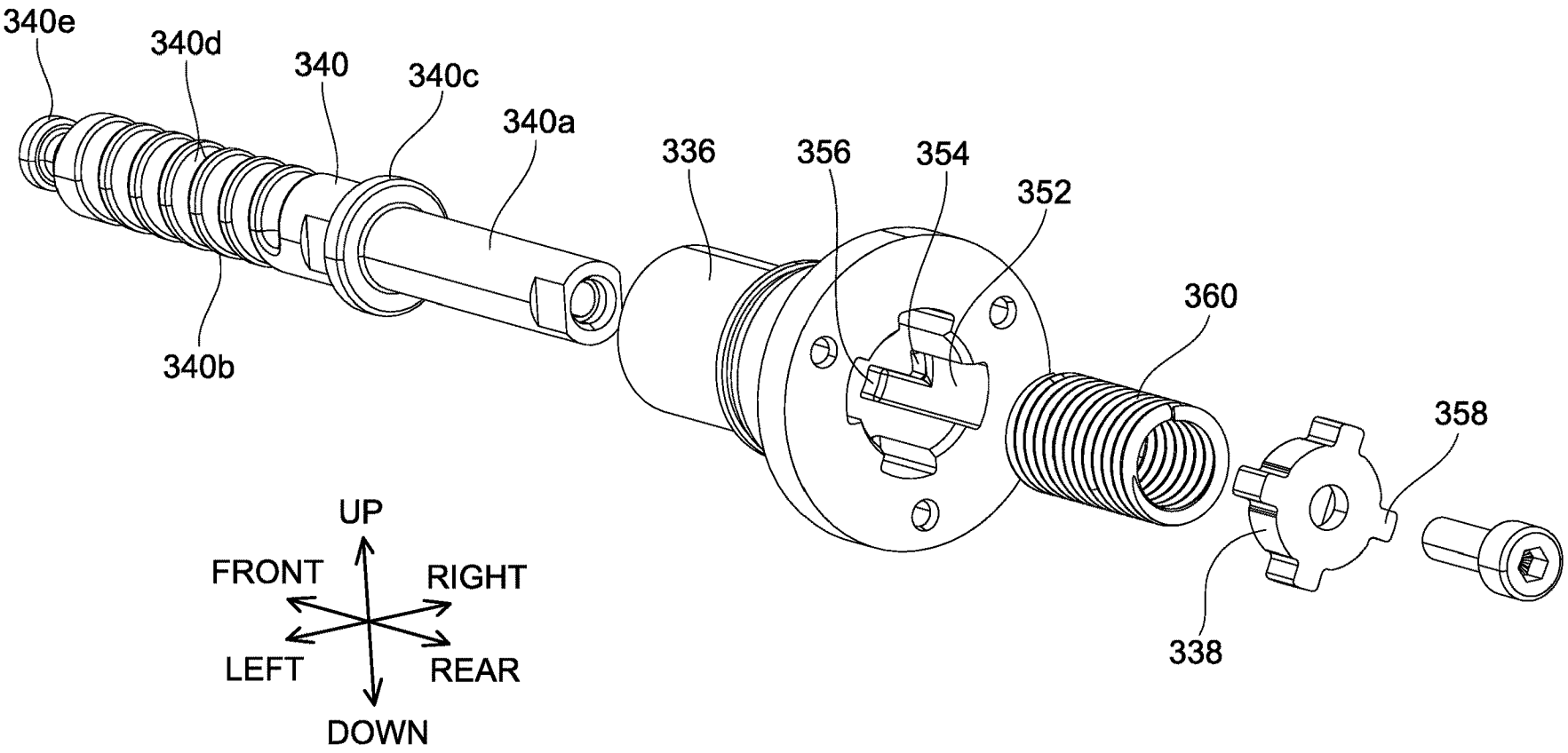
FIG. 22 is a perspective view of a carrier sleeve 336, a clutch plate 338, and a screw shaft 340 of the twisting unit 254 of the rebar tying tool 202 of the second embodiment.

As shown in FIG. 22, a clutch groove 352 extending in the front-rear direction is defined on an inner circumferential surface at a rear portion of the carrier sleeve 336. A first wall 354 and a second wall 356 are arranged at a front end of the clutch groove 352. A distance from a rear end of the carrier sleeve 336 to the first wall 354 in the front-rear direction is smaller than a distance from the rear end of the carrier sleeve 336 to the second wall 356 in the front-rear direction. The clutch plate 338 is accommodated in the carrier sleeve 336. A clutch piece 358 corresponding to the clutch groove 352 is arranged on the clutch plate 338. The clutch plate 338 is biased rearward with respect to the carrier sleeve 336 by a compression spring 360 accommodated in the carrier sleeve 336. In a normal state, the clutch plate 338 is capable of moving forward with respect to the carrier sleeve 336 to a position at which the clutch piece 358 comes into contact with the first wall 354 of the clutch groove 352. When the wire W is to be twisted, the carrier sleeve 336 rotates in the left-hand screw direction with respect to the clutch plate 338 as seen from behind, thus the clutch plate 338 is capable of moving forward with respect to the carrier sleeve 336 to a position at which the clutch piece 358 comes into contact with the second wall 356 of the clutch groove 352.

A rear part 340*a* of the screw shaft 340 is inserted into the carrier sleeve 336 from the front side, and is fixed to the clutch plate 338. A flange 340*c* projecting in a radial direction is arranged between the rear part 340*a* and a front part 340*b* of the screw shaft 340. A spiral ball groove 340*d* is defined in an outer circumferential surface of the front part 340*b* of the screw shaft 340. An engaging part 340*e* with a smaller diameter than the front part 340*b* is arranged at a front end of the screw shaft 340.

Figure 31:
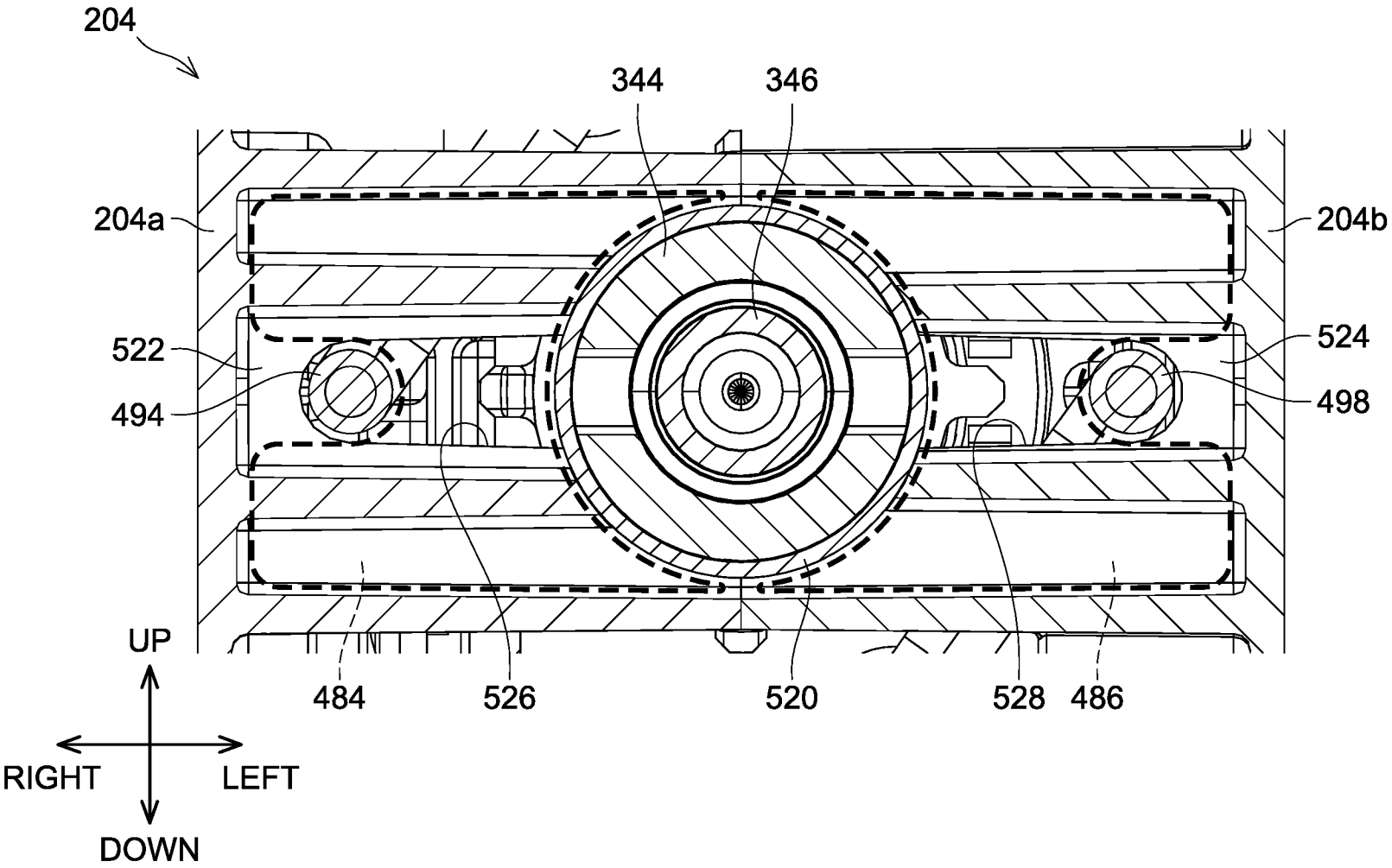
FIG. 31 is a cross-sectional view of a vicinity of an outer sleeve 344 of the rebar tying tool 202 of the third embodiment.

As shown in FIG. 21, the compression spring 360 is attached to the front part 340*b* of the screw shaft 340. The front part 340*b* of the screw shaft 340 is inserted into the inner sleeve 342 from behind. The inner sleeve 342 comprises a ball hole 342*a* for retaining balls 362. The balls 362 fit in the ball groove 340*d* of the screw shaft 340. A flange 342*b* projecting in the radial direction is arranged at a rear end of the inner sleeve 342. The inner sleeve 342 is inserted into the outer sleeve 344 from behind. The outer sleeve 344 is fixed to the inner sleeve 342. When rotation of the outer sleeve 344 is allowed by the rotation restrictor 328 (see FIG. 20), the inner sleeve 342 and the outer sleeve 344 rotate integrally as the screw shaft 340 rotates. On the other hand, when the rotation of the outer sleeve 344 is prohibited by the rotation restrictor 328 (see FIG. 18), the inner sleeve 342 and the outer sleeve 344 move in the front-rear direction with respect to the screw shaft 340. Specifically, when the twisting motor 322 rotates forward and the screw shaft 340 rotates in the left-hand screw direction as seen from behind, the inner sleeve 342 and the outer sleeve 344 move forward with respect to the screw shaft 340. Further, when the twisting motor 322 rotates in reverse and the screw shaft 340 rotates in the right-hand screw direction as seen from behind, the inner sleeve 342 and the outer sleeve 344 move rearward with respect to the screw shaft 340. A slit 344*a* extending rearward from a front end of the outer sleeve 344 is defined in a front portion of the outer sleeve 344. As shown in FIG. 31, a part of an outer circumferential surface of the outer sleeve 344 is surrounded by a bearing 520. The bearing 520 has a loop shape. A diameter of an inner circumferential surface of the bearing 520 is slightly greater than a diameter of the outer circumferential surface of the outer sleeve 344. Due to this, the outer sleeve 344 can move in the front-rear direction inside the bearing 520. The bearing 520 is retained by a right bearing retaining part 522 arranged on the inner surface of the right main body 204*a* and a left bearing retaining part 524 arranged on the inner surface of the left main body 204*b*. Due to this, a position of the bearing 520 with respect to the main body 204 in the front-rear direction is fixed. The outer sleeve 344 is inserted between the right bearing retaining part 522 and the left bearing retaining part 524.

Figure 23:
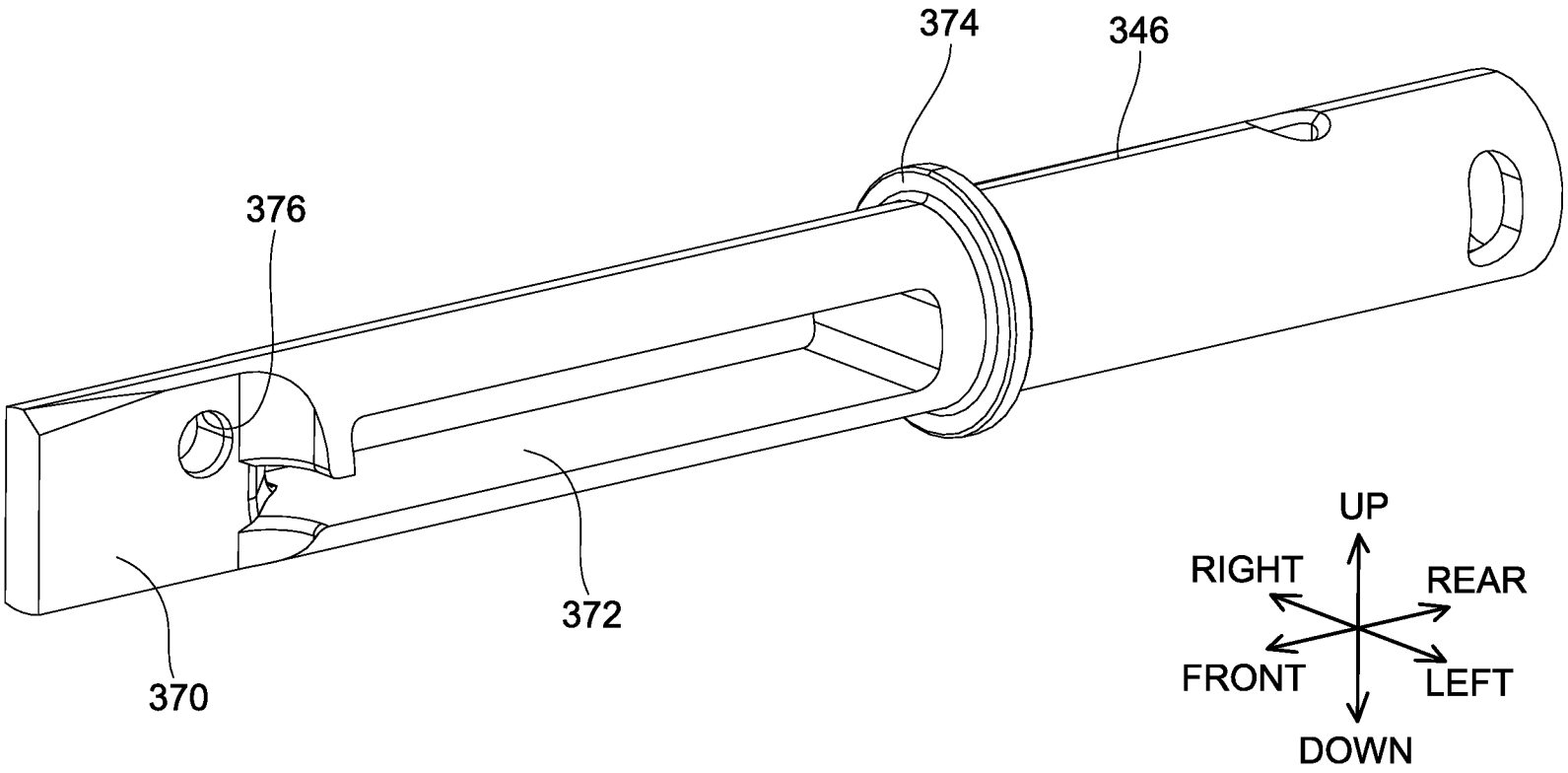
FIG. 23 is a perspective view of a clamp shaft 346 of the twisting unit 254 of the rebar tying tool 202 of the second embodiment.

The clamp shaft 346 is inserted into the inner sleeve 342 from the front side. The engaging part 340*e* of the screw shaft 340 is inserted in a rear end of the clamp shaft 346. The clamp shaft 346 is fixed to the screw shaft 340. As shown in FIG. 23, the clamp shaft 346 comprises a flat plate part 370, an opening 372, and a flange 374. The flat plate part 370 is disposed at a front end of the clamp shaft 346, and has a flat plate shape extending in the up-down direction and the front-rear direction. The flat plate part 370 has a hole 376 into which a pin 378 (see FIG. 24) is to be fitted. The opening 372 is disposed behind the flat plate part 370. The opening 372 penetrates the clamp shaft 346 in the left-right direction and extends in the front-rear direction. The flange 374 is disposed behind the opening 372 and protrudes in the radial direction.

Figure 24:
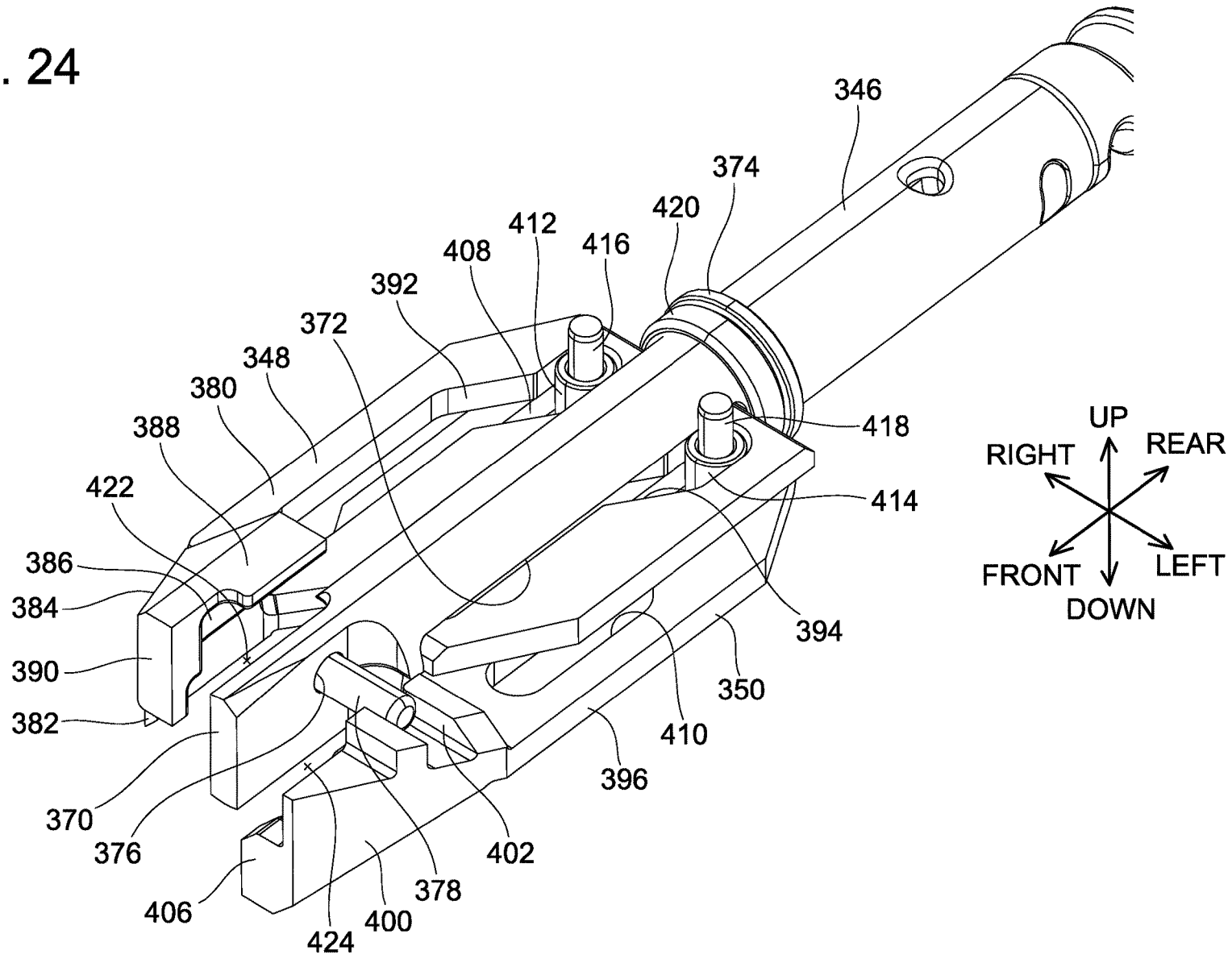
FIG. 24 is a perspective view of the twisting unit 254 of the rebar tying tool 202 of the second embodiment in a state having a right clamp 348 and a left clamp 350 attached to the clamp shaft 346.

As shown in FIG. 24, the right clamp 348 is attached to the clamp shaft 346 so as to penetrate the opening 372 of the clamp shaft 346 from right to left. The left clamp 350 is attached to the clamp shaft 346 so as to penetrate the opening 372 of the clamp shaft 346 from left to right below the right clamp 348.

Figure 25:
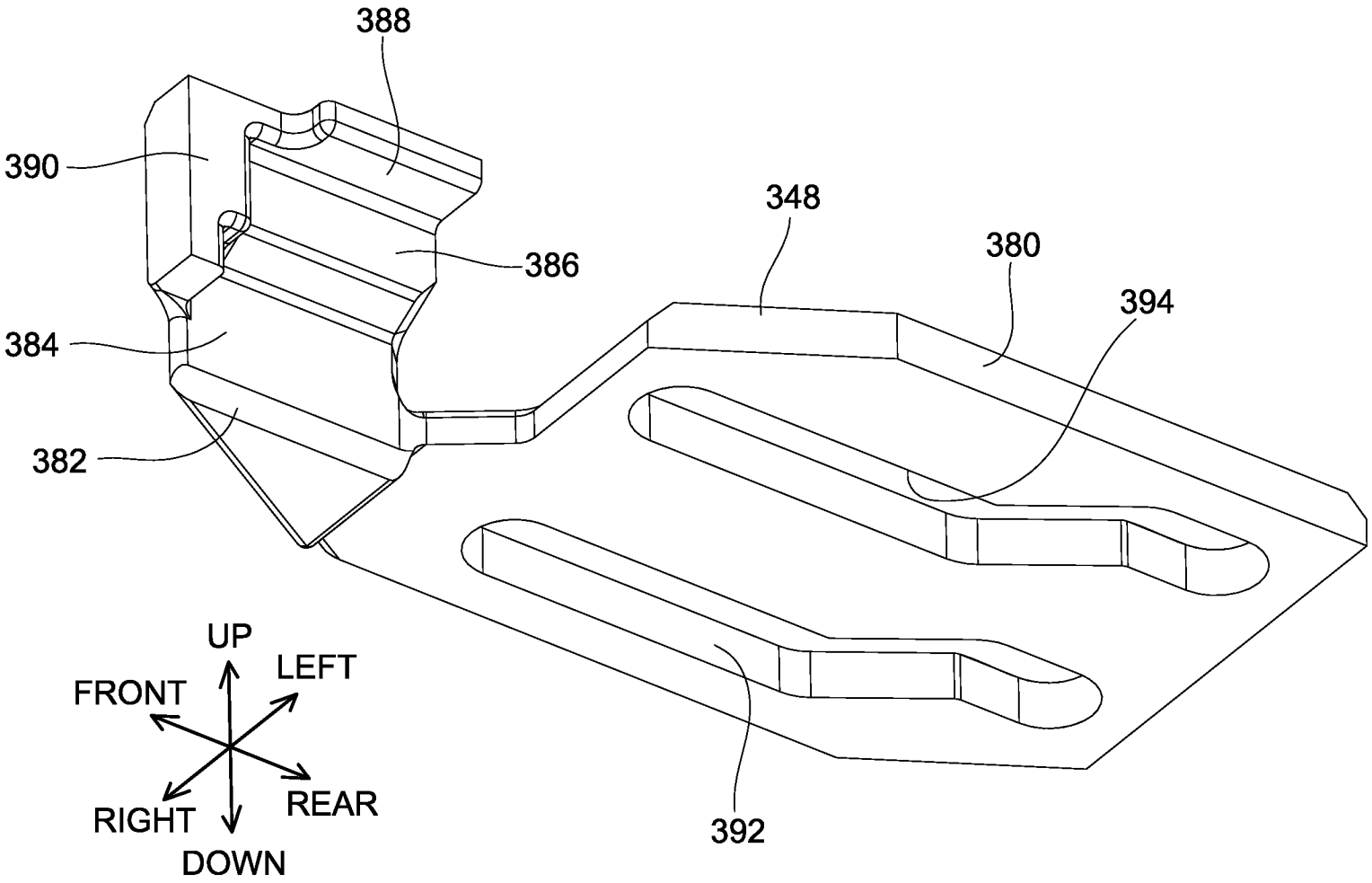
FIG. 25 is a perspective view of the right clamp 348 of the twisting unit 254 of the rebar tying tool 202 of the second embodiment.

As shown in FIG. 25, the right clamp 348 comprises a base part 380, a first projection 382, a second projection 384, a contacting part 386, an upper guard 388, and a front guard 390. The base part 380 has a flat plate shape extending in the front-rear direction and the left-right direction. The base part 380 comprises cam holes 392, 394. The cam holes 392, 394 each have a shape extending frontward toward a front end from a rear end, bending to extend toward the right front side, and bending again to extend frontward. The first projection 382 projects downward from a right front end of the base part 380. The second projection 384 projects upward from the right front end of the base part 380. The contacting part 386 protrudes leftward from an upper end of the second projection 384. The upper guard 388 protrudes leftward from an upper end of the contacting part 386. The front guard 390 protrudes leftward from front ends of the second projection 384 and the contacting part 386.

Figure 26:
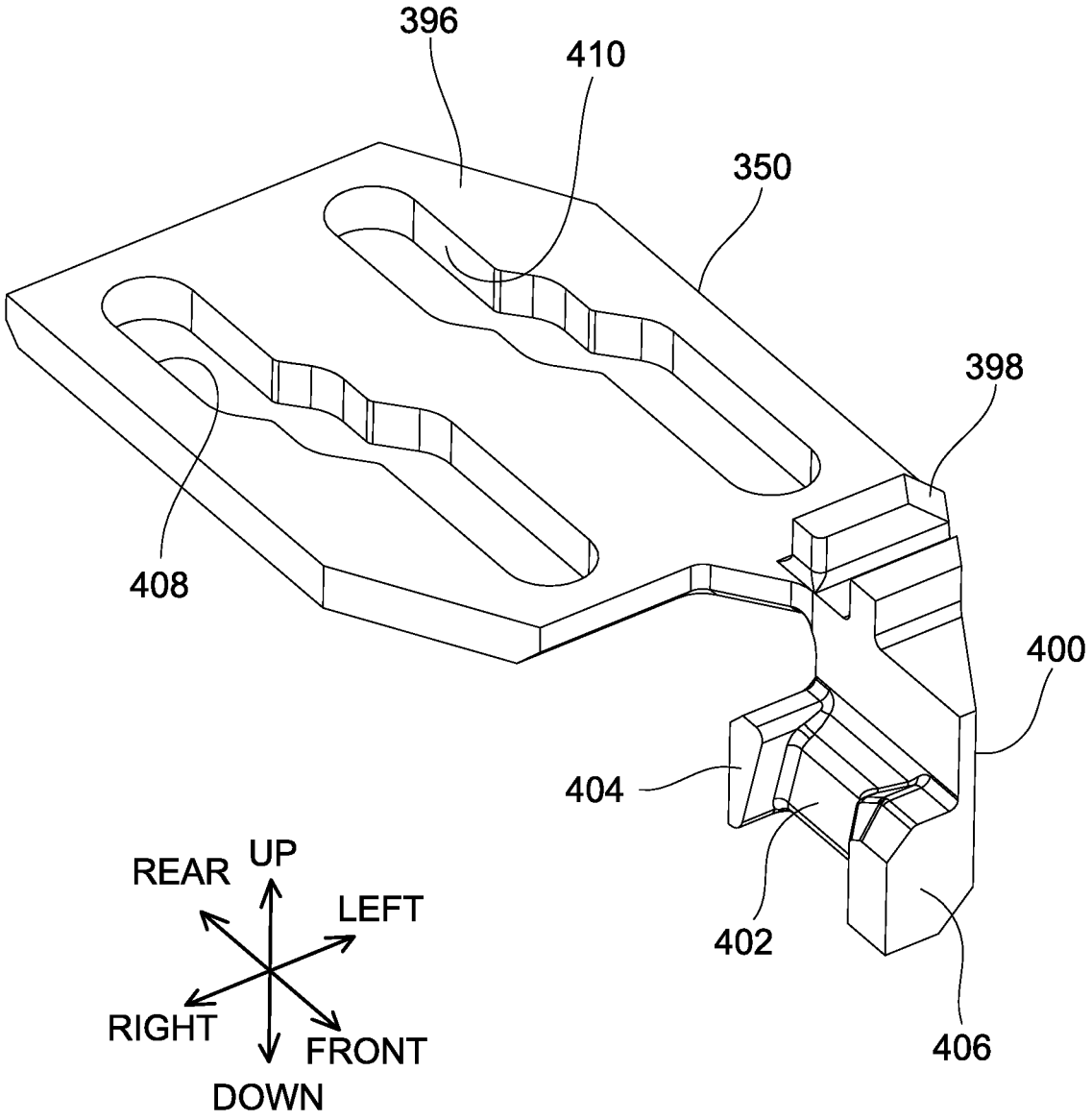
FIG. 26 is a perspective view of the left clamp 350 of the twisting unit 254 of the rebar tying tool 202 of the second embodiment.

As shown in FIG. 26, the left clamp 350 comprises a base part 396, a pin retaining part 398, a first projection 400, a contacting part 402, a rear guard 404, and a front guard 406. The base part 396 has a flat plate shape extending in the front-rear direction and the left-right direction. The base part 396 comprises cam holes 408, 410. The cam holes 408, 410 each have a shape extending frontward toward a front end from a rear end, bending to extend toward the left front side, bending again to extend frontward, then bending to extend toward the left front side, and further bending again to extend frontward. The pin retaining part 398 projects upward from a left front end of the base part 396. The pin retaining part 398 slidably retains the pin 378 (see FIG. 24). The first projection 400 projects downward from the left front end of the base part 396. The contacting part 402 projects rightward from a lower end of the first projection 400. The rear guard 404 protrudes rightward from a rear end of the contacting part 402. The front guard 406 protrudes rightward from a front end of the contacting part 402.

As shown in FIG. 24, in a state where the right clamp 348 and the left clamp 350 are attached to the clamp shaft 346, a cam sleeve 412 is inserted in the cam holes 392, 408 and a cam sleeve 414 is inserted in the cam holes 394, 410. Further, a support pin 416 is inserted in the cam sleeve 412, and a support pin 418 is inserted in the cam sleeve 414. An annular cushion 420 is attached between the right clamp 348 and the left clamp 350 and the flange 374 of the clamp shaft 346.

As shown in FIG. 20, in a state where the clamp shaft 346 is attached to the inner sleeve 342, the right clamp 348 and the left clamp 350 are inserted in the slit 344*a* of the outer sleeve 344, and the support pins 416, 418 are coupled to the outer sleeve 344. When the clamp shaft 346 moves in the front-rear direction with respect to the outer sleeve 344, the cam sleeve 412 attached to the support pin 416 moves in the front-rear direction inside the cam holes 392, 408 and the cam sleeve 414 attached to the support pin 418 moves in the front-rear direction inside the cam holes 394, 410, by which the right clamp 348 and the left clamp 350 move in the left-right direction.

As shown in FIG. 24, in an initial state where the clamp shaft 346 protrudes frontward from the outer sleeve 344, the right clamp 348 is positioned at farthest right with respect to the clamp shaft 346. In this state, a right wire passage 422 through which the wire W can extend is secured between the second projection 384 of the right clamp 348 and the flat plate part 370 of the clamp shaft 346, and an upper side of the right wire passage 422 is covered by the upper guard 388. This state of the right clamp 348 is termed a fully opened state. From this state, when the outer sleeve 344 moves forward with respect to the clamp shaft 346, the right clamp 348 moves leftward with respect to the clamp shaft 346. In this state, the wire W is held between a lower end of the contacting part 386 of the right clamp 348 and an upper end of the flat plate part 370 of the clamp shaft 346, and the front side of the right wire passage 422 is covered by the front guard 390. This state of the right clamp 348 is termed a fully closed state.

In the initial state where the clamp shaft 346 protrudes frontward from the outer sleeve 344, the left clamp 350 is positioned at farthest left with respect to the clamp shaft 346. In this state, a left wire passage 424 through which the wire W can extend is secured between the first projection 400 of the left clamp 350 and the flat plate part 370 of the clamp shaft 346. This state of the left clamp 350 is termed a fully opened state. From this state, when the outer sleeve 344 moves forward with respect to the clamp shaft 346, the left clamp 350 moves rightward with respect to the clamp shaft 346. In this state as well, the wire W can extend through the left wire passage 424, however, a rear portion of the left wire passage 424 is covered by the rear guard 404 and a front portion of the left wire passage 424 is covered by the front guard 406. This state of the left clamp 350 is termed a half-opened state. From this state, when the outer sleeve 344 further moves forward with respect to the clamp shaft 346, the left clamp 350 further moves rightward with respect to the clamp shaft 346. In this state, the wire W is held between an upper end of the contacting part 402 of the left clamp 350 and a lower end of the flat plate part 370 of the clamp shaft 346. This state of the left clamp is termed a fully closed state.

The wire W fed from the feeding part 260 to the guiding part 262 passes through the left wire passage 424 before it reaches the guiding part 262. Due to this, when the left clamp 350 enters the fully closed state and the wire W is cut by the cutter unit 252, a trailing end of the wire W wrapped around the rebars R is retained by the left clamp 350 and the clamp shaft 346.

Further, the wire W guided in the guiding part 262 passes through the right wire passage 422. Due to this, when the right clamp 348 enters the fully closed state, a tip end of the wire W wrapped around the rebars R is retained by the right clamp 348 and the clamp shaft 346.

Figure 27:
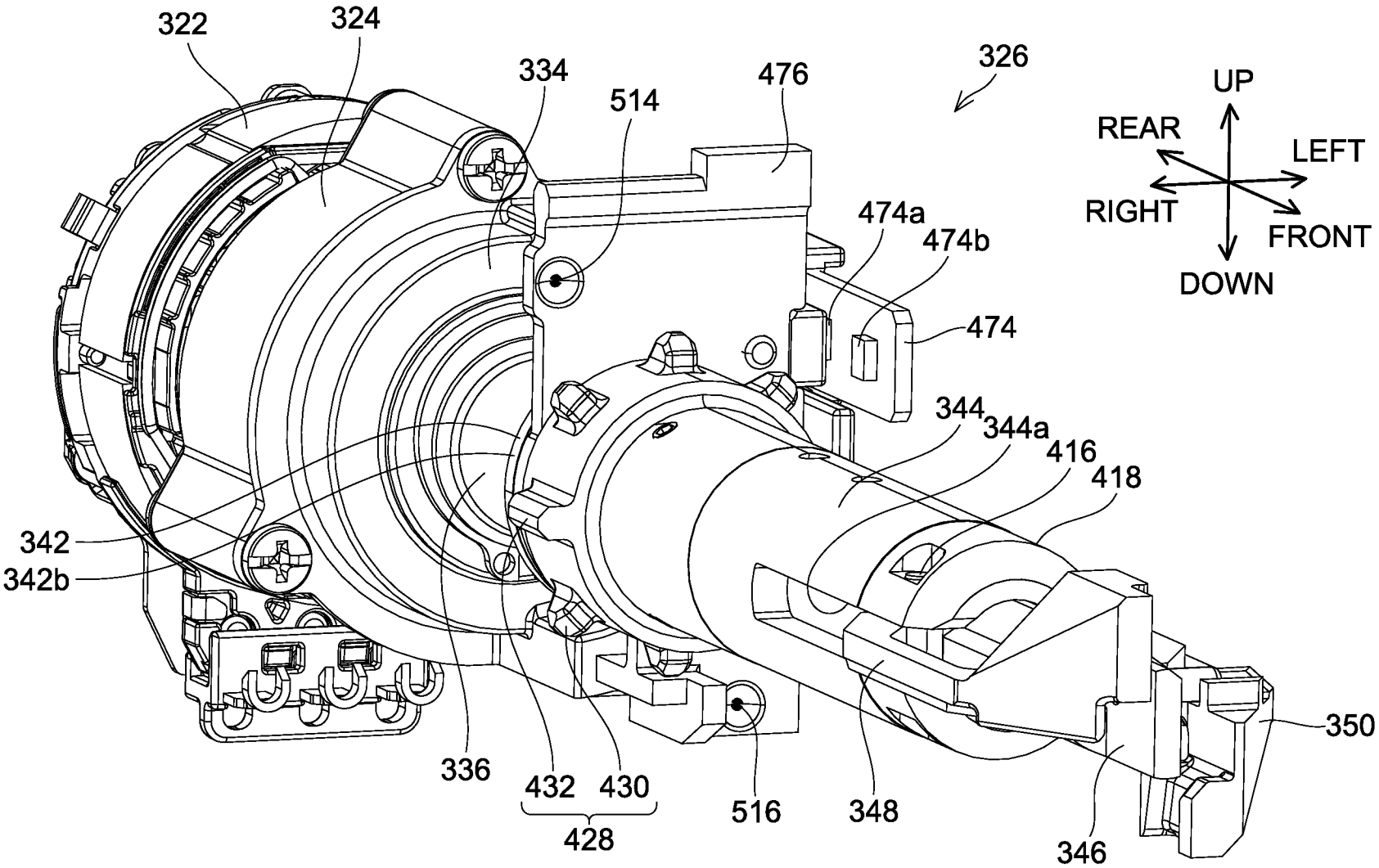
FIG. 27 is a perspective view of the twisting motor 322, the reduction gear unit 324, and the retaining part 326 of the twisting unit 254 of the rebar tying tool 202 of the second embodiment.

As shown in FIG. 27, eight fins 428 are arranged on a rear outer circumferential surface of the outer sleeve 344. The fins 428 extend in the front-rear direction. In the present embodiment, the eight fins 428 are arranged with 45-degrees intervals on the outer circumferential surface of the outer sleeve 344. Further, in the present embodiment, the eight fins 428 comprise seven short fins 430 and one long fin 432. A length of the long fin 432 in the front-rear direction is longer than a length of the short fins 430 in the front-rear direction. In the front-rear direction, a position of a rear end of the long fin 432 is same as positions of rear ends of the short fins 430. In the front-rear direction, a position of a front end of the long fin 432 is located frontward than positions of front ends of the short fins 430.

Figure 28:
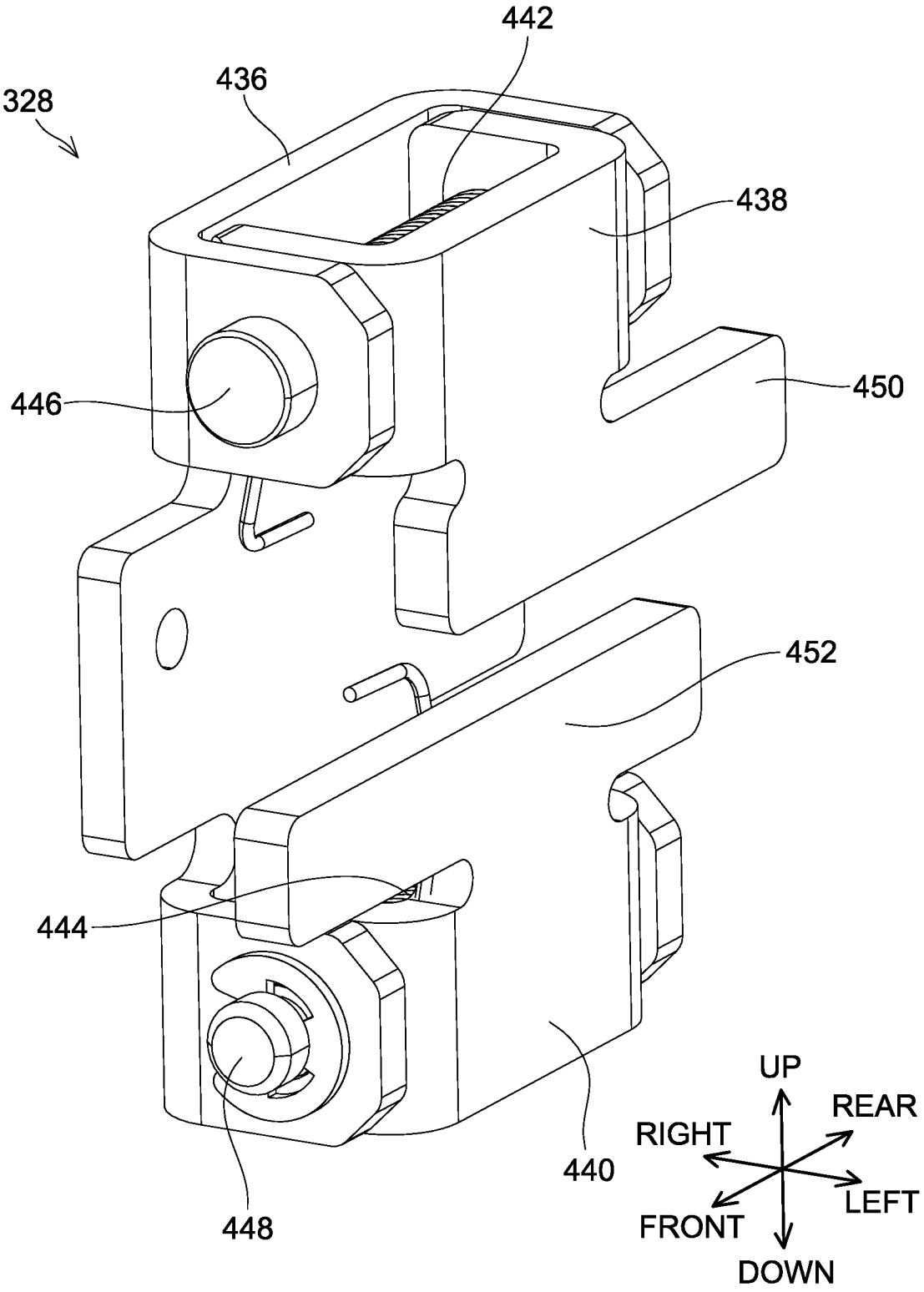
FIG. 28 is a perspective view of a rotation restrictor 328 of the rebar tying tool 202 of the second embodiment.

As shown in FIG. 20, the rotation restrictor 328 is disposed at a position corresponding to the fins 428 of the outer sleeve 344. The rotation restrictor 328 cooperates with the fins 428 to allow or prohibit rotation of the outer sleeve 344. As shown in FIG. 28, the rotation restrictor 328 comprises a base member 436, an upper stopper 438, a lower stopper 440, and torsion springs 442, 444. The base member 436 is fixed to the right main body 204*a*. The upper stopper 438 is pivotably supported at an upper portion of the base member 436 via a pivoting part 446. The upper stopper 438 comprises a restriction piece 450. The restriction piece 450 is positioned at a lower portion of the upper stopper 438. The torsion spring 442 biases the upper stopper 438 in a direction of opening outward (that is, in a direction along which the restriction piece 450 separates away from the base member 436). The lower stopper 440 is pivotably supported at a lower portion of the base member 436 via a pivoting part 448. The lower stopper 440 comprises a restriction piece 452. The restriction piece 452 is positioned at an upper portion of the lower stopper 440. A rear end of the restriction piece 452 is disposed frontward than a rear end of the restriction piece 450. A front end of the restriction piece 452 is disposed frontward than a front end of the restriction piece 450. The torsion spring 444 biases the lower stopper 440 in a direction of opening outward (that is, in a direction along which the restriction piece 452 separates away from the base member 436).

When the twisting motor 322 rotates forward with respect to the upper stopper 438 and the screw shaft 340 rotates in the left-hand screw direction as seen from behind, the rotation of the outer sleeve 344 is prohibited by the upper stopper 438 when the fins 428 of the outer sleeve 344 come into contact with the restriction piece 450. On the other hand, when the twisting motor 322 rotates in reverse and the screw shaft 340 rotates in the right-hand screw direction as seen from behind, the fins 428 of the outer sleeve 344 pushes in the restriction piece 450 even after they come into contact with the restriction piece 450. In this case, the upper stopper 438 does not prohibit the rotation of the outer sleeve 344.

When the twisting motor 322 rotates forward with respect to the lower stopper 440 and the screw shaft 340 rotates in the left-hand screw direction as seen from behind, the fins 428 of the outer sleeve 344 push in the restriction piece 452 even after they come into contact with the restriction piece 452. In this case, the lower stopper 440 does not prohibit the rotation of the outer sleeve 344. On the other hand, when the screw shaft 340 rotates in the right-hand screw direction as seen from behind, the rotation of the outer sleeve 344 is prohibited by the lower stopper 440 when the fins 428 of the outer sleeve 344 come into contact with the restriction piece 452.

Figure 29:
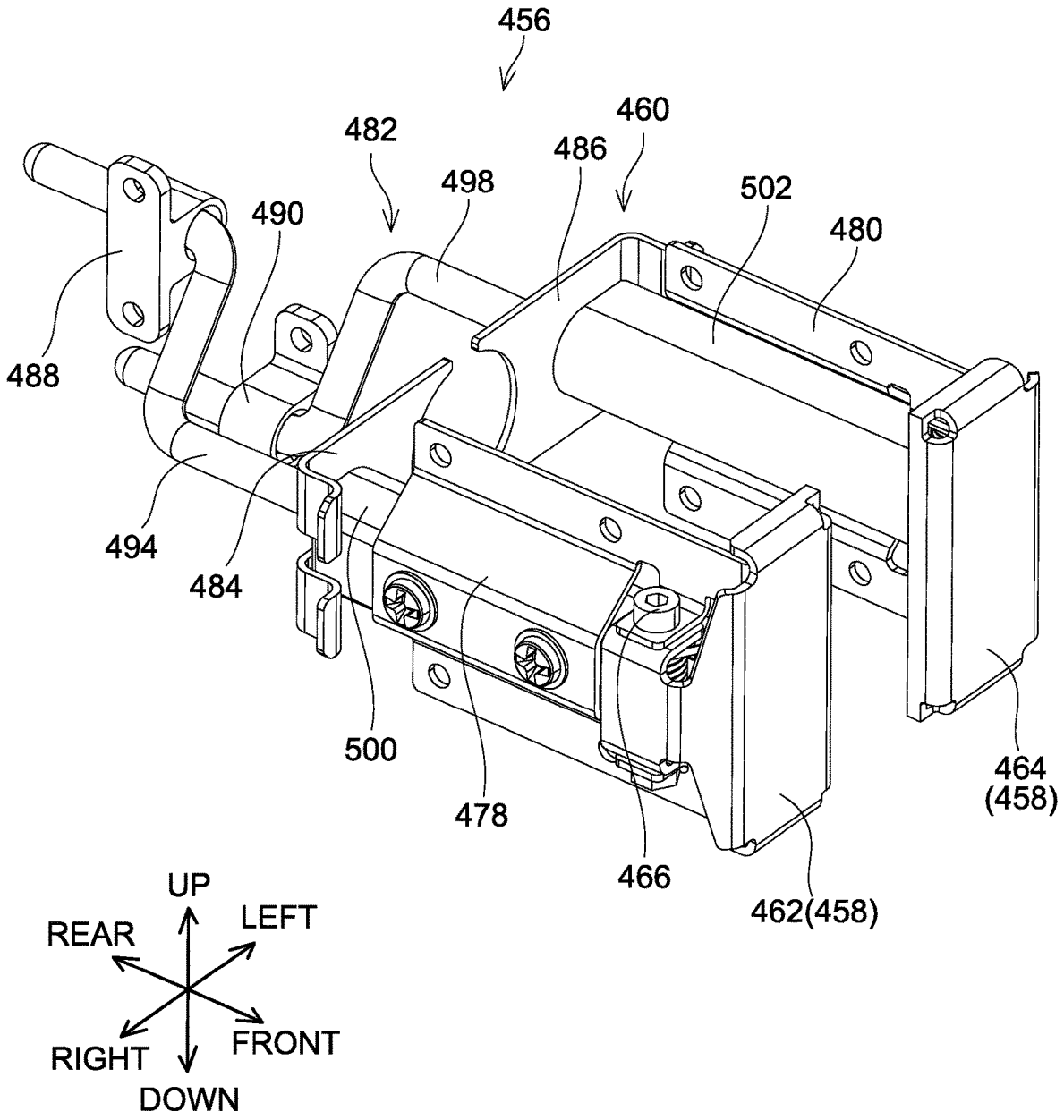
FIG. 29 is a perspective view of a rebar pusher 456 of the rebar tying tool 202 of the second embodiment.

As shown in FIG. 9, the rebar tying tool 202 further comprises a rebar pusher 456. As shown in FIG. 29, the rebar pusher 456 comprises a contacting member 458 and a pushing part 460. The pushing part 460 is configured to push out the contacting member 458 forward with respect to the main body 204. The pushing part 460 comprises a push plate 476 (see FIG. 27), base members 478, 480, a push rod 482, guide plates 484, 486, and rod holders 488, 490.

Figure 30:
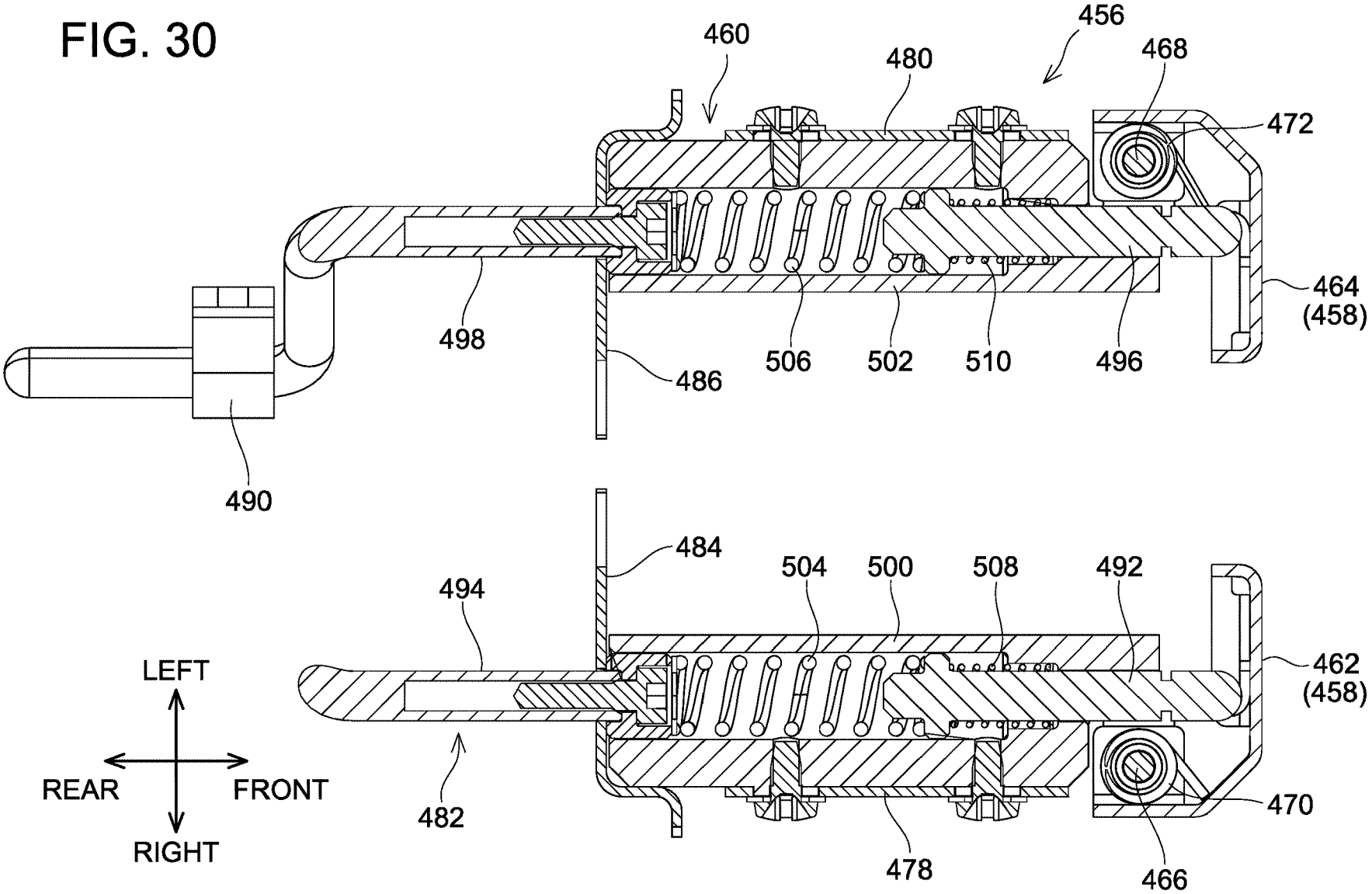
FIG. 30 is a cross-sectional view of the rebar pusher 456 of the rebar tying tool 202 of the second embodiment.

The contacting member 458 is disposed close to the front end of the main body 204. The contacting member 458 is disposed frontward than the twisting unit 254. The contacting member 458 comprises a first contacting part 462 and a second contacting part 464. The first contacting part 462 and the second contacting part 464 are disposed apart along the left-right direction. The first contacting part 462 and the second contacting part 464 are disposed separately. A shape of the first contacting part 462 is in a symmetric relationship with a shape of the second contacting part 464 with respect to a plane perpendicularly intersecting the left-right direction. The first contacting part 462 and the second contacting part 464 are supported by the base members 478, 480 so as to be pivotable about pivot axes 466, 468 (see FIG. 30) extending in the up-down direction. The base member 478 is fixed to the right main body 204*a*. The base member 480 is fixed to the left main body 204*b*. As shown in FIG. 30, torsion springs 470, 472 are attached to the pivot axes 466, 468. The torsion spring 470 causes a rearward biasing force acting in a closing direction to be applied to the first contacting part 462 with respect to the base member 478 by its elastic restoration force when the first contacting part 462 pivots frontward in an opening direction with respect to the base member 478. The torsion spring 472 causes a rearward biasing force acting in a closing direction to be applied to the second contacting part 464 with respect to the base member 480 by its elastic restoration force when the second contacting part 464 pivots frontward in an opening direction with respect to the base member 480.

The push rod 482 comprises front push rods 492, 496, rear push rods 494, 498, rod guides 500, 502, first compression springs 504, 506, and second compression springs 508, 510. The rod guides 500, 502 are fixed to the base members 478, 480. The front push rods 492, 496 are inserted into the rod guides 500, 502 from behind, and protrude frontward than front ends of the rod guides 500, 502. A front end of the front push rod 492 is disposed behind the first contacting part 462 and facing a rear surface of the first contacting part 462. A front end of the front push rod 496 is disposed behind the second contacting part 464 and facing a rear surface of the second contacting part 464. The front push rods 492, 496 are configured to move in the front-rear direction with respect to the main body 204 by being guided by the rod guides 500, 502. The rear push rods 494, 498 are inserted into the rod guides 500, 502 from behind. The rear push rod 494 is disposed behind the front push rod 492 and facing the front push rod 492, and the rear push rod 498 is disposed behind the front push rod 496 and facing the front push rod 496. The rear push rods 494, 498 are configured to move in the front-rear direction with respect to the main body 204 by being guided by the rod guides 500, 502. The first compression springs 504, 506 and the second compression springs 508, 510 are accommodated inside the rod guides 500, 502. The first compression springs 504, 506 couple the front push rods 492, 496 with the rear push rods 494, 498. The first compression springs 504, 506 cause an elastic restoration force to be applied when intervals between the front push rods 492, 496 and the rear push rods 494, 498 are decreased. The second compression springs 508, 510 bias the front push rods 492, 496 rearward with respect to the rod guides 500, 502. Spring stiffness of the second compression springs 508, 510 is smaller than spring stiffness of the first compression springs 504, 506. As shown in FIG. 29, the rear push rod 494 extends rearward from a front end to a rear end, bends to extend toward the left upper side, and further bends to extend rearward. The rear push rod 498 extends rearward from a front end to a rear end, bends to extend toward the right lower side, and further bends to extend rearward. As shown in FIG. 31, the rear push rods 494, 498 extend through a groove 526 defined in the right bearing retaining part 522 and a groove 528 defined in the left bearing retaining part 524. As shown in FIG. 29, the rod holders 488, 490 are configured to guide movements of the rear push rods 494, 498 in the front-rear direction. The guide plate 484 and the rod holder 488 are fixed to the right main body 204*a*. The guide plate 486 and the rod holder 490 are fixed to the left main body 204*b*.

As shown in FIG. 31, the guide plates 484, 486 surround a part of the outer circumferential surface of the outer sleeve 344. In FIG. 31, the guide plates 484, 486 are depicted by broken lines. The guide plates 484, 486 are disposed frontward than the right bearing retaining part 522 and the left bearing retaining part 524. When seeing the guide plates 484, 486 from the front side, the guide plates 484, 486 close the groove 526 recessed rightward from a left end of the right bearing retaining part 522 and the groove 528 recessed leftward from a right end of the left bearing retaining part 524 from the front side within ranges that do not overlap with the rear push rods 494, 498. Due to this, foreign particles such as iron powder generated from the rebars R can be suppressed from entering the grooves 526, 528 rearward from the front side.

As shown in FIG. 27, the push plate 476 is disposed between the rear end of the outer sleeve 344 and the flange 342*b* of the inner sleeve 342. The push plate 476 is configured to move in the front-rear direction with respect to the main body 204 following movements of the outer sleeve 344 and the inner sleeve 342 in the front-rear direction. As shown in FIGS. 18 and 19, a lower end of the push plate 476 is disposed at a position corresponding to the first lever member 312 and the second lever member 314 of the cutter unit 252. Due to this, when the push plate 476 moves frontward, the lower end of the push plate 476 comes into contact with the second lever member 314 and causes the second lever member 314 to pivot frontward. As shown in FIG. 27, the push plate 476 comprises a recess 514 defined at a position facing the rear end of the rear push rod 494 and a recess 516 defined at a position facing the rear end of the rear push rod 498. The recess 514 is positioned at a right upper portion of a front surface of the push plate 476. The recess 516 is positioned at a left lower portion of the front surface of the push plate 476.

When the push plate 476 moves frontward with respect to the main body 204, the rear ends of the rear push rods 494, 498 shown in FIG. 29 enter the recesses 514, 516 of the push plate 476. From this state, when the push plate 476 further moves frontward, the rear push rods 494, 498 are pushed in frontward, and the front push rods 492, 496 are pushed out frontward via the first compression springs 504, 506 shown in FIG. 30. Due to this, the first contacting part 462 and the second contacting part 464 pivot frontward in the opening direction, and are pressed against the rebars R.

As shown in FIGS. 18 and 19, the push plate 476 has a permanent magnet 476*a* attached thereto. As shown in FIG. 27, a sensor substrate 474 is disposed in the bearing box 334, corresponding to the permanent magnet 476*a*. The sensor substrate 474 has magnetic sensors 474*a*, 474*b* configured to detect magnetics of the permanent magnet 476*a*. The magnetic sensor 474*a* is disposed at a position facing the permanent magnet 476*a* when the twisting unit 254 is in the initial state. The controller 220 determines whether the twisting unit 254 is in the initial state by using the permanent magnet 476*a* and the magnetic sensor 474*a*. The magnetic sensor 474*b* is disposed at a position facing the permanent magnet 476*a* when the right clamp 348 is in the fully closed state and the left clamp 350 is in the half-opened state. The controller 220 determines whether the right clamp 348 is in the fully closed state and the left clamp 350 is in the half-opened state by using the permanent magnet 476*a* and the magnetic sensor 474*b*.

The magnetic sensors 474*a*, 474*b* and the controller 220 are electrically connected by seventh connecting cables 475 (see FIG. 10). As shown in FIG. 10, the seventh connecting cables 475 extend from the sensor substrate 474 and on the left side of the twisting unit 254, further extend inside the grip 206 via the connecting position between the main body 204 and the grip 206, and through inside the battery receptacle 208 to the controller 220.

Next, the tying operation of the rebar tying tool 202 will be described. The rebar tying tool 202 is configured to perform the tying operation when the trigger 212 is operated by the operator. Upon when the rebar tying tool 202 performs the tying operation, a feed-out process, a tip end retaining process, a pullback process, a trailing end retaining process, a cutting process, a tensioning process, a twisting process, and a returning process are executed.

(Feed-Out Process)

From the initial state of the rebar tying tool 202, when the feeding motor 256 shown in FIG. 14 rotates forward (that is, rotates in a direction D1 shown in FIG. 14), the feeding part 250 feeds out the wire W wound on the reel 232 by a predetermined length. As shown in FIG. 17, the tip end of the wire W extends through the fixed cutter member 308, the movable cutter member 310, the left wire passage 424 (see FIG. 24), the guiding part 262, and the right wire passage 422 (see FIG. 24) in this order. Due to this, the wire W is wrapped around the rebars R in the loop shape. When the feed-out of the wire W is completed, the feeding motor 256 stops.

(Tip End Retaining Process)

After completion of the feed-out process, when the twisting motor 322 shown in FIG. 20 rotates forward, the screw shaft 340 rotates in the left-hand screw direction. At this occasion, the outer sleeve 344 is prohibited from rotating in the left-hand screw direction by the rotation restrictor 328. Due to this, the outer sleeve 344 moves forward with respect to the main body 204 and the clamp shaft 346 together with the inner sleeve 342. Due to this, the right clamp 348 enters the fully closed state and the left clamp 350 enters the half-opened state. As a result, the tip end of the wire W is retained by the right clamp 348 and the clamp shaft 346. After this, the twisting motor 322 stops.

(Pullback Process)

After completion of the tip end retaining process, when the feeding motor 256 shown in FIG. 14 rotates in reverse (that is, in the direction D2 shown in FIG. 14), the feeding part 250 pulls back the wire W wrapped around the rebars R. Since the tip end of the wire W is retained by the right clamp 348 and the clamp shaft 346, the diameter of the wire W around the rebars R decreases. When the pullback of the wire W is completed, the feeding motor 256 stops.

(Trailing End Retaining Process)

Figure 32:
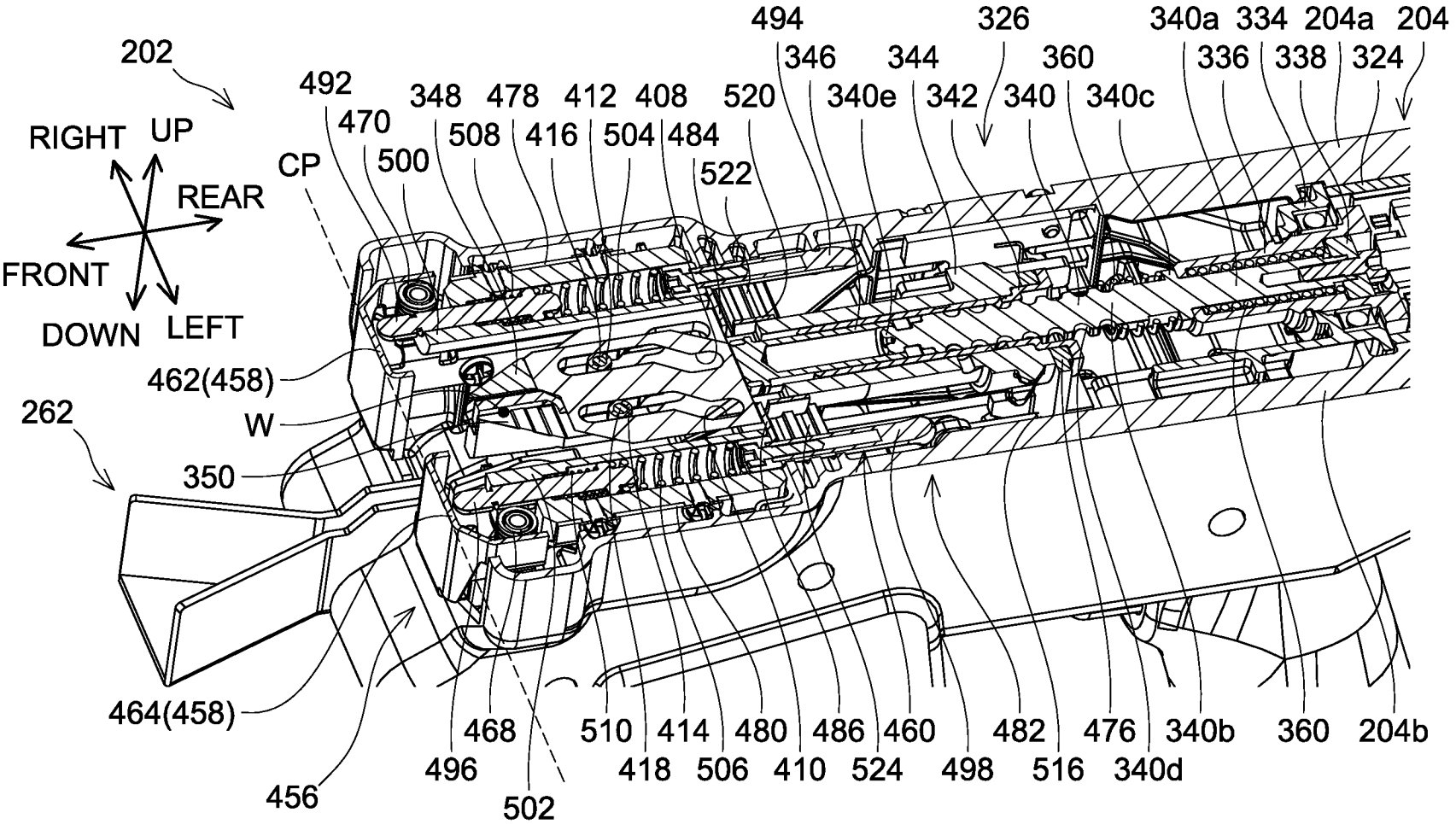
FIG. 32 is a cross-sectional view of a tensioning process of the rebar tying tool 202 of the second embodiment, in a state where rear ends of rear push rods 494, 498 have entered into recesses 514, 516 of a push plate 476.

After completion of the pullback process, when the twisting motor 322 shown in FIG. 20 rotates forward, the screw shaft 340 rotates in the left-hand screw direction. At this occasion, the outer sleeve 344 is prohibited from rotating in the left-hand screw direction by the rotation restrictor 328. Due to this, the outer sleeve 344 further moves forward with respect to the main body 204 and the clamp shaft 346 together with the inner sleeve 342. Due to this, as shown in FIG. 32, the left clamp 350 enters the fully closed state. As a result, the trailing end of the wire W is retained by the left clamp 350 and the clamp shaft 346.

(Cutting Process)

After completion of the trailing end retaining process, when the twisting motor 322 shown in FIG. 20 further rotates forward, the screw shaft 340 rotates in the left-hand screw direction. At this occasion, the outer sleeve 344 is prohibited from rotating in the left-hand screw direction by the rotation restrictor 328. Due to this, the outer sleeve 344 further moves forward with respect to the main body 204 and the clamp shaft 346 together with the inner sleeve 342, and the push plate 476 presses down the upper end of the second lever member 314 frontward as shown in FIG. 19. Due to this, the wire W is cut by the fixed cutter member 308 and the movable cutter member 310.

(Tensioning Process)

Figure 33:
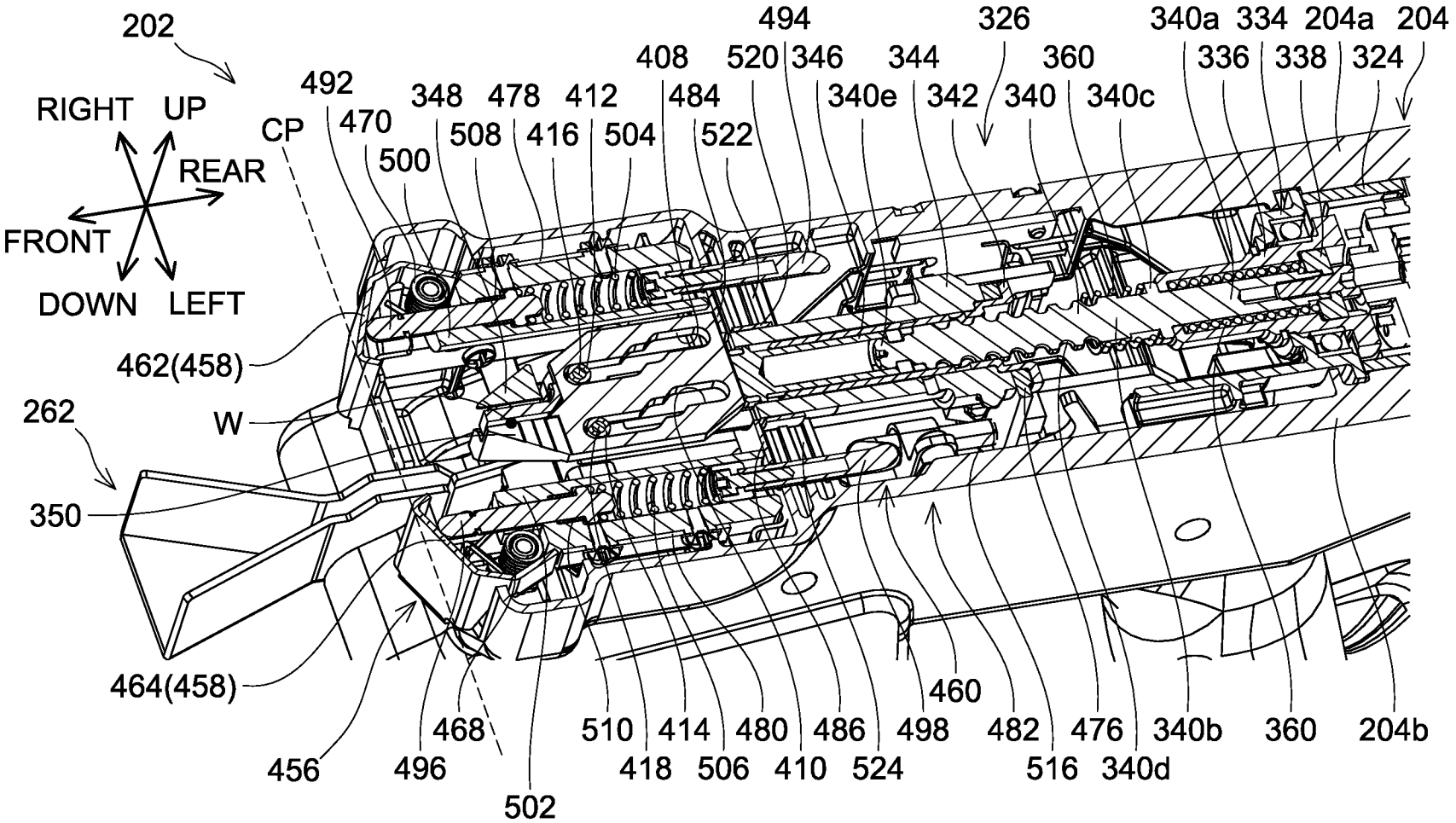
FIG. 33 is a cross-sectional view of the rebar tying tool 202 of the second embodiment in a state where the tensioning process is completed.

After completion of the cutting process, when the twisting motor 322 shown in FIG. 20 further rotates forward, the screw shaft 340 rotates in the left-hand screw direction. Since the outer sleeve 344 is prohibited from rotating in the left-hand screw direction by the rotation restrictor 328, the outer sleeve 344 further moves forward with respect to the main body 204 and the clamp shaft 346 together with the inner sleeve 342. After this, the rear ends of the rear push rods 494, 498 shown in FIG. 29 enter the recesses 514, 516 of the push plate 476 shown in FIG. 27. From this state, when the outer sleeve 344 and the inner sleeve 342 further move forward with respect to the main body 204 and the clamp shaft 346, the push plate 476 pushes out the rear push rods 494, 98 frontward. Due to this, as shown in FIG. 33, the rear push rods 494, 498 move forward, the front push rods 492, 496 move forward by the second compression springs 508, 510 being contracted, and the first contacting part 462 and the second contacting part 464 pivot frontward in the opening direction with respect to the base members 478, 480. Due to this, the rebars R are pushed out frontward with respect to the main body 204 (that is, the main body 204 is pushed back rearward relatively with respect to the rebars R), and the rebars R and the contacting position CP between the first contacting part 462 and the second contacting part 464 move apart from the retaining position of the wire W retained by the right clamp 348, the left clamp 350, and the clamp shaft 346. As a result, the wire W wrapped around the rebars R is thereby pulled. In the present embodiment, the contacting position CP moves frontward with respect to the main body 204.

(Twisting Process)

Figure 34:
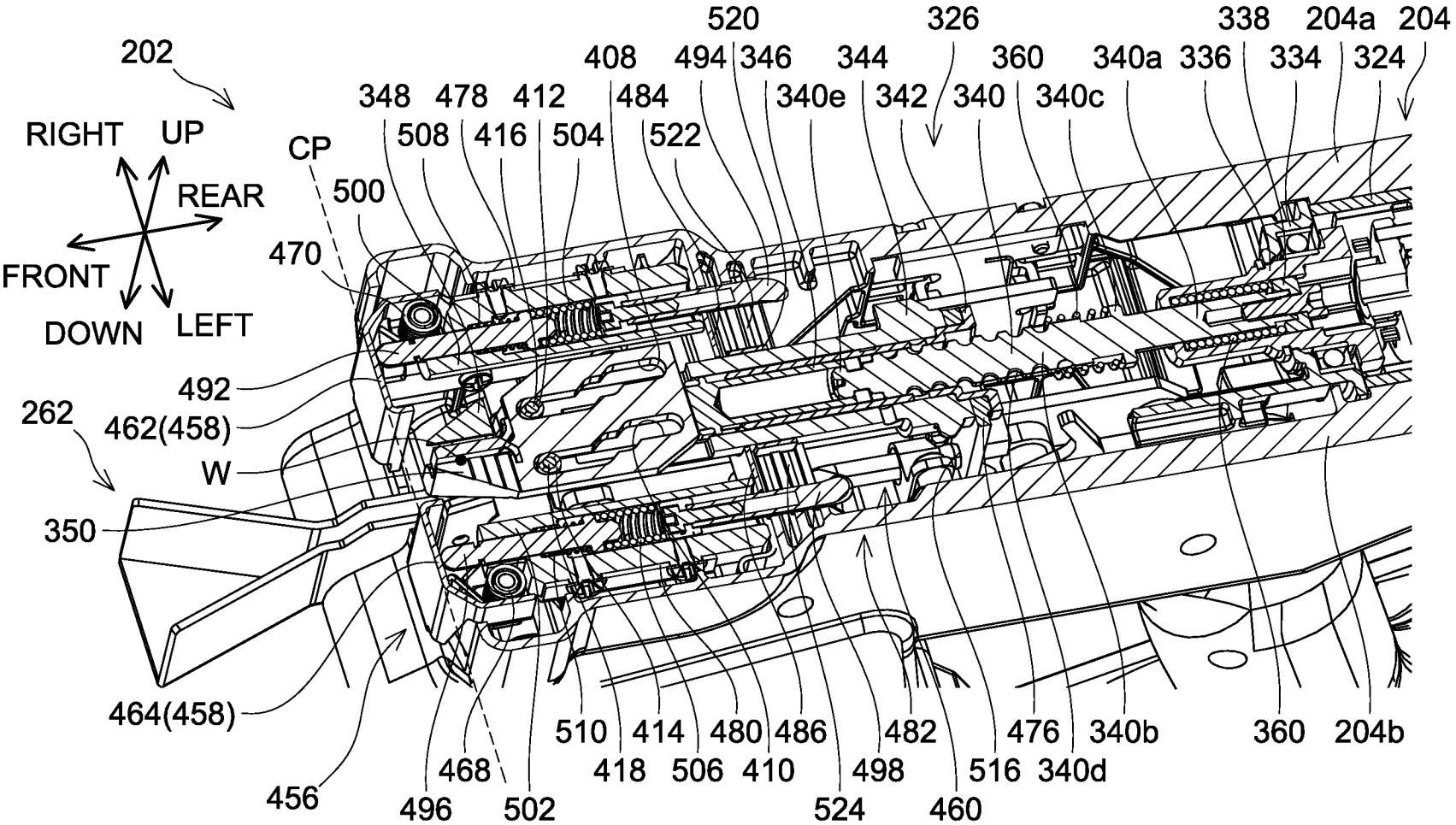
FIG. 34 is a cross-sectional view of the rebar tying tool 202 of the second embodiment in a state where a twisting process is completed.

After completion of the tensioning process, when the twisting motor 322 shown in FIG. 20 further rotates forward, the screw shaft 340 rotates in the left-hand screw direction. At this occasion, the outer sleeve 344 is allowed to rotate in the left-hand screw direction by the rotation restrictor 328, thus the outer sleeve 344, the inner sleeve 342, the clamp shaft 346, the right clamp 348, and the left clamp 350 rotate in the left-hand screw direction integrally. Due to this, the wire W wrapped around the rebars R is twisted. As the wire W is twisted, the twisting allowance of the wire W becomes shorter, thus the right clamp 348, the left clamp 350, and the clamp shaft 346 that are retaining the wire W are drawn toward the rebars R, and the main body 204 is drawn frontward toward the rebars R. As shown in FIG. 34, the first contacting part 462 and the second contacting part 464 pivot rearward in the closing direction with respect to the base members 478, 480 as a result and return to the initial positions, and the contacting position CP moves relatively rearward with respect to the main body 204. At this occasion, the front push rods 492, 496 move rearward, the second compression springs 508, 510 expand, and the first compression springs 504, 506 contract. From this state, when the wire W is further twisted, the clutch plate 338 shown in FIG. 22 moves forward against the biasing force of the compression spring 360 to a position at which the clutch piece 358 comes into contact with the second wall 356 of the clutch groove 352. Due to this, the screw shaft 340, the outer sleeve 344, the inner sleeve 342, the clamp shaft 346, the right clamp 348, and the left clamp 350 move forward with respect to the main body 204. As a result, the retaining position of the retained wire W moves relatively frontward with respect to the main body 204. When the twisting of the wire W is completed, the twisting motor 322 stops.

(Returning Process)

After completion of the twisting process, when the twisting motor 322 shown in FIG. 20 rotates in reverse, the screw shaft 340 rotates in the right-hand screw direction. At this occasion, the outer sleeve 344 is prohibited from rotating in the right-hand screw direction by the rotation restrictor 328. Due to this, the outer sleeve 344 retracts back with respect to the main body 204 and the clamp shaft 346 together with the inner sleeve 342. The left clamp 350 enters the fully opened state after being in the half-opened state, and the right clamp 348 enters the fully opened state. When the rotation in the right-hand screw direction is allowed by the rotation restrictor 328, the outer sleeve 344, the inner sleeve 342, the clamp shaft 346, the right clamp 348, and the left clamp 350 rotate in the right-hand screw direction integrally. When the long fin 432 comes into contact with the lower stopper 440, the rotation of the outer sleeve 344 is prohibited again. Due to this, the outer sleeve 344 returns to an angle of the outer sleeve 344 in the initial state. After this, the outer sleeve 344 retracts back again with respect to the main body 204 and the clamp shaft 346 together with the inner sleeve 342. When the twisting unit 254 returns to the initial state, the twisting motor 322 stops.

(Effects)

In the present embodiment, the rebar tying tool 202 further comprises the main body 204. As shown in FIG. 16, the cam part 290 is disposed inside the main body 204. The operating part 284 further comprises the lever 286 disposed outside the main body 204 and configured to be operated by the operator, and the coupler 288 penetrating the main body 204 and coupling the cam part 290 and the lever 286. One of the lever 286 and the cam part 290 is configured to slide along the main body 204. The rebar tying tool 202 further comprises the third biasing member 304 configured to bias the operating part 284 toward the main body 204 in the direction of pressing one of the lever 286 and the cam part 290 against the main body 204. In the above configuration, the biasing force of the third biasing member 304 is applied to one of the lever 286 and the cam part 290, by which one of the lever 286 and the cam part 290 is pressed against the main body 204. Due to this, the wobbling of the operating part 284 can be suppressed.

Further, the lever 286 is configured to slide along the outer surface of the main body 204, and is configured to keep the cover member 224 in the prohibiting state. The third biasing member 304 biases the cam part 290 with respect to the main body 204 toward inside the main body 204. In the above configuration, since the cam part 290 is biased toward inside the main body 204 by the biasing force of the third biasing member 304 being applied to the cam part 290, the lever 286 is thereby pressed against the outer surface of the main body 204. In this case, foreign matters can be suppressed from being caught between the lever 286 and the outer surface of the main body 204. Due to this, sliding performance of the operating part 284 can be suppressed from decreasing while at the same time the wobbling of the operating part 284 can be suppressed.

Further, the third biasing member 304 includes the compression spring. The coupler 288 passes inside the third biasing member 304. In the above configuration, the space inside the main body 204 required to dispose the cam part 290, the coupler 288, and the third biasing member 304 can be reduced.

Further, the rebar tying tool 202 further comprises the protrusion 302 and the recess 292 both disposed inside the main body 204 and configured to engage with each other. The position of the recess 292 is fixed with respect to the cam part 290. The position of the protrusion 302 is fixed with respect to the main body 204. In the above configuration, the protrusion 302 and the recess 292 are disposed inside the main body 204. As compared to the case in which the protrusion 302 and the recess 292 are disposed outside the main body 204, objects such as the rebars R can be suppressed from colliding with the protrusion 302 and the recess 292, and the protrusion 302 and the recess 292 can be suppressed from being damaged. Due to this, engagement defect between the protrusion 302 and the recess 292 can be suppressed from occurring.

(Corresponding Relationship)

The cover member 224 is an example of "stopper".

Specific examples of the present invention has been described in detail, however, these are mere exemplary indications and thus do not limit the scope of the claims. The art described in the claims include modifications and variations of the specific examples presented above.

In an aspect, the teeth 62*a* may not be disposed on the outer circumferential surface of the driving roller 62 and the teeth 64*a* may not be disposed on the outer circumferential surface of the driven roller 64. In this case, the driven roller 64 may rotate following the driving roller 62 by the outer circumferential surface of the teeth 62*a* and the outer circumferential surface of the driven roller 64 being in contact.

The cover 20 according to an aspect may include a groove that is depressed inward in the outer surface of the cover 20 instead of the engaging part 92. In this case, the cover 20 may be kept in the prohibiting state by a distal end of the lever part 84 engaging with the groove of the cover 20.

The operating part 82 according to an aspect may be configured to slide in the up-down direction and/or the front-rear direction.

The pivoting part 22 according to an aspect may be disposed in the front, rear, or upper part of the cover 20.

As another example of the stopper, the accommodating part 16 according to an aspect may not comprise the shaft 18*b*. In this case, the cover 20 may comprise a shaft to which the reel 26 can be attached.

As another example of the stopper, the accommodating part 16 according to an aspect may comprise a rivet part instead of the cover 20. The rivet part may include a first portion and a second portion. A diameter of the first portion may be greater than a diameter of the shaft 18*b* of the holder 18 and smaller than a diameter of the bearing hole 27*a* of the core 27 of the reel 26. A diameter of the second portion may be greater than the diameter of the shaft 18*b* and the diameter of the bearing hole 27*a*. The first portion is configured to be inserted into the bearing hole 27*a* while the second portion is configured not to be inserted in the bearing hole 27*a*. The first portion may be inserted into the bearing hole 27*a* of the core 27 of the reel 26 inserted onto the shaft 18*b* and the second portion may be brought into contact with the core 27, by which the reel 26 can be suppressed from detaching from the shaft 18*b*.

The accommodating part 16 according to an aspect may be disposed at a rear part of the main body 4. In this case, the accommodating part 16, the feeding part 52, and the guiding part 54 may be disposed in this order from rear to front. Further, the feeding motor 48 and the reduction gear unit 50 may be disposed above, below, on the right side of, or below the driving roller 62 of the feeding part 52. Further, the operating part 82 may be disposed more on the front side than the reel 26 held in the accommodating part 16 is and more on the rear side than the driven roller 64 of the feeding part 52 is.

The protrusion 302 according to an aspect may be disposed on the cam part 290. In this case, the recess 292 may be defined in the fixing member 300.

Technical features described in the description and the drawings may technically be useful alone or in various combinations, and are not limited to the combinations as originally claimed. Further, the art described in the description and the drawings may concurrently achieve a plurality of aims, and technical significance thereof resides in achieving any one of such aims.

What is claimed is:

1. A rebar tying tool configured to tie rebars with a wire, the rebar tying tool comprising:

a holder configured to hold a reel around which the wire is wound about a rotation axis;

a stopper configured to switch between a prohibiting state in which the stopper prohibits the reel from detaching from the holder and an allowing state in which the stopper allows the reel to detach from the holder;

a driving roller configured to rotate;

a driven roller configured to switch between a clamped state and a non-clamped state, wherein the wire is clamped between the driving roller and the driven roller when the driven roller is in the clamped state, and the wire is not clamped between the driving roller and the driven roller when the driven roller is in the non-clamped state; and a twisting unit comprising a retaining member that is configured to twist the wire fed around the rebars, wherein the driven roller is in the non-clamped state at all times while the stopper is in the allowing state.

2. The rebar tying tool according to claim 1, further comprising:

an operating part configured to move between an open position and a closed position, wherein the driven roller switches from the clamped state to the non-clamped state and the stopper switches from the prohibiting state to the allowing state when the operating part is operated from the closed position toward the open position.

3. The rebar tying tool according to claim 2, wherein the driven roller switches from the non-clamped state to the clamped state and the stopper switches from the allowing state to the prohibiting state when the operating part is operated from the open position toward the closed position.

4. The rebar tying tool according to claim 3, wherein the driven roller is disposed more on one side than the driving roller is in a direction in which the rotation axis extends, and the stopper is disposed more on the one side than the holder is in the direction in which the rotation axis extends.

5. The rebar tying tool according to claim 4, further comprising:

a motor configured to rotate the driving roller, wherein the operating part is disposed on the one side than the motor is in the direction in which the rotation axis extends.

6. The rebar tying tool according to claim 4, further comprising:

a motor configured to rotate the driving roller; and a reduction gear unit configured to decelerate rotation of the motor, wherein the operating part is disposed more on the one side than the motor is in the direction in which the rotation axis extends, and a link part is disposed more on the one side than the reduction gear unit is in the direction in which the rotation axis extends.

7. The rebar tying tool according to claim 2, further comprising:

a link part disposed between the operating part and the driven roller, wherein the link part is located in a first position when the operating part is located in the closed position, the driven roller being in the clamped state while the link part is located in the first position, and the link part is located in a second position when the operating part is located in the open position, the driven roller being in the non-clamped state while the link part is located in the second position.

8. The rebar tying tool according to claim 7, wherein the operating part comprises a cam part, and the cam part is configured to move the link part from the first position to the second position when the operating part is operated from the closed position toward the open position.

9. The rebar tying tool according to claim 8, wherein the operating part is configured to pivot about a pivot axis, the cam part gradually extends toward a link part side in a direction along which the pivot axis extends, the cam part gradually extending toward the link part side at a greater degree along one direction about the pivot axis and the cam part is configured to move the link part from the first position to the second position while being in contact with the link part when the operating part pivots to another direction about the pivot axis.

10. The rebar tying tool according to claim 9, further comprising:

a main body, wherein the cam part is disposed inside the main body, the operating part further comprises:

a lever part disposed outside the main body and configured to be operated by an operator; and a coupler penetrating the main body and coupling the cam part with the lever part, one of the lever part and the cam part is configured to slide along the main body, and the rebar tying tool further comprises:

a third biasing member configured to bias the operating part with respect to the main body in a direction along which the one of the lever part and the cam part is pressed against the main body.

11. The rebar tying tool according to claim 10, wherein the lever part is configured to slide along an outer surface of the main body and keep the stopper in the prohibiting state, and the third biasing member is configured to bias the cam part toward inside the main body.

12. The rebar tying tool according to claim 10, wherein the third biasing member comprises a compression spring, and the coupler passes inside the compression spring.

13. The rebar tying tool according to claim 10, further comprising:

a protrusion and a recess both disposed inside the main body and configured to engage with each other, a position of one of the protrusion and the recess is fixed with respect to the cam part, and a position of another of the protrusion and the recess is fixed with respect to the main body.

14. The rebar tying tool according to claim 7, further comprising:

a first biasing part configured to bias the link part from the second position toward the first position.

15. The rebar tying tool according to claim 2, wherein the operating part comprises a lever part configured to be operated by an operator, the stopper comprises an engaging part configured to engage with the lever part when the stopper is in the prohibiting state, and the lever part keeps the stopper in the prohibiting state when the lever part engages with the engaging part.

16. The rebar tying tool according to claim 2, wherein at least a part of the operating part is disposed between the reel and the driven roller when the rebar tying tool is viewed along a direction in which the rotation axis extends.

17. The rebar tying tool according to claim 16, wherein when a direction in which the rebars are disposed as viewed from the twisting unit is a front direction and the direction in which the rotation axis extends is a left-right direction, the operating part is disposed higher than the reel and lower than the driven roller.

18. The rebar tying tool according to claim 1, further comprising:

an operating part configured to move between an open position and a closed position, wherein the driven roller switches from the non-clamped state to the clamped state and the stopper switches from the allowing state to the prohibiting state when the operating part is operated from the open position toward the closed position.

19. The rebar tying tool according to claim 1, wherein the holder includes an opening, the stopper is configured to close the opening when the stopper is in the prohibiting state, an accommodating space is defined by the holder and the stopper, and the reel is placed in the accommodating space.

20. The rebar tying tool according to claim 19, further comprising:

a pivoting part connecting the holder with the stopper, wherein the stopper is configured to pivot with respect to the holder by the pivoting part, and the reel is disposed between the pivoting part and the driven roller when the rebar tying tool is viewed along a direction in which the rotation axis extends.

21. The rebar tying tool according to claim 1, further comprising:

a second biasing part configured to bias the stopper from the prohibiting state to the allowing state.

22. The rebar tying tool according to claim 1, wherein the driving roller has an outer circumferential surface comprising first teeth, and the driven roller has an outer circumferential surface comprising second teeth configured to mesh with the first teeth.

23. A rebar tying tool configured to tie rebars with a wire, the rebar tying tool comprising:

a holder configured to hold a reel around which the wire is wound about a rotation axis;

a stopper configured to switch between a prohibiting state in which the stopper prohibits the reel from detaching from the holder and an allowing state in which the stopper allows the reel to detach from the holder;

an operating part;

a driving roller configured to rotate;

a driven roller configured to switch between a clamped state and a non-clamped state, wherein the wire is clamped between the driving roller and the driven roller when the driven roller is in the clamped state, and the wire is not clamped between the driving roller and the driven roller when the driven roller is in the non-clamped state; and a twisting unit comprising a retaining member that is configured to twist the wire fed around the rebars, wherein the driven roller switches from the clamped state to the non-clamped state and the stopper switches from the prohibiting state to the allowing state when the operating part is operated.

* * * * *